US010326207B2

(12) United States Patent
Smith et al.

(10) Patent No.: US 10,326,207 B2
(45) Date of Patent: Jun. 18, 2019

(54) DISCRETE-DIPOLE METHODS AND SYSTEMS FOR APPLICATIONS TO COMPLEMENTARY METAMATERIALS

(71) Applicant: Duke University, Durham, NC (US)

(72) Inventors: David R. Smith, Durham, NC (US); Nathan Landy, Durham, NC (US); John Hunt, Durham, NC (US); Tom A. Driscoll, Durham, NC (US)

(73) Assignee: Duke University, Durham, NC (US)

( * ) Notice: Subject to any disclaimer, the term of this patent is extended or adjusted under 35 U.S.C. 154(b) by 485 days.

(21) Appl. No.: 15/023,373

(22) PCT Filed: Sep. 24, 2014

(86) PCT No.: PCT/US2014/057221
§ 371 (c)(1),
(2) Date: Mar. 19, 2016

(87) PCT Pub. No.: WO2015/094448
PCT Pub. Date: Jun. 25, 2015

(65) Prior Publication Data

US 2016/0204515 A1 Jul. 14, 2016

Related U.S. Application Data

(60) Provisional application No. 61/881,475, filed on Sep. 24, 2013.

(51) Int. Cl.

| | |
|---|---|
| ***H01Q 13/20*** | (2006.01) |
| ***H01Q 13/28*** | (2006.01) |
| ***H01Q 15/00*** | (2006.01) |

(52) U.S. Cl.
CPC ..... *H01Q 15/0086* (2013.01); *H01Q 13/28* (2013.01); *H01Q 15/0066* (2013.01); *H01Q 13/20* (2013.01)

(58) Field of Classification Search
CPC ..... H01Q 15/0086; H01Q 15/0006; H01Q 15/10; H01Q 13/22; H01Q 13/28; H01Q 21/24; G02B 5/008
See application file for complete search history.

(56) References Cited

U.S. PATENT DOCUMENTS

| | | | | |
|---|---|---|---|---|
| 2005/0110681 | A1* | 5/2005 | Londre | H01Q 1/246 343/700 MS |
| 2012/0194399 | A1* | 8/2012 | Bily | H01Q 13/28 343/772 |
| 2013/0018591 | A1* | 1/2013 | Grzegorczyk | G01N 22/00 702/19 |

(Continued)

OTHER PUBLICATIONS

Notification of Transmittal of the International Search Report and the Written Opinion of the International Searching Authority, or the Declaration, PCT International Application No. PCT/US2014/057221 dated Jun. 25, 2015.

*Primary Examiner* — Changhyun Yi
(74) *Attorney, Agent, or Firm* — Olive Law Group, PLLC

(57) ABSTRACT

Discrete-dipole methods and systems for applications to complementary metamaterials are disclosed. According to an aspect, a method includes identifying a discrete dipole interaction matrix for a plurality of discrete dipoles corresponding to a plurality of scattering elements of a surface scattering antenna.

33 Claims, 47 Drawing Sheets

(56) References Cited

U.S. PATENT DOCUMENTS

| | | | | |
|---|---|---|---|---|
| 2013/0057431 | A1* | 3/2013 | Lenormand | H01Q 21/0043 342/361 |
| 2013/0116980 | A1 | 5/2013 | Das et al. | |
| 2013/0135136 | A1 | 5/2013 | Haynes et al. | |
| 2013/0148194 | A1* | 6/2013 | Altug | G01N 21/554 359/350 |
| 2015/0162658 | A1* | 6/2015 | Bowers | H01Q 15/006 342/385 |

* cited by examiner (a) Cloak Designed with Clausius Mossotti (b) Cloak Designed with Nonlocal Corrections (a) The Physical Problem (b) Equivalent Problem in (A) and (B)

(b) Contribution from Image Dipoles (a) The Physical Problem (a) Retrieved Magnetic Polarizability (b) Simulation Domain (b) Total Scattering Cross-Section (a) Cloak design with CMMs

DISCRETE-DIPOLE METHODS AND SYSTEMS FOR APPLICATIONS TO COMPLEMENTARY METAMATERIALS

CROSS REFERENCE TO RELATED APPLICATIONS

This application is a 35 USC 371 application of International PCT Patent Application Number PCT/US14/57221, filed on Sep. 24, 2014 and titled DISCRETE-DIPOLE METHODS AND SYSTEMS FOR APPLICATIONS TO COMPLEMENTARY METAMATERIALS, which claims the benefit of and priority to U.S. Provisional Patent Application No. 61/881,475, filed Sep. 24, 2013 and titled DISCRETE-DIPOLE METHODS FOR APPLICATIONS TO COMPLEMENTARY METAMATERIALS; all of the contents of which are hereby incorporated by reference herein in their entireties.

FEDERALLY SPONSORED RESEARCH OR DEVELOPMENT

The technology disclosed herein was made in part with government support under grant number HSHQDC-12-C-00049 entitled "Metamaterial Transceiver for Compression Radio Frequency Imaging." The United States government may have certain rights in the technology.

TECHNICAL FIELD

The presently disclosed subject matter relates to discrete-dipole methods and systems for applications to metamaterials, complementary metamaterials, and/or surface scattering antennas.

BACKGROUND

Conventional optical devices consist mainly of shaped dielectrics and metals. The trajectories of individual rays of light are altered via refraction and reflection at the boundaries of these homogeneous materials. The traditional optical design process is therefore reduced to finding materials with better optical responses and optimizing their surface contours for various applications. Gradient-Index (GRIN) devices introduce a new degree of freedom to the design process by incorporating inhomogeneous dielectrics. Ray trajectories are no longer restricted to straight lines inside GRIN elements, and can instead be gently curved by the gradient in the index of refraction.

In some sense, Transformation Optics (TO) is a generalization of GRIN design. Instead of simply specifying a gradient in the isotropic refractive index of a material, TO yields individual gradients in all tensor components in the electrical permittivity $\overline{\overline{\epsilon}}$ and magnetic permeability $\overline{\overline{\mu}}$. However, while traditional optical design is based on the short wavelength approximations of geometrical optics, TO is accurate to the level of the macroscopic Maxwell's equations, and has shown application even at zero frequency.

Unfortunately, like GRIN technology, the design freedom afforded by TO comes at the cost of complexity and extreme material parameters. In principle, these designs can be implemented with metamaterials (MMs)—composites that provide artificial material responses. In practice, however, metamaterials can add a host of complexities and restrictions to the design process. The complexity of the TO material prescription has continually forced researchers to make simplifying approximations in order to achieve any of the desired functionality, even when the dimensionality of the problem is reduced and the polarization is restricted.

One significant application of metamaterials is in the design and implementation of surface scattering antennas. Surface scattering antennas are described, for example, in A. Bily et al, "Surface Scattering Antennas," U.S. Patent Application Publication No. 2012/0194399 ("Bily I"); A. Bily et al, "Surface Scattering Antenna Improvements," U.S. Patent Application No. 2014/0266946 ("Bily II"); and P.-Y. Chen et al, "Surface Scattering Antennas with Lumped Elements," U.S. Application No. 61/988,023 ("Chen"), each of which is herein incorporated by reference. Surface scattering antennas generally include a waveguide structure such as a coplanar waveguide, microstrip, stripline, or closed waveguide (such as a rectangular waveguide or substrate integrated waveguide), with a plurality of adjustable scattering elements coupled to and positioned along the waveguide. In some approaches the waveguide is a one-dimensional waveguide; in other approaches the waveguide is two-dimensional (as with a parallel plate waveguide or a plurality of parallel one-dimensional waveguides filling a two-dimensional antenna aperture). The adjustable scattering elements may include, for example, complementary metamaterial elements, such as CELC (complementary electric LC) or CSRR (complementary split ring resonators) structures. Complementary metamaterial elements are described, for example, in D. R. Smith et al, "Metamaterials for surfaces and waveguides," U.S. Patent Application Publication No. 2010/0156573 (herein incorporated by reference), and further described herein. In other approaches, the scattering elements are subwavelength patches positioned above apertures in the waveguide structure. The scattering elements can be made adjustable by various approaches described, for example, in Bily I, Bily II, and Chen, infra. For example, in some approaches the scattering elements include an electrically-adjustable material such as a liquid crystal material or a ferroelectric material, and the scattering elements are then adjusted by applying an adjustable voltage across the electrically-adjustable material; in other approaches the scattering elements include lumped elements such as transistors or diodes (including varactor diodes), and the scattering elements are then adjusted by applying voltages across the terminals of the lumped elements (e.g. to vary a capacitance or switch a transistor between ohmic/saturation mode and pinch-off mode). The set of possible adjustments of the adjustable scattering elements can be a binary set of adjustments (i.e. just two possible adjustment states) or a grayscale set of adjustment (i.e. more than two possible adjustment states).

These surface scattering antennas generally use a holographic principle to define a radiation pattern of the reference antenna. The radiation pattern is determined by an interference between a reference wave, which is a guided wave that propagates along the waveguide structure, and a holographic antenna configuration, which is a modulation pattern imposed on the antenna by the adjustments of the scattering elements. The design of an antenna modulation to provide a desired radiation pattern may be complicated by coupling between the scattering elements and by interactions such that the form of the modulation perturbs the reference mode.

In view of the foregoing, it is desired to provide improved techniques and systems for TO design with metamaterials and for holographic antenna pattern designs for surface scattering antennas.

BRIEF SUMMARY

Disclosed herein are discrete-dipole methods and systems for applications to complementary metamaterials. According to an aspect, a method includes identifying a discrete dipole interaction matrix for a plurality of discrete dipoles corresponding to a plurality of scattering elements of a surface scattering antenna.

According to another aspect, a system includes a surface scattering antenna with a plurality of adjustable scattering elements. The system also includes a storage medium on which a set of antenna configurations is written. Each antenna configuration may be selected to optimize a cost function that is a function of a discrete dipole interaction matrix.

According to another aspect, a method of controlling a surface scattering antenna with a plurality of adjustable scattering elements is provided. The method includes reading an antenna configuration from a storage medium, the antenna configuration being selected to optimize a cost function that is a function of a discrete dipole interaction matrix. The method also includes adjusting the plurality of adjustable scattering elements to provide the antenna configuration.

BRIEF DESCRIPTION OF THE SEVERAL VIEWS OF THE DRAWINGS

The foregoing aspects and other features of the present subject matter are explained in the following description, taken in connection with the accompanying drawings, wherein:

FIG. 3A depicts a diagram of spatial dispersion in an array of SRRs in a cubic lattice of period a;

FIG. 3B depicts a diagram of spatial dispersion in an array of SRRS in a cubic lattice of period a;

DETAILED DESCRIPTION

Figure 1A:
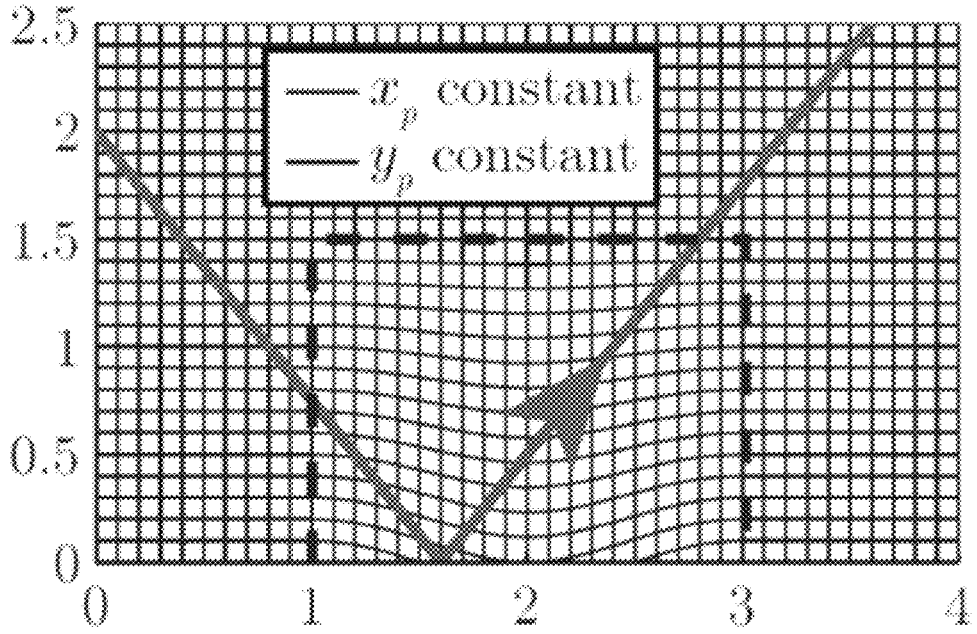
FIG. 1A depicts ray trajectories distorted by a TO-prescribed material in the virtual domain.

For the purposes of promoting an understanding of the principles of the present disclosure, reference will now be made to various embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e. at least one) of the grammatical object of the article. By way of example, "an element" means at least one element and can include more than one element.

Unless otherwise defined, all technical terms used herein have the same meaning as commonly understood by one of ordinary skill in the art to which this disclosure belongs.

It is noted that throughout the text bracketed numbers (e.g., [123]) shall refer to the references listed at the end of the Detailed Description, unless context indicates otherwise.

Transformation Optics

The TO algorithm is predicated on the form invariance of Maxwell's Equations. Maxwell's Equations in a given space take the same form in different coordinate systems so long as the material tensors $\overline{\overline{\epsilon}}$ and $\overline{\overline{\mu}}$ are redefined to incorporate the effects of the coordinate transformation. A detailed derivation of this equivalence may be found in [3] and it is not reproduced it herein.

Instead an application of this equivalence is described and examined. Consider a transformation of the form $x^{i'}=x^{i'}(x^{i'})$. The stationary form of the material parameters is: [4]

$$e^{i'j'}=|A_i^{i'}|^{-1}A_i^{i'}A_j^{j'}e^{ij} \tag{1.1}$$

where $A_i^{j'}$ is the Jacobian matrix of the transformation. A similar equation holds for $\overline{\overline{\mu}}$. This fact has been established in the study of the formal structure of electromagnetics [5]. The traditional interpretation is that the transformed material parameters and the untransformed material parameters represent the same material but in different coordinate systems. However, in 2006, Pendry [6] made the conceptual leap to interpret the transformed material parameters as distinct materials in the original space. The transformed material distorts electromagnetic quantities such that they behave as if they were in the original, (virtual), space as viewed in the transformed, (physical), coordinates. These two interpretations may be called the topological and material interpretations, respectively [4].

In the examples of the present disclosure, restriction is made to orthogonal coordinate systems, although it should be understood that the systems and techniques in accordance with the present subject matter should not be so limited and may be applicable to any suitable coordinate system. It can be convenient to adopt the dyadic notation for Eq. 1.1:

$$\overline{\overline{\varepsilon}}' = \frac{\Lambda\overline{\overline{\varepsilon}}\Lambda^T}{|\Lambda|}. \tag{1.2}$$

Figure 1B:
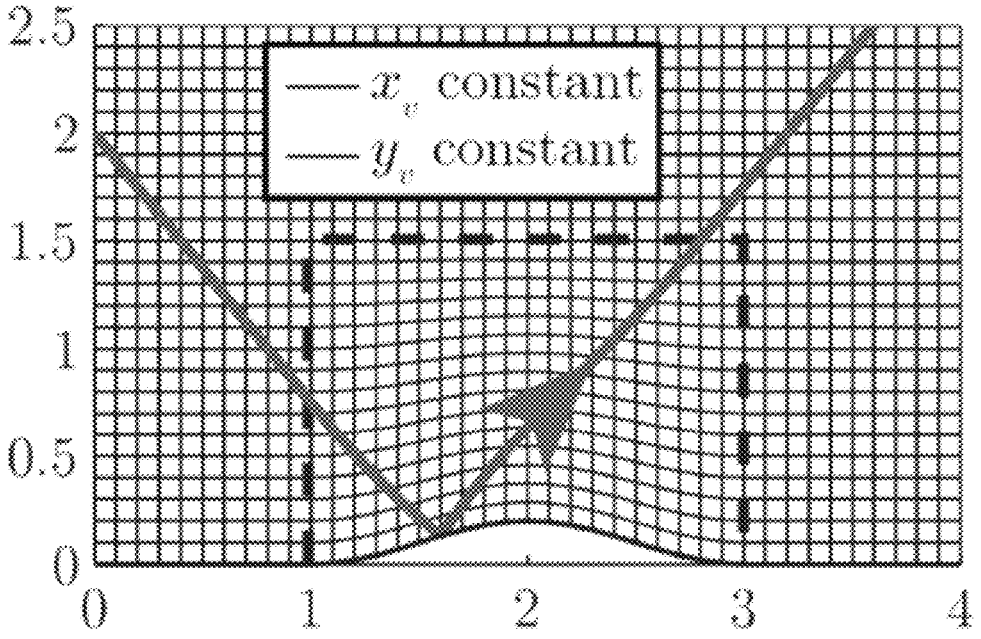
FIG. 1B depicts ray trajectories distorted by a TO-prescribed material in the physical domain.

This notation is used for much of the remainder of the present disclosure. As a concrete example of the method, consider the space shown in FIG. 1A, which illustrates ray trajectories distorted by a TO-prescribed material in the virtual domain. This region consists of a vacuum bounded on the bottom by a perfect electric conductor (PEC). This may be called the virtual domain, and label it with the subscript "v". The line with the arrow represents a ray that is reflected off of this PEC. A coordinate transformation can be found that maps this Cartesian space to a deformed one that produces a bump on the PEC (See FIG. 1B, which illustrates ray trajectories distorted by a TO-prescribed material in the physical domain). This is the physical domain, labeled with a "p". In the virtual space, lines of constant $x_p$ and $y_p$ may be plotted. When moving to the physical domain, lines of constant $x_v$ and $y_v$ may be plotted. In the physical domain, the ray trajectory appears deformed simply by virtue of the coordinate system imposed on it. However, if the material parameters is implemented from (Eq. 1.1), rays can be forced to follow this deformed trajectory. Thus, a type of electromagnetic cloak is formed that is capable of concealing a perturbation under a conducting plane. This device is referred to both as a "ground-plane cloak" and "carpet cloak".

Pendry's single insight therefore allows one to determine material prescriptions that distort electromagnetic space in innumerable ways. However, the experimental realization of TO media has been hampered by a lack of naturally occurring materials that possess the necessary extreme and controllable dielectric and magnetic responses. In the following, metamaterials are discussed and can be used to circumvent some of the limits of natural materials.

TO derived-devices may require full control over $\overline{\overline{\epsilon}}$ and $\overline{\overline{\mu}}$. However, Nature provides a very limited library of magneto-electric materials that provide the desired response and are also amenable to fabrication. Moreover, presently disclosed devices typically require precisely controlled inhomogeneity and anisotropy, neither of which can be adjusted directly in a naturally-occurring medium.

It is recognized that it is possible to create TO devices with naturally-occurring materials [7, 8]. It is noted, however, that this removes a number of degrees-of-freedom in design, and naturally restricts polarization. Therefore, the vast majority of experimentally-demonstrated TO devices have included artificial composites in their design [9, 10, 11, 12, 13, 14, 15, 16, 17, 18, 19, 20, 21, 22, 2]. These artificial composites are typically referred to as "metamaterials". Metamaterials may be referred to as artificial materials engineered to have properties that may not be found in nature. In this context, a material is a collection of microscopic entities (i.e. atoms or molecules), that collectively respond to external stimulus such that the behavior of the aggregate may be encapsulated in a few macroscopic parameters. In electromagnetics, materials are typically characterized by complex electrical permittivities and magnetic permeabilities.

In order to derive these quantities, the process of averaging or homogenization may be introduced to connect the detailed microscopic description of the systems disclosed herein to desired macroscopic definitions. This averaging process can be performed over a suitable region in the system. For periodic arrangements of elements, this integration may be performed over a single unit cell.

This homogenization process, as well as the terms "microscopic" and "macroscopic," can imply that there are length scales where the material definition is valid. These scales may differ quite a bit depending on physical aspects of the problem under consideration: a collection of particles may appear quite distinct to a high frequency acoustic waves and homogeneous to a low-frequency electromagnetic wave. Fortunately, the formal homogenization process reveals its own limitations, as will be described below.

Figure 2:
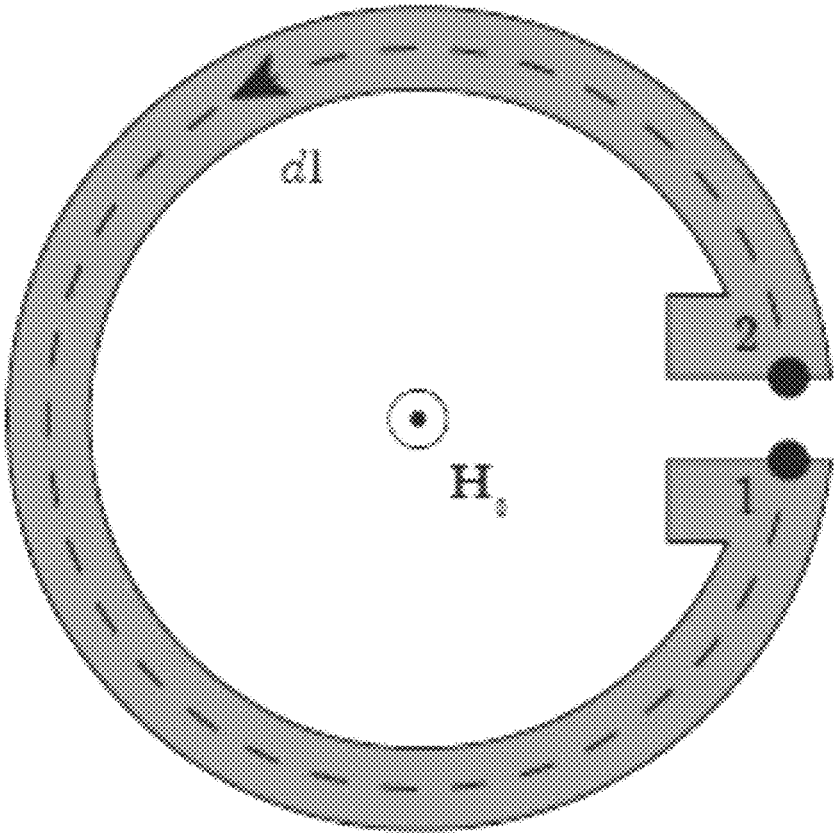
FIG. 2 is a diagram depicting a split-ring resonator.

The term "metamaterial" is clarified herein by analyzing one in detail. Since all metamaterial elements that currently exist across multiple physical disciplines cannot be feasibly described, various examples related to electromagnetism are described herein but should not be considered limiting, because other metamaterial elements may be utilized. The analysis disclosed herein uncovers a number of important concepts in effective medium theory as well as some of the inherent limitations of electromagnetic metamaterial design. Therefore the split ring resonator [23, 24] has been selected for use due to its historical importance in the field and its use later as described herein. A split-ring resonator may include a thin metallic wire or circuit board trace that has been bent to form a broken loop, as shown in FIG. 2, which illustrates a diagram depicting a split-ring resonator. An incident electromagnetic wave can cause currents to flow and scattered fields to develop. It may be determined that the amplitude of these currents by developing a circuit model, as shown by [25].

The scattered fields appear to satisfy the Dirichlet boundary condition on the conductor surface. Since $\nabla \cdot B=0$, B may be written as the curl of an auxiliary vector potential A [26]. This boundary condition is therefore:

$$E_0+E_S=E_0-\nabla\varphi-j\omega A=0, \tag{1.3}$$

In order to obtain a cause-and-effect relationship between the incident and scattered fields, integration along the contour shown in FIG. 2:

$$\int E_0 \cdot dl=j\omega\int A \cdot dl+\int\nabla\varphi \cdot dl. \tag{1.4}$$

The term on the LHS, $$\int_1^2 E \cdot dl, \tag{1.5}$$

clearly represents a source for the equivalent circuit. It may be assumed that the integral in E can be closed without effecting its solution, (meaning that the contribution from the gap is negligible). Therefore use Faraday's law can be used:

$$\nabla \times E=-j\omega B \tag{1.6}$$

combined with Stoke's theorem to find that Eq. 1.5 can be written as:

$$\int E_0 \cdot dl=j\omega\int B_0 \cdot dS, \tag{1.7}$$

(i.e. the magnetic flux through the circuit induces an EMF that serves as the source). Immediately, an ambiguity can be recognized: this source term may be uncovered by considering the imposed boundary conditions on the electric field only, it may be said that circuit is driven by the magnetic field. It is noted that at zero frequency, the time derivative of the magnetic flux is identically zero and therefore no current exists in the circuit. However, a natural magnetic medium may still show a response to a DC field. For this reason researchers often refer to artificial magnetism as first order spatial dispersion; and the exciting field can either be thought of as a uniform B-field, or as a spatially-varying electric field. This equivalence is highlighted because it presents an incomplete description of the problem. It does not consider the excitation effects of the uniform applied electric field, or other spatial derivatives of the applied electric field. For instance, the electric fields excite a quadrupole moment that contributes to the magnetic dipole moment in varying degrees as the orientation of the fields are changed [27, 28].

It may be assumed that a uniform current I is driven through the loop except at the broken ends. Charge can build up in his gap according to the continuity equation:

$$\nabla \cdot J=-j\omega\rho \tag{1.8}$$

This azimuthal current can provide the following magnetic dipole moment:

$$m=\int r\times J dV=2\pi R^2 I\,. \tag{1.9}$$

However, in order to determine the current explicitly, the model must be developed further as described below.

Now consider the first term on the RHS of Eq. 1.4. Using Stoke's theorem and the definition of A and, the following can result:

$$j\omega\int A_S \cdot dl=j\omega\int B_S \cdot dS. \tag{1.10}$$

Therefore, this term represents the magnetic flux that arises due to the induced currents, i.e. the inductance of the structure:

$$L = j\omega\frac{\int B_s \cdot dS}{I}. \tag{1.11}$$

The last term is the capacitance of the structure:

$$\int \nabla\varphi \cdot d1 = \frac{Q}{C}, \tag{1.12}$$

so that the circuit can be given by:

$$j\omega\Phi_m = j\omega LI - j\frac{1}{\omega C}. \tag{1.13}$$

Now an explicit expression for I can be provided, and m can be calculated. However, from the definition of the electric dipole moment:

$$p=Ql, \tag{1.14}$$

it can be seen that the magnetic field induces an electric dipole moment as well [29]. This electric dipole stems from the charges deposited on the edge of the conductor in the capacitive region, as indicated by Eq. 1.12. This is the hallmark of bianisotropy: an incident magnetic field creates an electric response and vice-versa. In such a medium, the constitutive relations are written as:

$$D=\overline{\overline{\epsilon}}+\overline{\overline{\kappa}}H$$

$$B=\overline{\overline{\mu}}H-\overline{\overline{\kappa}}^T E. \tag{1.15}$$

It can be seen that a medium composed of SRRs will behave unexpectedly if this bianisotropic effect is not considered [29, 30]. This can be critical for the design of TOdevices, since the formulation calls for purely anisotropic permittivities and permeabilities. Fortunately, careful MM design can mitigate-or even eliminate-the effect of bianisotropy [29, 9, 31].

The effects of bianisotropy are ignored for now. It is shown herein that an SRR can provide a magnetic moment, which can be assumed to be simply proportional to the field exciting the element:

$$m=\alpha H_0. \tag{1.16}$$

Now, in order to create an effective medium, these SRRs can be arrayed in some fashion. For example, split-rings can be arrayed in a simple cubic lattice since this is the most amenable to planar fabrication. This array can be excited with a uniform magnetic field. When done so, each element can be seen to produce a dipole moment in response to the applied field. However, it is noted that these dipoles also produce magnetic fields of their own. Therefore, the field exciting these element consists of both the applied field and the fields from all the other elements. It may be shown that the local field exciting each differs from the average field by [32]:

$$\langle H\rangle - H_{loc} = -\frac{P}{3}. \tag{1.17}$$

Figure 3A:
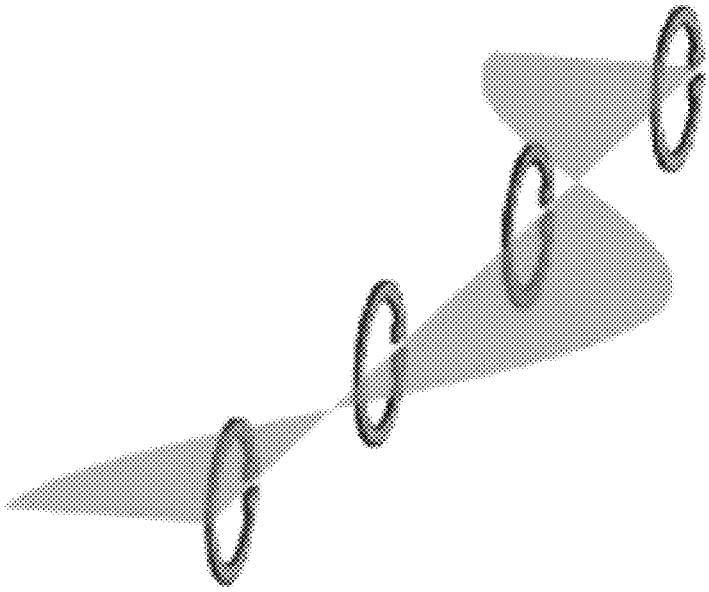

This phenomenon is investigated further herein. At this point, it is noted that this adds another degree of complexity, and Eq. 1.17 can differ quite a bit depending on the layout of the array. Now the frequency of the applied field can be increased. As it is done so, the average magnetic fields in the medium become non-uniform due to the finite wavelength. As the frequency is increased, the wavelength becomes shorter and shorter until the spatial variation of the wave is comparable to the spacing between SRRs, as shown in FIG. 3A, which depicts a diagram of spatial dispersion in an array of SRRs in a cubic lattice of period a. At this point, the definition of an effective medium can begin to break down. When magnetization is calculated:

$$M = \frac{1}{a^3}\int m(r)dV = \frac{1}{a^3}m, \tag{1.18}$$

as expected. However, when the average field is calculated, the following is found [33, 34]

$$\langle H\rangle = \frac{1}{a^3}\int H(r')dV = H_0\frac{\sin qa/2}{qa/2} + HOM. \tag{1.19}$$

If the average material properties in the cell are calculated, an explicit dependence of μ can be found on the wavenumber q in the system [33, 34]. Such is the consequence of averaging over a volume where there is a sinusoidal modulation to the magnetic and electric fields. This artifact becomes quite important at microwave frequencies where the wavelength of light imposes a natural inhomogeneity in the system. However, this spatial dispersion can manifest due to any field gradient, and its effects can be quite deleterious for even highly sub-wavelength unit cells [35].

Figure 3B:
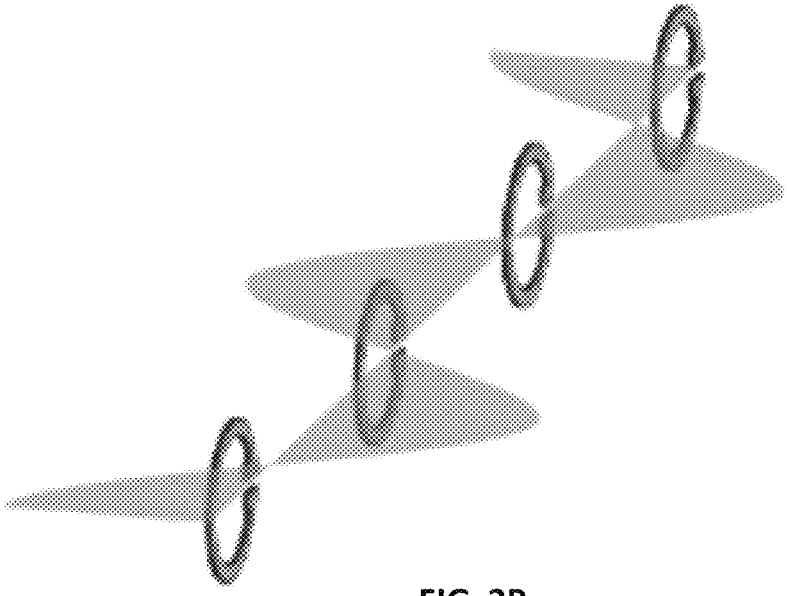

In FIG. 3B, the operational frequency has been increased even further. The applied field now shows significant variation over the SRR itself, and the dipolar circuit model breaks down. In order to accurately model this system, fine structure of the currents in the SRR and how they contribute to multipoles of various orders [36] may be considered:

$$J_i = j\omega[a_{ij}E_j + a_{ijk}(\nabla_l\nabla_k E_K)\ \ldots\ ] \tag{1.20}$$

If this is continued, the analysis can become increasingly cumbersome and can cease to provide insight into the behavior of the array. Therefore this can be stopped at any point.

In the preceding analysis, a number of caveats to the material interpretation of an array of split-ring resonators are introduced. A specific element size or configuration may not be identified and it be said that the material interpretation is invalid. Rather, the appropriateness of the material interpretation may depend on the particular circumstances of the system.

A "metamaterial" may be referred as a useful starting point for further analysis and design, i.e. the concept is enabling. This definition can free one from the stringent limitations imposed on a true effective medium, but it can be reminder of how a device might differ from such a material.

Quasi-Conformal Mappings in Transformation Optics

In this section, quasiconformal mappings and their use in transformation optical design in accordance with embodiments are described. By introducing a number of approximations, it can be shown that these mappings can provide for the design of TO devices with greatly simplified material specifications. Using the TO method, an examination is provided of the origin of aberration that appear from approximations described herein, and avenue for mitigating them are provided.

The physical field distribution in a TO device is determined by the specific coordinate transformation that is used in turn to determine the distribution of constitutive parameters. In most instances, however, the field distribution within the volume of the device is of no consequence: only the fields on the boundaries of the device are relevant, since the function of most optical devices is to relate a set of output fields on one port or aperture to a set of input fields on another port or aperture. From the TO perspective, device functionality is determined by the properties of the coordinate transformation at the boundaries of the domain. Since there are an infinite number of transformations that have identical behavior on the boundary, there is considerable freedom to find a transformation that is "optimal" in the sense that it maximizes a desired quantity, such as isotropy. A useful derivation of this condition is found in [3, 37], which is reproduced here for completeness.

A coordinate transformation produces a mapping between points in two domains. The constitutive parameters that result from a general mapping can be determined from Eq. 1.2. It is instructive to restrict attention to two-dimensional (2D) mappings of the form x'=[x'(x, y), xy'(x, y)], for which the material transformation tensors can be written:

$$\frac{AA^T}{|A|} = \begin{bmatrix} x_x'^2 + x_y'^2 & x_x'y_x' + x_y'y_y' & 0 \\ x_x'y_x' + x_y'y_y' & y_x'^2 + y_y'^2 & 0 \\ 0 & 0 & 1 \end{bmatrix}. \tag{2.1}$$

For compactness, differentiation with respect to coordinates with a subscript is indicated. The 2D mapping is useful for configurations in which the fields are constrained to propagate within the plane, and are polarized so that either the electric or magnetic fields are transverse to the out-of-plane direction, (TEz or TMz, respectively in the coordinate system). Ideally, the constitutive tensors have only diagonal components, meaning an orthogonality condition may be imposed on $\in_x y = \in_y x = 0$. According to Eq. 2.1, this constraint implies:

$$x_x'y_x' = -x_y'y_y'. \tag{2.2}$$

Mappings that satisfy Eq. 2.2 may generally correspond to materials that are anisotropic in the plane, since $\in_{xx} \neq \in_{yy}$. Imposing this second constraint and using Eq. 2.2, it can be found that:

$$x_x' = y_y'$$

$$x_y' = -y_x'. \tag{2.3}$$

Thus, the result of requiring that the constitutive tensors be diagonal and that the medium be isotropic in the plane is that the Eq. 2.3 must be satisfied; these may be Cauchy-Riemann equations that define conformal maps.

Under a conformal map, the transformed coordinate system remains locally orthogonal, and angles formed by curves passing through a given point in one coordinate system are conserved in the transformed coordinate system. For conformal transformations, it can be seen from Eq. 2.3 that the primed coordinates satisfy the vector form of Laplace's equation, or $$\nabla^2 x'=0. \tag{2.4}$$

Conversely, any transformation that satisfies Eq. 2.4 everywhere may be conformal, so that Laplace's equation can be employed to obtain maps numerically. The constitutive parameters that correspond to conformal maps are much easier to implement than general TO media; to illustrate this explicitly, if Eq. 2.3 is inserted into Eq. 2.1, it is found that the constitutive parameters have the form:

$$\frac{AA^T}{|A|} = \mathrm{Diag}[1, 1, |A|^{-1}]. \tag{2.5}$$

TO media that are of the form of Eq. 2.5 are often described as "isotropic" and "dielectric-only"; however, the use of these terms with respect to Eq. 2.5 and conformal transformations requires some qualification. The in-plane components of the constitutive tensors corresponding to the conformal mapping are identically unity. Nevertheless, such a transformation can be implemented with isotropic dielectrics if the polarization of the fields is restricted in the medium. With this restriction in place, the incident field only "sees" the relevant material components. In this case, the full transformation can be obtained with an isotropic dielectric if the electric field is constrained to be parallel to the z-axis, (TMz polarization). While explicitly solving the Cauchy-Riemann differential equations, (Eq. 2.3), analytically to find conformal mappings may seem a challenge, it is straightforward to prove using complex analysis that any mapping between two sets of complex coordinates that can be written as:

$$z'=f(z), \tag{2.6}$$

where z=x+iy and z=x'+iy' can satisfy equations 2.3. The use of complex analysis renders the effort of discovering conformal transformations a trivial matter; however, the limitations of conformal maps arise when the transformation domain is truncated. That is, once boundary conditions are applied to the governing differential equations, it is not always possible to achieve conformal modules equal to unity, and hence the Cauchy-Riemann equations do not apply universally to all geometries.

Quasi-Conformal Transformations and the Quasi-Isotropic Approximation

Figure 4:
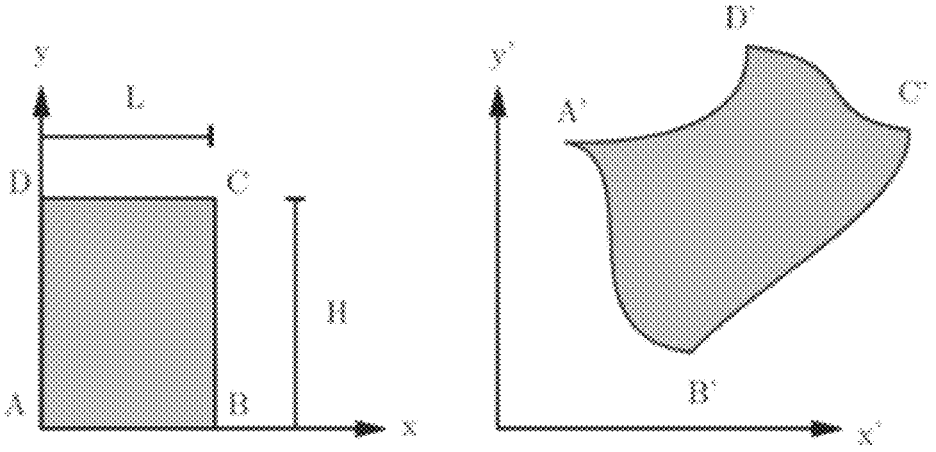
FIG. 4 illustrates a diagram of a mapping between a rectangle Q and quadrilateral domain R.

The Riemann Mapping theorem states that any simply-connected domain may be conformally-mapped to the unit disk. In essence, it guarantees that a conformal map can be found between any two domains by mapping each of them to each other through a mapping to the unit disk. However, as discussed previously, much of the power of TO is determined by the transformation at the boundary of the domain. For instance, it may be required that the transformation does not introduce reflections or change the direction of a wave entering or exiting the transformed domain. These conditions introduce additional restrictions to the transformation [38]. The most straightforward way to satisfy these conditions is to stipulate that the coordinates are the same as free space on the boundary of the transformed domain, (Dirichlet boundary conditions). At the very least, it may be required that each side of the physical region is mapped to the same corresponding boundary in the virtual domain. Mathematically, a vertex may be assigned to the intersection of each arc in the physical domain, as shown in FIG. 4. It may then be stipulated that each of these vertices is mapped to a corresponding vertex in the virtual domain. FIG. 4 illustrates a diagram of a mapping between a rectangle Q and quadrilateral domain R. The generalized quadrilateral R consists of four Jordan arcs and represents the physical domain. The vertices (A, B, C, D) in Q are mapped to vertices (A, B, C, D) in R, as shown in FIG. 4.

This extra constraint can severely limit the scope of conformally-equivalent domains. Specifically, once the sides of the quadrilateral domain have been specified, the region can only be mapped to another quadrilateral that shares the same conformal module. The conformal module (M) is simply the aspect ratio of the differential rectangle corresponding to a set of orthogonal coordinates. If the domain is rectangular, then M is the aspect ratio of the entire domain. Another concern relates to the boundary conditions directly. While Dirichlet boundaries are ideal for most purposes, they may be incompatible with the requirement of orthogonality at all points in the mapped domain. If x'(x)and M are simultaneously specified at the boundary, the problem becomes over-determined and it may not be guaranteed that the mapping can be orthogonal at the boundary [39]. Instead, a combination of Dirichlet and Neumann boundaries may be needed to simultaneously fix the geometry of the transformed domain and maintain orthogonality on the boundary. The Dirichlet component of the boundary conditions appear when it is stated that each arc in physical space corresponds to an edge in the virtual space, as shown in FIG. 4. Formally, it may be stated that $$x=0 \text{ on edge } D'A' \text{ and } x=L \text{ on edge } B'C'$$

$$y=0 \text{on edge } A'B' \text{ and } y=H \text{ on edge } C'D'. \tag{2.7}$$

Figure 5:
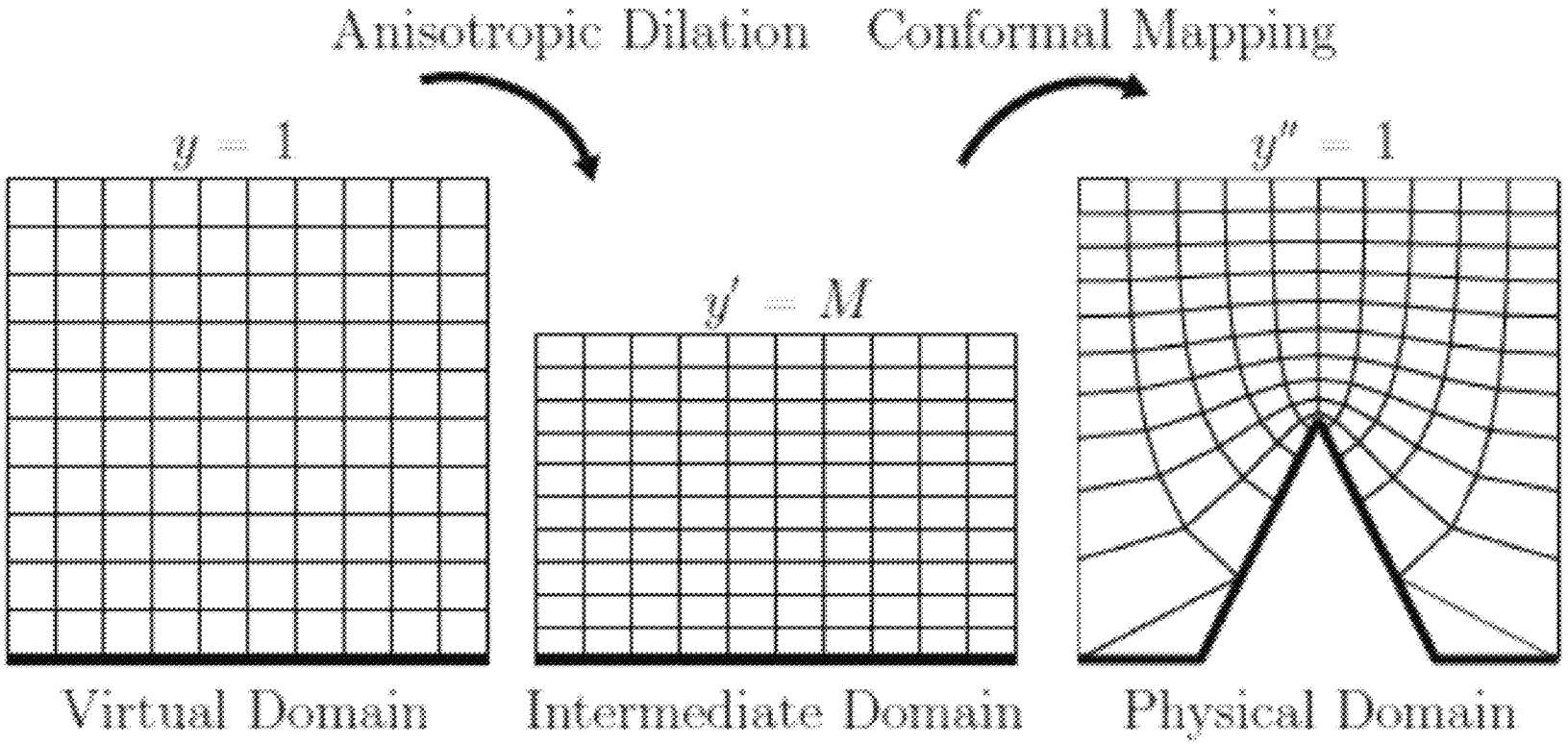
FIG. 5 depicts diagrams of a conformal module of the physical domain.
Figure 6:
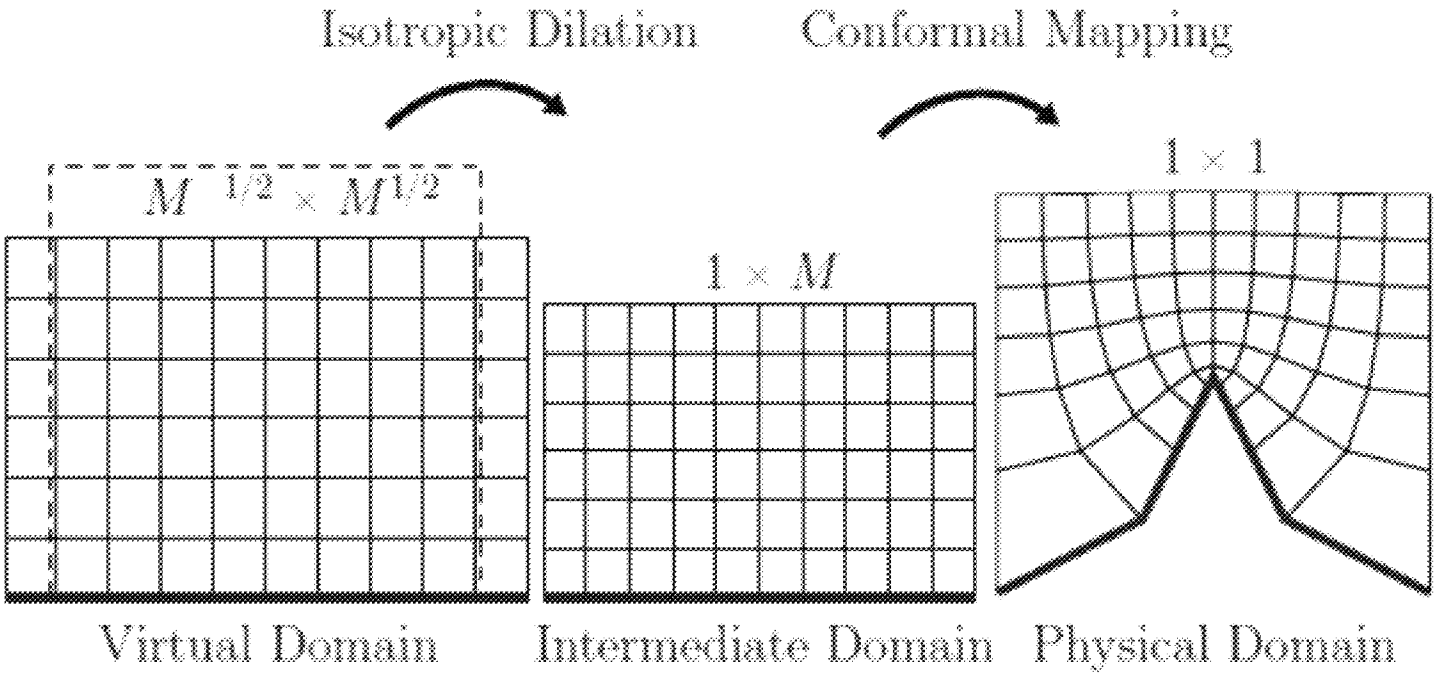
FIG. 6 depicts diagrams of a conformal module of the physical domain.

The Neumann component determines the position of the coordinate lines not specified by Eq. 2.7 and guarantees orthogonality on the boundary. The orthogonality condition on the other boundaries may be rewritten as:

$$\nabla' x\cdot\hat{n}=0 \text{ on } y=0, H$$

$$\nabla' y\cdot\hat{n}=\text{on } x=0, L \tag{2.8}$$

where $\hat{n}$ is the normal to the boundary curve. This formulation of the boundary conditions in terms of gradients in the physical space can be useful for the numerical solution process later. The important thing to note at this point is that the Neumann boundary condition can allow coordinate lines to slide along the boundary to ensure orthogonality. This deviates from the normal Dirichlet specification and aberrations may result depending on the severity of the deviation. Now, attend is brought to the conformal module. It may be considered what happens when two domains do not share the same conformal module. The effect may be considered via example using the tools of TO. A given region of space may be mapped onto a region that has a perturbation introduced, in this case a bump that protrudes into the domain from below, as shown on the right of the same figure. This configuration has become known as the carpet cloak, as discussed herein. If it is assumed that the lower boundary corresponds to a perfect electric conductor, then the mapping represents the design of a "cloak" that removes the effect of the perturbation from the reflecting surface [40]. For simplicity, it may be assumed that the dimensions of the physical domain are one by one in arbitrary units. Note that the conformal modules for the two domains are not the same; for the case shown in FIG. 5, the conformal module of the physical domain is approximately M=0.68. The physical domain has been intentionally made large to create a substantially different conformal module and to aid in visualization of the process. To compensate for the mismatch in conformal modules, first the virtual domain may be mapped to an intermediate domain having the same conformal module as the physical domain. The simplest way to do this is with a uniform dilation of the form y'=My. This intermediate domain may be mapped onto the physical domain with a conformal transformation, so that the functional dependence of the final transformed coordinates may be written x"=x"(x'(x)). The effect of the multiple transformations on the material parameters may be considered. The combined dilation and conformal mapping can produce material tensors of the form:

$$\frac{AA^T}{|A|} = \mathrm{Diag}[M^{-1}, M, (M|A_c)|^{-1}] \tag{2.9}$$

where $A_c$ is the Jacobian matrix of the conformal transformation between the intermediate and physical domains. For an assumed $TM^z$ polarization, the conformal module provides an immediate measure of the anisotropy of the TO medium, as well as its required magnetic response, since $M=\sqrt{\mu_x/\mu_y}$. Written in terms of x and y, the equation becomes $$Mx'_x=y'_y \tag{2.10a}$$

$$Mx'_y=-y'_x, \tag{2.10b}$$

so that Eq. 2.4 becomes $$M^{-2}x''_{xx}+x''_{yy}=0. \tag{2.11}$$

The solution to this vector equation is the quasi-conformal (QC) map. The QC map minimizes the anisotropy of mappings between domains of differing modules [40]. In general, there is no closed-form solution to Eq. 2.11, and it must be calculated using a numerical approach. Historically, iterative methods [39, 41] are often used. Since M is not known a priori, it may be calculated at each solution step and inserted into the discretized governing equations. Alternatively, the domains may be approximated by polygons, and the mapping may be computed analytically via Schwarz-Christoffel transformations [42]. It is also possible to simply circumvent the issue of calculating M by reformulating the problem in terms of its inverse. Noting that the inverse of a conformal map is conformal, the following equation can be written:

$$Mx_{x'}=My_{y'}, \tag{2.12a}$$

$$My_{x'}=-x_{y'}, \tag{2.12b}$$

Following the steps between Eqs. 2.3 and 2.4, it can be found that the vector Laplacian can be recovered for the inverse problem:

$$\nabla'^2 x=0. \tag{2.13}$$

Since the inverse mapping is independent of M, the inverse mapping may be calculated and Eq. 2.13 may be used to determine M in a single step. The forward transformation and material parameters can then be calculated in a post-processing step. This can be done iteratively, as before, or in a single step using PDE solution software based on the finite-element method [43]. The latter method may be used for all the mappings shown. Explicitly, Eq. 2.13 can be solved subject to the boundary conditions 2.7 and 2.8 in the physical domain using the software suite COMSOL.

Returning to Eq. 2.9, it can be seen that the cost of the QC map is immediately clear: the in-plane material tensors elements are no longer equal to each other. However, it is generally the case that small deformations of space create small perturbations to the conformal module of the physical domain. Li and Pendry [40] suggested that the small anisotropy be ignored in this case. Specifically, if local indices of refraction are defined along the principle axes of the transformation according to $$n_x=\sqrt{\mu_y \epsilon_z} \tag{2.14a}$$

$$n_y=\sqrt{\mu_x \epsilon_z} \tag{2.14b}$$

then geometric average of these quantities is $$n=\sqrt{\epsilon_z}=M|A_c|^{-1}. \tag{2.15}$$

To implement this transformation without magnetic materials, the in-plane tensors components may be set to unity and use Eq. 2.15 for the out-of-plane component. It can be seen that the resulting material parameters are those of an isotropic in-plane dilation $x''=\sqrt{M}x'$:

$$\frac{AA^T}{|A|} = \mathrm{Diag}[1, 1, M\,|\,A_c^{-1}] \tag{2.16}$$

All of the limitations of the isotropic approximation can be understood in terms of these intermediate transformations. Instead of correcting the aspect ratio of the virtual domain through anisotropic stretching, the virtual domain has been isotropically dilated. This is shown schematically in FIG. 2.3. Assigning the physical domain a side length of one, it can be seen that the virtual domain now has a horizontal extent of $M^{1/2}$ and a vertical extent of $M^{1/2}$. The intermediate transformation uniformly dilates the virtual domain by another factor of $M^{1/2}$, and this region is then conformally mapped to the physical domain. Note that neither the aspect ratio nor the area of the virtual domain is the same as the physical domain.

Now the limitations of QC mapping compared with the general TO formulation is discussed. Any deviation from the strict TO prescription may result in a number of undesired wave propagation properties, or aberrations.

Even when properly implemented with the anisotropic material properties of Eq. 2.9, the QC map requires Neumann boundary conditions that allow coordinate lines to "slip" along the boundary of the transformed domain. This can lead to aberrations, since the resulting material parameters are not those of free-space. In general, however, this type of error is small and can be mitigated by increasing the size of the transformation domain. The effect of slipping can be seen quantitatively with a study of QCM-derived optic as described herein. A more significant problem arises from the isotropic approximation represented by the material prescription in Eq. 2.16. Since the virtual and physical domains are no longer the same size, the transformations no longer result in a strictly TO medium; instead, the resulting distributions of material parameters are only approximately correct, and will introduce a number of aberrations. The aberrations that result from the QC approximation will clearly depend on the severity of the transformation: larger deformations of space may result in larger changes in the module. However, even small changes in the module can disrupt the functionality of a QC device. It has been shown that carpet cloaks are always rendered visible when anisotropy is neglected, regardless of the size of the perturbation [44].

Despite its limitations, the QC method has found many applications. For example, those aberrations that might be manifest in ray-tracing analyses [44] can be obscured when the device is on the order of the wavelength of operation so that diffractive effects dominate device behavior. This is a common situation at microwave frequencies, and the QC method may be applied to flatten conventional dielectric lens- and parabolic reflector-antennas without significant loss in performance [45, 46, 47]. Alternatively, the method can be used to reshape antenna radiation patterns by reshaping the boundary of a domain containing the antenna [48]. Also, an attempt to mitigate aberrations introduced by the QC method may be implemented by exploiting extra degrees of freedom that might exist in the design. For instance, as have been shown, the QC map may be required when the conformal module of the physical and virtual domains are not the same. This situation is typically the case for the carpet cloak, whereby the boundaries of the cloak intercept free space on three sides of the domain. But there may be other cases where the boundary conditions are less severe. This will be demonstrated via example.

Figure 7:
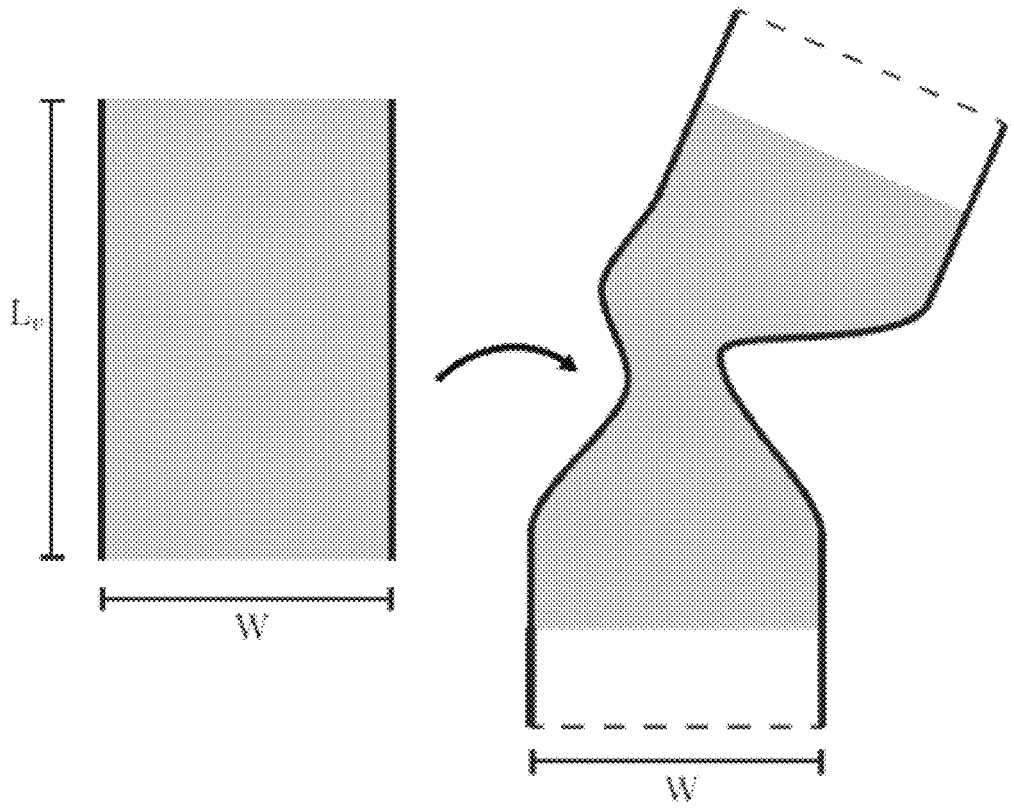
FIG. 7 depicts diagrams of conformal mapping applied to a waveguide bend.

Consider a metallic waveguide operating in the TE10 mode, as shown in FIG. 7. FIG. 7 depicts diagrams of conformal mapping applied to a waveguide bend. Referring to FIG. 7, a rectangle is mapped to a distorted waveguide on the right. The height of the rectangle is chosen such that it shares the same conformal module as the bent domain. Inserting a kink or a bend in this waveguide can, in general, cause reflections. TO can be used to map this distorted region to a straight one and restore performance [49, 50]. However, it is noted that there is some ambiguity when the transformation is defined: how long is the virtual domain? Theoretically, any desired length may be chosen and performance may be unchanged up to a phase shift in the wave exiting the transformed region. The length of the virtual domain may be set to be equal to the conformal module of the physical domain. When this is done, the transformation becomes strictly conformal, and a dielectric-only implementation may be used without cost [51, 52]. The calculation is straightforward: first the QC map may be calculated numerically using an arbitrary length virtual domain. subsequent M may be calculated according to Eq. 2.10. With this knowledge, the substitution of dy→M dy may be made to effectively scale the virtual domain. This technique may be suitably used to help alleviate some of the aberrations that appear in the optics modified with QCTO.

Quasi-Conformal Transformation Optics in 3D

Figure 8:
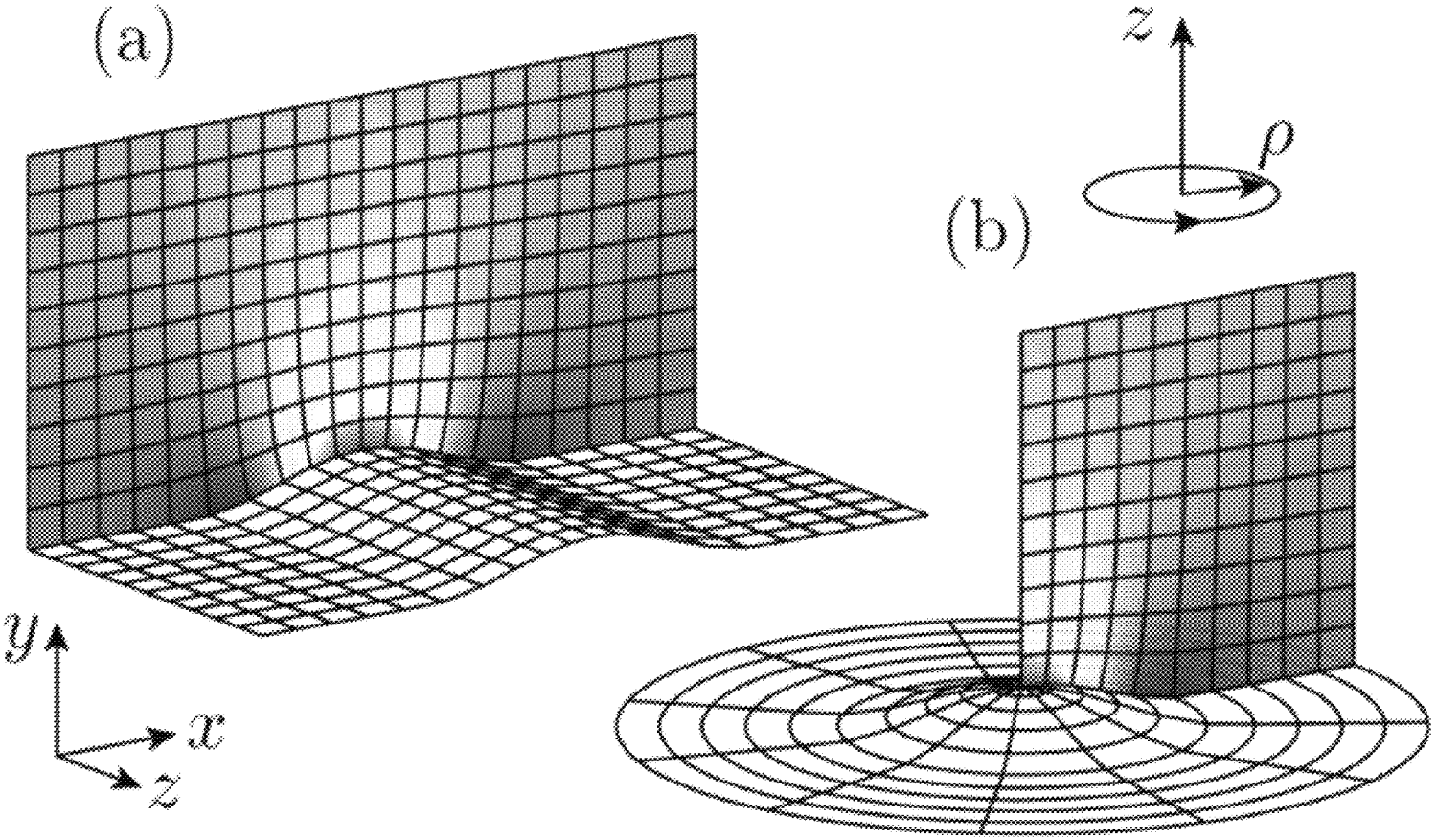
FIG. 8 depicts quasi-conformal mapping in Cartesian and cylindrical coordinate systems.

A quasi-conformal transformation in the plane may be considered as depicted in FIG. 8, which have determined as described herein. It is assumed that the deformation of the module is negligible, (M≈1), or that have been scaled the virtual domain to enforce the conformal condition as discussed at the end of the last section. In part, the simplicity of the QCTO method arises from the reduced dimensionality of the problem. The question then naturally arises: Can this simplicity be retained for other systems that exhibit some form of invariance? For instance, since many optical systems are rotationally symmetric about an optical axis, i.e. $\partial_\phi=0$, it is natural to apply the conformal mapping procedure in the ρ-z plane, as depicted conceptually in FIG. 8, which is a depiction of the same quasi-conformal mapping in (a) Cartesian and (b) cylindrical coordinate systems. This procedure is slightly more involved than the Cartesian case because of the complications of working in cylindrical coordinates [53]. This may begin by considering the 2D mapping. The coordinate transformation can be of the form:

$$\rho'=\rho'(\rho,z) \tag{2.17a}$$

$$\phi'=\phi \tag{2.17b}$$

$$z'=z'(\rho,z). \tag{2.17c}$$

The Jacobian of the coordinate transformation is then:

$$A_c=\begin{bmatrix}\rho'_\rho & 0 & \rho'_z\\ 0 & 1 & 0\\ z'_\rho & 0 & z'_z\end{bmatrix}. \tag{2.18}$$

Following the procedure described above and making the substitutions y→z, the transformed material parameters derived from Eq. 1.2 can be found to have the form:

$$\frac{A_cA_c^T}{|A_c|}=\mathrm{Diag}[1,|A_c|^{-1},1], \tag{2.19}$$

where $A_c$ is now understood to be the Jacobian of the conformal transformation in the ρ-z plane. While the material prescription is complete at this point, it is now provided a highlight of the subtlety of working in non-Cartesian coordinate systems. The material parameters that have been derived are expressed in a coordinate basis. This is not the typical basis used to express physical quantities. To illustrate the complications this causes, consider the ϕ-basis vector:

$$\phi=\rho^{-1}(x\sin\phi-y\cos\phi). \tag{2.20}$$

It is clear that ϕ is not normalized, implying that the material response of Eq. 2.19 may have a different physical meaning depending on its position in the mapped space. In particular, the in-plane components of Eq. 2.19 may require a non-vanishing response even though they are expressed as unity in this basis. However, Eq. 2.20 suggests a conversion to a unit basis through the change-of-basis matrix:

$$A_{cu}=\mathrm{Diag}[1,\rho,1], \tag{2.21}$$

and back to a coordinate basis with:

$$A_{uc}=A_{cu}^{-1}=\mathrm{Diag}[1,\rho^{-1},1]. \tag{2.22}$$

To determine the resulting material parameters, Eq. 2.22 may be used to transform from the traditional unit basis into a cylindrical coordinate basis. In the coordinate basis, coordinate transformation is performed with Eq. 2.19 and then return to the, (now transformed), unit basis with Eq. 2.21. The total transformation operator can be expressed as:

$$A_T=A_{cu}A_cA_{uc} \tag{2.23}$$

or $$A_T=\begin{bmatrix}\rho'_\rho & 0 & \rho'_z\\ 0 & \frac{\rho'}{\rho} & 0\\ z'_\rho & 0 & z'_z\end{bmatrix}. \tag{2.24}$$

Now Eq. 1.2 may be used to find that the transformed material parameters are:

$$\frac{AA^T}{|A|} = \mathrm{Diag}\left[\frac{\rho'}{\rho}, \frac{\rho}{\rho'}, \frac{1}{|A_c|}, \frac{\rho'}{\rho}\right]. \tag{2.25}$$

As in the Cartesian case, the parameters are orthotropic; however, for the cylindrical case the in-plane tensor components are no longer those of free-space. The factor of ρ arises from the fact that the differential volume element in cylindrical coordinates is a function of ρ. The transformed material parameters must compensate for this extra dilation of space between the virtual and physical coordinates. Additionally, the material parameters are orthotropic in cylindrical coordinates, which means the principle axes are not constant but vary circumferentially. Therefore, the system is not simplified, as six material responses are needed to implement this transformation, and this transformation cannot be implemented solely with a dielectric. However, as will be sees, this transformation is amenable to certain simplifying approximations.

Eikonal Approximations for Uniaxial Transformations

When the scale of electromagnetic inhomogeneity is substantially larger than the free-space wavelength, electromagnetic behavior is dominated by geometric optics. In this regime, electromagnetic waves take the form of plane waves with spatially-varying phase contours. At each point in space, these waves obey a local dispersion equation that is equivalent to that of a homogeneous medium. This begins by describing the dispersion relation for the azimuthally-uniaxial material of the previous section. Maxwell's Equations for time-harmonic fields can take the form:

$$\nabla\times E=j\omega\mu_0\mu_r H \tag{2.26a}$$

$$\nabla\times H=-j\omega\in_0\in_r E. \tag{2.26b}$$

The assumption is made that the fields can be written as:

$$E=E_0 e^{-jk_0\psi(r)} \tag{2.27a}$$

$$H=H_0 e^{-jk_0\psi(r)} \tag{2.27b}$$

This is a "quasi-plane wave," where the spatial variation of phase is decoupled from that of the field amplitude. Inserting this form for the fields and making the definition $k\equiv\nabla\psi$, Eq. 2.26 can be found to reduce to:

$$k\times H_0 - c_0\varepsilon_0 E_0 = j\frac{1}{k_0}\nabla\times H_0 \tag{2.28a}$$

$$k\times E_0 - c_0\mu_0 H_0 = j\frac{1}{k_0}\nabla\times E_0 \tag{2.28b}$$

Taking the limit $k_0\rightarrow\infty$, the right hand side of Eqs. 2.28 go to zero and the spectral form of Maxwell's Equations is recovered in a homogeneous medium. A more rigorous discussion of the applicability of this approximation is given in [54, 55]. Combining Eqs. 2.28 in this limit yields:

$$k\times[\mu_r^{-1}(k\times E_0)]+\in_r E_0=0. \tag{2.29}$$

Making the definition $K_{ik}=\in_{ijk}k_j$, Eq. 2.29 can be recast as a matrix operation on the electric field:

$$(K\mu_r^{-1}K+\in_r)E_0=0. \tag{2.30}$$

For a nontrivial solution to exist, Eq. 2.30 must have zero determinant. Enforcing this condition yields the local dispersion relation for the medium. In general, this task is complicated by the general anisotropy of ∈ and μ [56], but it is greatly simplified in this case, where the material parameters are constrained to be uniaxial and share the same eigenbasis; i.e., of the form:

$$\mu_r=\mathrm{Diag}[\mu_t, \mu_t, \mu_p] \tag{2.31a}$$

$$\in_r=\mathrm{Diag}[\in_t, \in_t, \in_p]. \tag{2.31b}$$

The subscripts t and p refer to quantities transverse or parallel to the optical axis, (z or ϕ in the examples above). In a Cartesian basis, it is found that the dispersion relation is a bi-quadratic equation that factors into two, (nominally independent), modes:

$$\left(\frac{k_x^2+k_y^2}{\mu_t\varepsilon_z}+\frac{k_z^2}{\mu_t\varepsilon_t}-1\right)\left(\frac{k_x^2+k_y^2}{\mu_z\varepsilon_t}+\frac{k_z^2}{\mu_t\varepsilon_t}-1\right)=0. \tag{2.32}$$

Since the presently disclosed system is diagonal in a cylindrical basis, conversion to cylindrical coordinates can be made in Eq. 2.32 by making the substitution (x, y, z)→(ρ, z, ϕ) to find:

$$\left(\frac{k_\rho^2+k_z^2}{\mu_t\varepsilon_\phi}+\frac{k_\phi^2}{\mu_t\varepsilon_t}-1\right)\left(\frac{k_\rho^2+k_z^2}{\mu_\phi\varepsilon_t}+\frac{k_\phi^2}{\mu_t\varepsilon_t}-1\right)=0. \tag{2.33}$$

It is important to emphasize that the components of k do not correspond to the solutions to Maxwell's equations in cylindrical coordinates. Rather, they are simply the projections of the Cartesian wave vector onto a cylindrical basis, i.e., $$k_\rho=k_x\cos\phi+k_y\sin\phi$$

$$k_\phi=k_y\cos\phi-k_x\sin\phi \tag{2.34}$$

These modes form uniaxial ellipsoidal surfaces in k-space that are equivalent to the extraordinary mode of a uniaxial dielectric. Unlike a uniaxial dielectric, however, there will not in general be an ordinary mode corresponding to anisotropic material. This form is only valid when two components of the constitutive tensors are equal in the eigenbasis of the material. For TO media, the TE and TM modes are identical since $\in_r=\mu_r$.

At this point, it is noted that the dispersion relation does not depend directly on the optical properties of the material. Rather, the relation is determined solely by the indices of refraction of the wave propagating along each of the principal axes of the material tensors. These unique indices can be labeled as follows:

$$n_{t,TE}=\sqrt{\in_p\mu_t}$$

$$n_{t,TM}=\sqrt{\in_t\mu_p}$$

$$n_p=\sqrt{\in_t\mu_t}, \tag{2.35}$$

where the subscripts indicate whether the electric field (TE) or magnetic field (TM) is transverse to the optical axis. Since Eq. 2.35 only specifies these three parameters for the four unique components of ∈ and μ, there is freedom to specify one of these material components to be equal to an arbitrary value α if appropriate substitutions are made to the other components. For instance, if $\tilde{\mu}_t=\alpha$ is set, then the other components become (in the cylindrical case):

$$\tilde{\varepsilon}_t = \frac{\varepsilon_t \mu_t}{\alpha} \tag{2.36}$$

$$\tilde{\varepsilon}_t = \frac{\varepsilon_\phi \mu_t}{\alpha}$$

$$\tilde{\mu}_\phi = \alpha \frac{\mu_\phi}{\mu_t}$$

In order to minimize the number of magnetic elements in the eventual design, $\alpha=1$ may be chosen. This flexibility is general to uniaxial magneto-dielectric media, but for the presently disclosed TO-derived design, this approximation also retains the degeneracy of the dispersion relation so that waves of both polarizations follow the same trajectory in the medium.

The above procedure illustrates the great benefit of the QC method for 3D TO. While the material parameters derived directly from the TO algorithm are not particularly simple, (three required magnetic responses), the symmetries of the mapping permit a subsequent approximation to be made that greatly reduces the complexity of the problem, (one required magnetic response) [57].

At this point, a number of approximations have been introduced to the general TO specification. In the following, these approximations are tested when this methodology is applied to the design of a high-performance lens. Since lenses have well defined metrics of performance, the effectiveness of the QC mappings can be discerned as well as the material approximations by evaluating the performance of these lenses. A variety of numerical techniques can be used to judge the effectiveness of these lenses.

Transformation Optics for 3D Devices: Reshaping the Luneburg Lens

In accordance with embodiments, the present disclosure includes a TO-modified lens that can provide near-perfect imaging characteristics with only one magnetic response. Using this lens, approximations can be examined as described herein.

While the carpet cloak provides a good platform to demonstrate the functionality and simplicity of the quasi-conformal technique, it is not very interesting from an applications standpoint. Fortunately, other proposed TO designs are amenable to QC optimization. One of the more compelling of these designs is the modified Luneburg lens proposed by Schurig [53]. The Luneburg lens is one implementation of a family of spherically symmetric gradient index lenses that perfectly focuses images of concentric spherical surfaces onto one another in the geometric optics limit. Typically, the radius of one of these spheres is taken to infinity so that parallel rays are imaged to points on the surface of the lens. The most well-known, (and simplest), index distribution was derived by the eponymous Luneburg as follows:

$$n(r) = \sqrt{2 - \left(\frac{r}{a}\right)^2}, \tag{3.1}$$

where n is index of refraction, r is the radial coordinate, and a is the radius of the lens.

Figure 9:
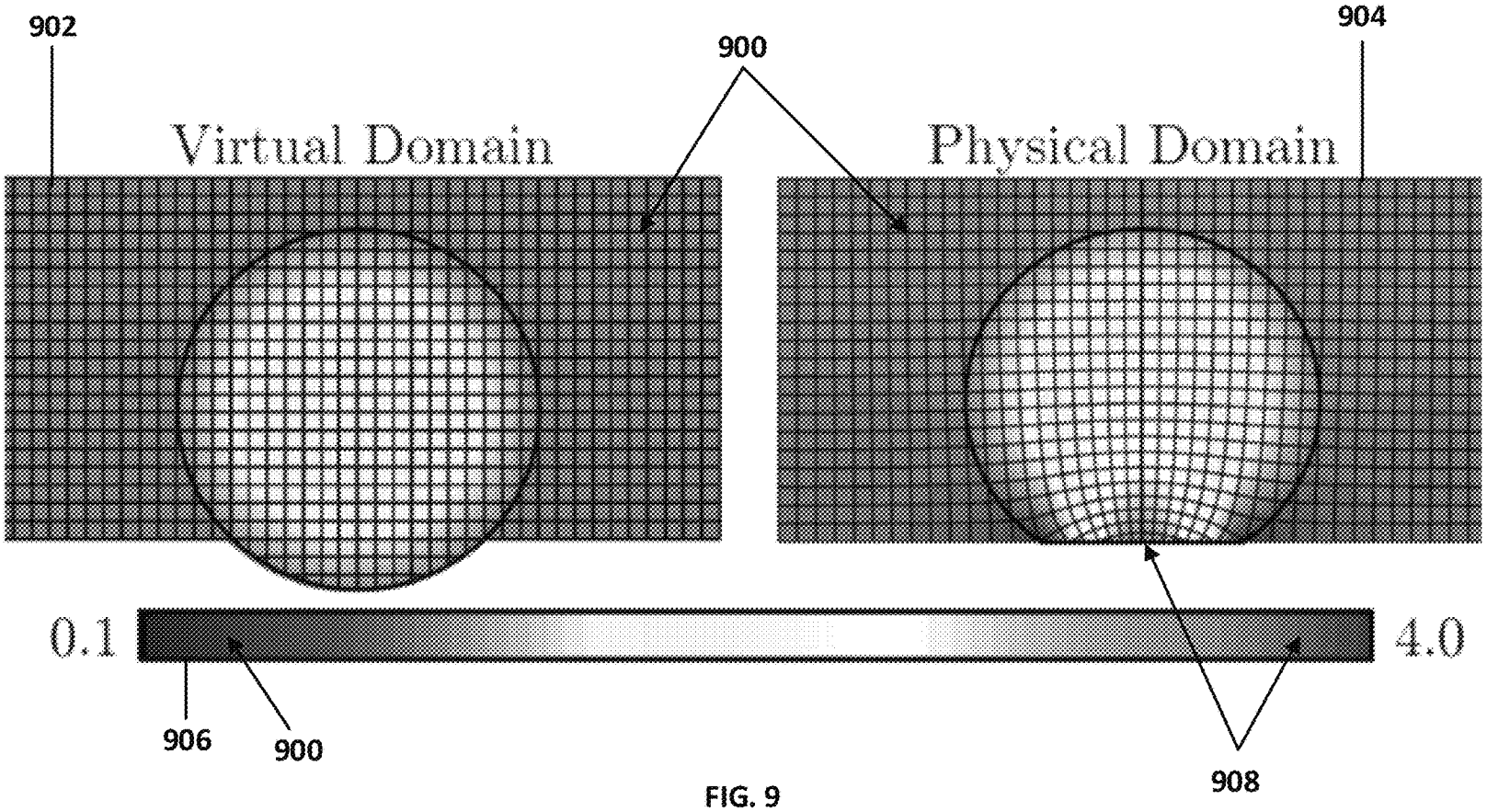
FIG. 9 depicts the QC transform for the Luneburg lens flattened for a ninety degree field-of-view in 2D.

FIG. 9 depicts the QC transform for the Luneburg lens flattened for a ninety degree field-of-view in 2D. The black line indicates the extent of the lens in the mapped regions. On the left of FIG. 9, the virtual domain lens geometry shows lines of constant x and y and the Luneburg dielectric distribution. On the right of FIG. 9, the physical domain geometry shows lines of constant x and y and the transformed dielectric distribution. The scale bar on the bottom indicates the color scaling of the dielectric. The blue domain is generally designated 900 in contour plots 902 and 904 and the legend 906. The red domain is generally designated 908 in contour plot 904 and the legend 906.

While the Luneburg lens can produce a perfect image, it has the key disadvantage that the image is spread over a spherical surface: any attempt to image onto a planar surface-as would be needed for most detector arrays-would result in extreme field curvature aberration. Schurig demonstrated that TO could be used to map a portion of the spherical image surface onto a flat one, thereby creating a flat focal plane without introducing any aberrations. Schurig's proposed transformation exhibited all of the aforementioned limitations of MM-enabled TO design, in particular requiring both anisotropic permittivity and permeability with relatively extreme ranges of values.

Given its advantages for imaging, the Luneburg lens represents a useful challenge for QC techniques, since an all-dielectric implementation may serve as a superior optical device. Kundtz and Smith [59] made use of a transformation similar to the one illustrated in FIG. 9, in which the virtual space consists of the unperturbed Luneburg lens index distribution. In this 2D realization of the Luneburg, it is desired that the physical space be a quadrilateral, with one side corresponding to the flattened Luneburg. The virtual space is then distorted, bounded on the top, left, and right by straight lines, while the lower boundary is conformal to the curve of the lens, as shown in the left of FIG. 9. The index distribution of the Luneburg is then inserted into the virtual space, where it multiplies the QCTO material distribution, and the inverse transformation is used to flatten the Luneburg. Since it is assumed that a detector can terminate the fields on the flattened side, the same "slipping" boundary conditions can be applied on the lower edge as were used for the carpet cloak, and Eq. 2.13 solved to determine the QC gri 1. This same "flattening" procedure may be applied to other GRIN devices, such as the Maxwell fisheye lens [19], and can also be used as a method to correct field curvature in conventional optical systems [37].

The first implementation of the flattened Luneburg was performed at microwave frequencies using cut-wire dipoles to achieve the desired gradient index structure [59]. The 2D lens may have limited utility. An initial approach to extend the QCTO methodology to three dimensions was to take the 2D dielectric distribution from a QC transformation and revolve it around an axis of symmetry [14, 15]. However, as shown in subsequent sections, this method does not produce a medium that corresponds to the correct transformed material parameters, and such a lens may suffer additional aberrations.

Figure 10:
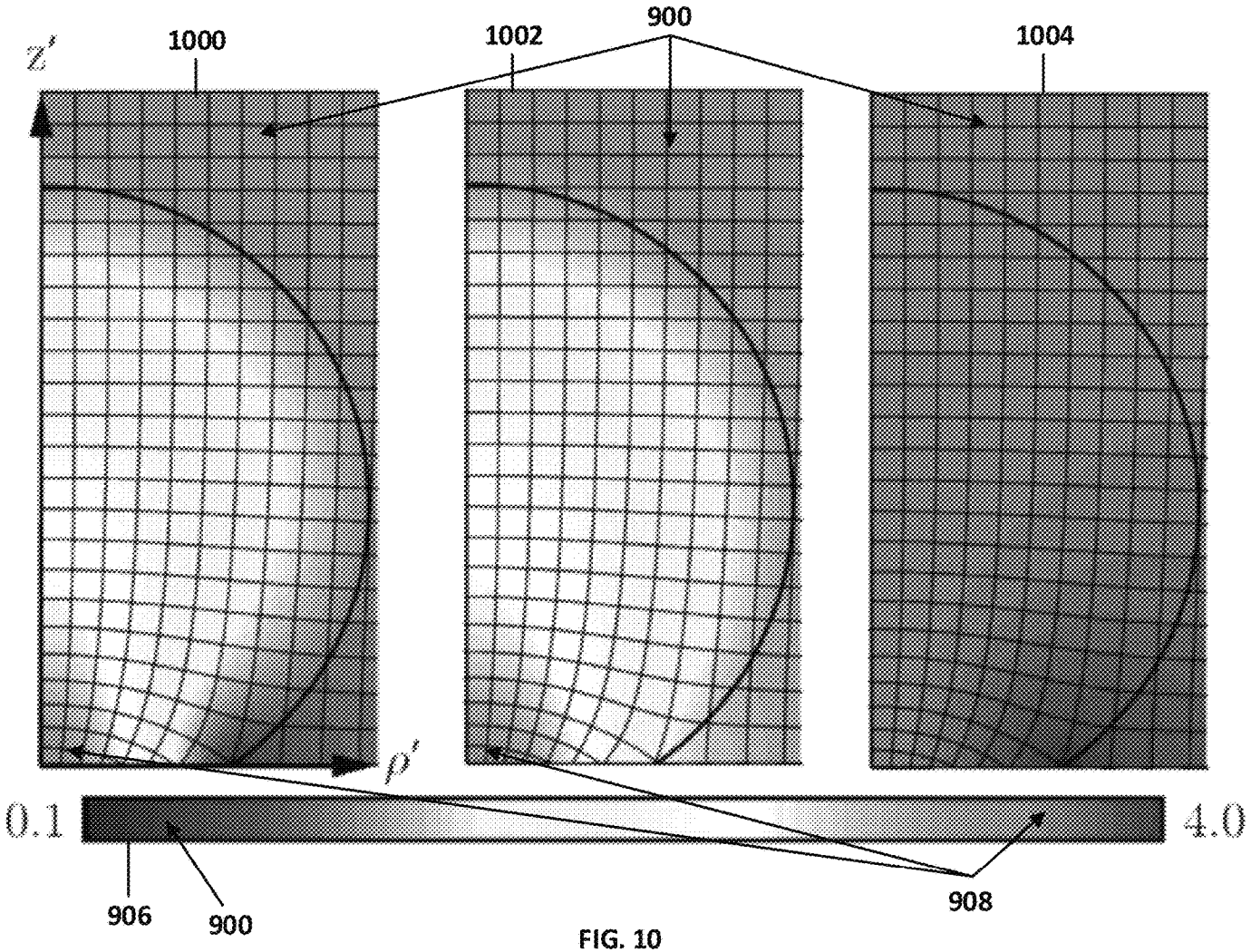
FIG. 10 shows reduced-parameter material distribution for a flattened Luneburg lens.

Rather, the approximation described herein may be used to design a reduced-parameter implementation of the lens. This approximation may be especially appropriate for the transformed Luneburg lens, since the original dielectric distribution was derived under geometric optics considerations [58]. FIG. 10 shows reduced-parameter material distribution for a flattened Luneburg lens. The other two components of μ' (not shown) are unity. The blue domain is generally designated 900 in contour plots 1000, 1002, and 1004 and the legend 906. The red domain is generally designated 908 in contour plots 1000 and 1002 and the legend 906. FIG. 10 shows the material parameters for a lens with the same degree of flattening as FIG. 9. In the following, this approximation is compared with the full-parameter design and an isotropic-only variant.

Ray-tracing is a useful tool for optically-large problems in which diffraction effects may be ignored. Additionally, ray-tracing may be formulated in the language of Hamiltonian optics, and it may be possible to glean some insight into the performance of devices based upon the symmetries that they might possess. Each ray of light may be considered as a particle that follows a trajectory that satisfies the Hamiltonian $$H(p_i, q_i)=0. \tag{3.2}$$

The parameterized ray trajectory $q(\tau)$ is found by numerically integrating Hamilton's equations:

$$\dot{q}_i = \frac{\partial H}{\partial p_i}, \tag{3.3a}$$

$$\dot{p}_i = \frac{\partial H}{\partial q_i}. \tag{3.3b}$$

In Cartesian coordinates, the Hamiltonian is simply the local dispersion relation, and the conjugate momenta are simply the components of the normalized wave-vector k. Straightforward algorithms exist for ray-tracing in general impedance-matched media [4] and uniaxial media specifically [54]. However, it may be desired to exploit the symmetry of the system by performing the integration in cylindrical coordinates. This may be accomplished by finding the Hamiltonian that preserves the form of Hamilton's equation [60]:

$$H = \frac{p_\rho^2 + p_z^2}{n_t^2} + \frac{p_\phi^2}{\rho^2 n_\phi^2}, \tag{3.4}$$

where the indices of refraction along the principle axes of the material have been used as defined by Eq. 2.33 and assumed degeneracy in the dispersion relation. This form of the Hamiltonian is important for two reasons. From Hamilton's equations, it can be seen that the coordinates are cyclic in the coordinate $\phi$:

$$\dot{p}_\phi = -\frac{\partial H}{\partial \phi} = 0 \tag{3.5}$$

so that $p_\phi$ is conserved along a ray. This implies that rays can be categorized based upon their initial angular momentum. Rays with zero angular momentum $p_\phi(\tau)$ obey a reduced Hamiltonian of the form $$H = \frac{p_\rho^2 + p_z^2}{n_t^2}, \tag{3.6}$$

which is simply the Hamiltonian of a ray in an axially-symmetric isotropic medium. The implication here is that the flattened Luneburg lens can be properly implemented with an isotropic dielectric only at normal incidence.

Extreme care must be taken in the numerical integration of Eq. 3.3, since the mapping itself is determined numerically. In the absence of a closed-form solution for the mapping, an intelligent interpolation scheme can be relied upon to retrieve the material values and their spatial derivatives as required by Eq. 3.3. Fortunately, COMSOL can provide the spatial derivatives of all solved quantities. However, these are derivatives in the virtual domain, and they may be required in the physical domain for ray-tracing described herein. From the chain rule, it can be seen that $$\partial_{i'} = (\partial_i x^{j'})\partial_i = A\partial_i. \tag{3.7}$$

With these quantities calculated on a regular grid, the Hermite-cubic interpolation [61] may be used to determine these quantities anywhere to high precision. It ca be expected that even higher accuracy could be achieved by using the same mesh and interpolation functions that are used internally by COMSOL.

In a study disclosed herein, four distinct lenses were considered based on two different transformations. The first transformation is based on the traditional QC mapping where the conformal module between domains is not preserved. The second transformation is based on the conformal (C) mapping where the height of the virtual domain has been adjusted to preserve the conformal module. From each of these transformation, two different lenses can be constructed: one anisotropic, based on the proper transformed material equations, and one isotropic, which mimics the proper material parameters at zero field angle as shown by Eq. 3.6.

Figure 11:
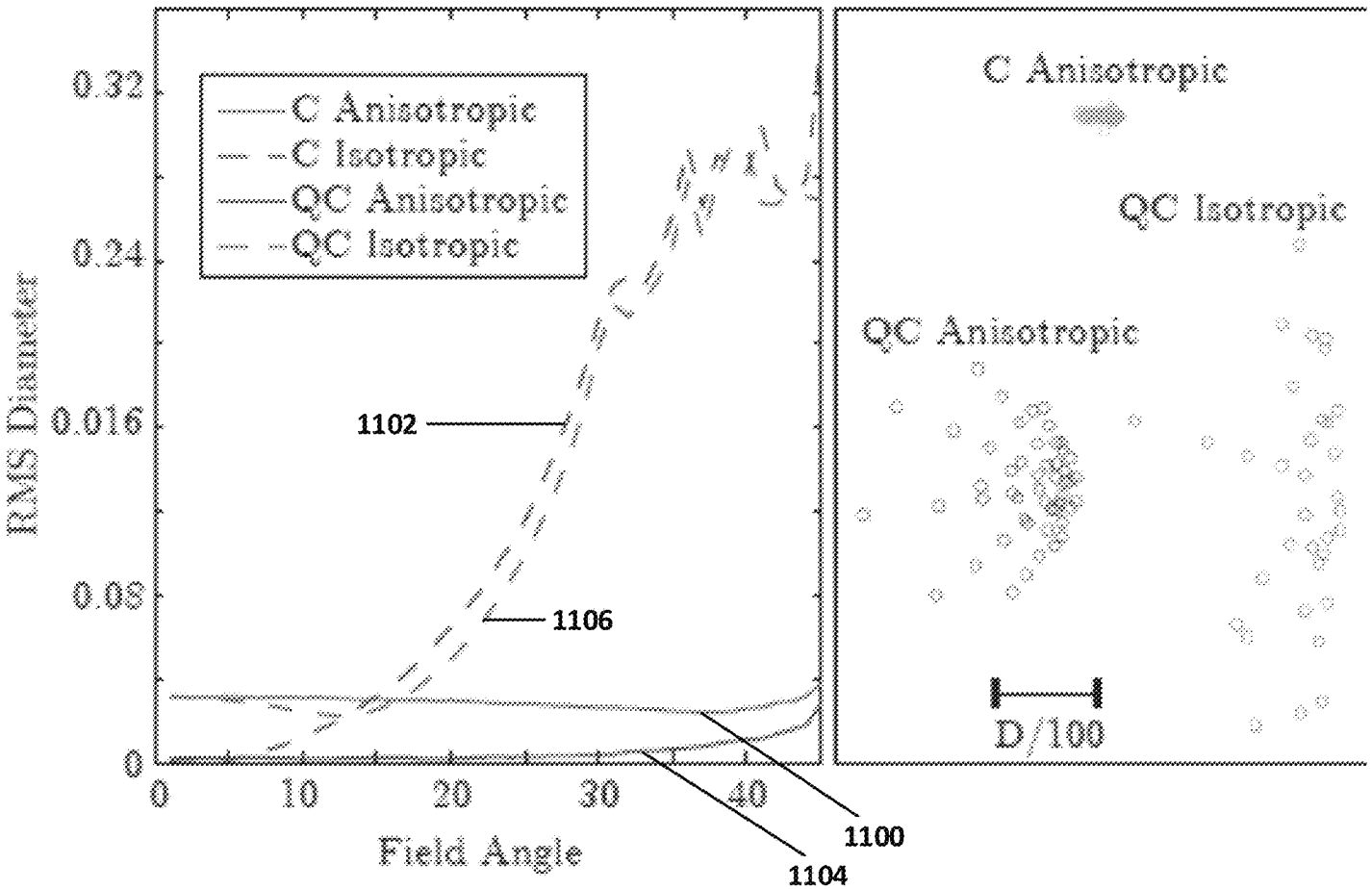
FIG. 11 shows the root-mean-square (RMS) spot size for four different lens constructions.

FIG. 11 shows the root-mean-square (RMS) spot size for four different lens constructions: C isotropic and anisotropic, and QC isotropic and anisotropic. More particularly, the left part of FIG. 11 shows the spot size comparison of various flattened Luneburg lenses calculated with numerical ray-tracing. The spot size at each angle is the RMS average of 100 incident rays. The right part of FIG. 11 shows the spot diagrams at 30 degrees. At normal incidence, (zero field angle), $p_\phi=0$ and the ray paths for the anisotropic and isotropic lenses are degenerate. However, aberrations do appear in the lenses derived from the QC mapping. These aberrations are related to the omission of in-plane anisotropy, as discussed herein. At normal incidence, all the rays pierce the top boundary of the cylindrical transformation domain without refractive aberration since $n \times k=0$. Therefore, the slight material inhomogeneity at this boundary can be ignored, as well as the isotropic scaling that occurs in the quasi-conformal approximation. However, the error induced by neglecting anisotropy cannot be neglected. As shown previously, the material anisotropy allows the mapped region to be stretched to fit in the transformation domain. Without this stretching transformation, the Luneburg lens is no longer circular in the virtual domain. Instead, it can appear compressed along one axis. This leads to the non-vanishing spot at zero field angle.

In FIG. 11, reference 1100 indicates C Anisotropic, reference 1102 indicates C Isotropic, reference 1104 indicates QC Anisotropic, and reference 1106 indicates QC Isotropic.

Up to approximately 5 degrees, the isotropic lens configurations may be essentially identical to their anisotropic counterparts. However, it can be seen that the isotropic lens performance drops dramatically for larger field angles. By comparison, the anisotropic lenses show consistent performance across the specified field of view. The conformally-mapped lens shows the smallest spot size up to about 44 degrees. At this point, a significant number of rays are now intercepting the domain from the side where the mismatch has been increased by scaling the virtual domain. This aberration can be reduced by increasing the lateral extent of the transformation domain, but this would have the unwanted effect of increasing the size of the optic.

Figure 12:
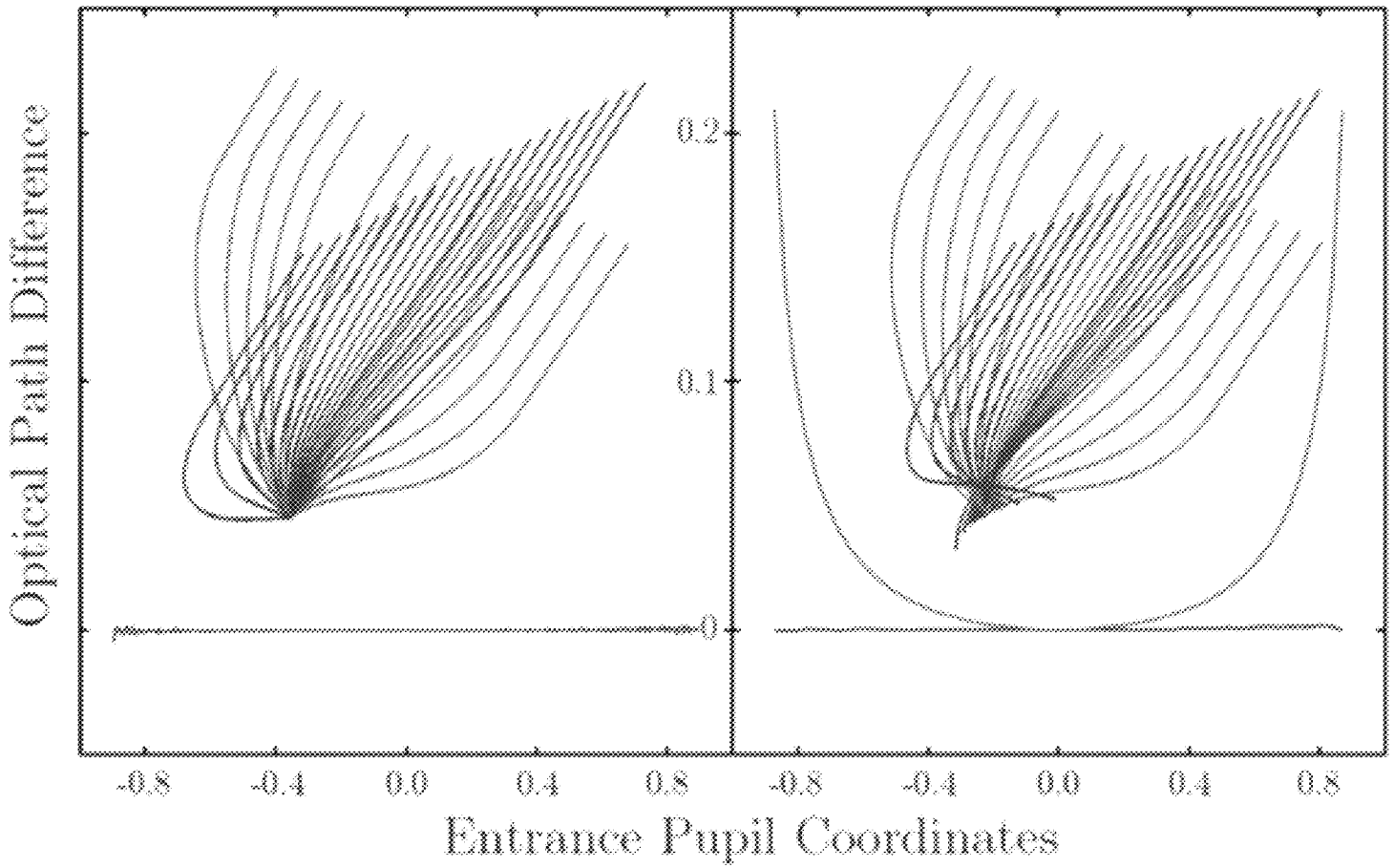
FIG. 12 shows plots for sagittal and tangential rays.

The isotropic variants of lenses clearly show the largest aberrations for large field angles. The source of these aberrations can be visualized by plotting the ray trajectories for anisotropic and isotropic lens variants as shown in FIG. 12. Rays that lie in the plane of the chief ray and the optical axis, (meridional rays), are focused identically in both cases, as these are the rays with zero angular momentum. However, a dramatic difference can be seen in performance when rays are plotted in an orthogonal plane that contains the chief ray. This is the sagittal plane, and these rays have maximum angular momentum. Only the anisotropic lens properly focuses in this case. Sagittal rays in the isotropic case appear to be focused to a point above the nominal focal plane so that the lens exhibits astigmatism. Similar results were shown qualitatively in [57] for all three lenses and in [21] for the isotropic case.

These can be connected results to those of traditional optical lens design by calculating the optical path difference (OPD) for the rays. The optical path length (OPL) is simply the change in the eikonal across the path of each ray. From the definition of the eikonal, the following equation results:

$$\mathrm{OPL}=\psi(r_1)-\psi(r_0)=\int_{r_0}^{r_1} k\cdot dl. \tag{3.8}$$

The OPD is calculated by subtracting the OPL of the chief ray from the OPL of all other rays. The OPD is plotted in FIG. 12 for both sagittal and tangential rays. The "broad" group of curves in the plot represent the sagittal rays, whereas the "narrow" family of curves represent the meridional rays. More particularly, on the left of FIG. 12, OPD plots across he sagittal and meridional planes an anisotropic (left) and isotropic (right) lens. As expected, the meridional rays have virtually no OPD in either case. However, the sagittal rays in the isotropic case show an OPD plot that is symmetric about the optical axis. This is indicative of astigmatism, as previously mentioned. Similar ray-tracing analysis may be performed for the carpet cloak [62]. Unsurprisingly, the revolved, all-dielectric implementation of the cloak fails to operate effectively at all angles of incidence. Interestingly, an extruded version of the all-dielectric carpet cloak appears to mitigate these aberrations to some extent [62, 63]. However, this technique may have some application, especially in designs with restricted incident angles. For instance, alternative cloaking designs such as the conformal map introduced by Leonhardt [64] are only designed to work at one angle of incidence. If this structure is revolved around the axis parallel to this angle, performance is not diminished, as shown in [65].

Full-Wave Verification of Eikonal-Limit Design

Ray-tracing is strictly valid only in the limit of vanishing wavelength. However, lenses are often used in situations where the aperture is only a few wavelengths across. In this regime, diffractive effects must be considered explicitly. Various models, (physical optics, geometrical theory of diffraction), can account for these effects with increasing accuracy, but it may be that only full-wave numerical solvers can handle these effects in conjunction with the complicated gradients and anisotropy of TO-derived materials. Full-wave simulations also allow the testing of the effects of the eikonal approximation that were made to the transformation. The full-wave simulation of optically-large, three-dimensional objects is a formidable task. For example, the finite-element method (FEM) requires at least a few nodal points per wavelength to resolve gradients in electromagnetic fields. Memory requirements thus scale with the volume of the simulation domain. Fortunately, these requirements can be drastically reduced for problems with azimuthal invariance, such as the lens considered above. The fields were first expanded in a Fourier series in $\phi$:

$$E(r)=\sum_{m=-\infty}^{\infty} E_m(\rho, z)e^{jm\phi} \tag{3.9a}$$

$$H(r)=\sum_{m=-\infty}^{\infty} H_m(\rho, z)e^{jm\phi}. \tag{3.9b}$$

The orthogonality of the series permits solving for the fields associated with each mode individually. Moreover, the substitution $\partial_\phi \rightarrow jm$ can be made in Maxwell's equations so that the problem is reduced to finding the 2D field pattern for each mode. This allows the solving of M small 2D problems sequentially instead of one large one.

To simulate a plane wave incident on the lens, the incident fields were decomposed as Eq. 3.9. The decomposition is facilitated by the introduction of the auxiliary vector potentials A and F to represent the two distinct polarizations of the incident wave, ($TM^z$ and $TE^z$, respectively) [26]. For instance, an incident wave making an angle $\theta_0$ from the z-axis with the electric field polarized in y may be expressed as:

$$E_\rho=-\frac{E_0}{k_0\rho\sin\theta_0}\sum_{m=-\infty}^{\infty} j^{1-m}J_m(k\rho)e^{jm\phi} \tag{3.10a}$$

$$E_\phi=E_0e^{jk_0\rho\cos\theta_0}\sum_{m=-\infty}^{\infty} J'_m(k\rho)e^{jm\phi} \tag{3.10b}$$

where the prime (') indicates differentiation with respect to the argument. In practice, the series must be truncated at some maximal wavenumber M. From the asymptotic form of Bessel functions, the series may be truncated without significant error when [66]:

$$M=Ceil(k_o\rho\sin\theta_0)+6, \tag{3.11}$$

where ceil[ ] is the integer ceiling operator. With these tools in place, now the performance of the lenses can be investigated. For each lens, an incident plane at 30 degrees off normal can be simulated for apertures ranging from five to thirty wavelengths in diameter. The performance metric is the spot size that encompasses 84% of the energy in the focal plane, the same amount of energy contained in the primary lobe of a nonaberrated Airy disk. This metric enables quick comparison between the lenses and the expected diffraction-limited performance of a lens with the same aperture and focal length.

In the study described herein, three lenses derived from the same conformal transformation are reviewed. The first lens uses the full-parameter implementation. For this case, the virtual-domain Luneburg material distribution can be set to $$\mu_r=\epsilon_r=\sqrt{2-\left(\frac{r}{a}\right)^2}, \tag{3.12}$$

so that the lens performance is identical for both polarizations of the incident wave. The second lens uses the eikonal approximation of Eq. 2.36. As opposed to the first lens, the Luneburg distribution is mostly dielectric so as to maintain the minimum amount of magnetic coupling in the design. Since this design is based on a high frequency approximation, inferior performance may be expected as compared to the full transformation for small apertures, and then it may be expected to asymptotically approach the performance of the full transformation as the aperture size is increased. Additionally, some difference in performance can be expected for the two polarizations of the incident wave. The final lens represents an isotropic, dielectric-only implementation. Since this implementation neglects the anisotropy of the transformation, it can be expected to show the worst performance for all aperture sizes. Additionally, the spot size to asymptote to the nonzero value corresponding to the RMS size can be expected to be given by the ray-tracing analysis of previously described.

Figure 13:
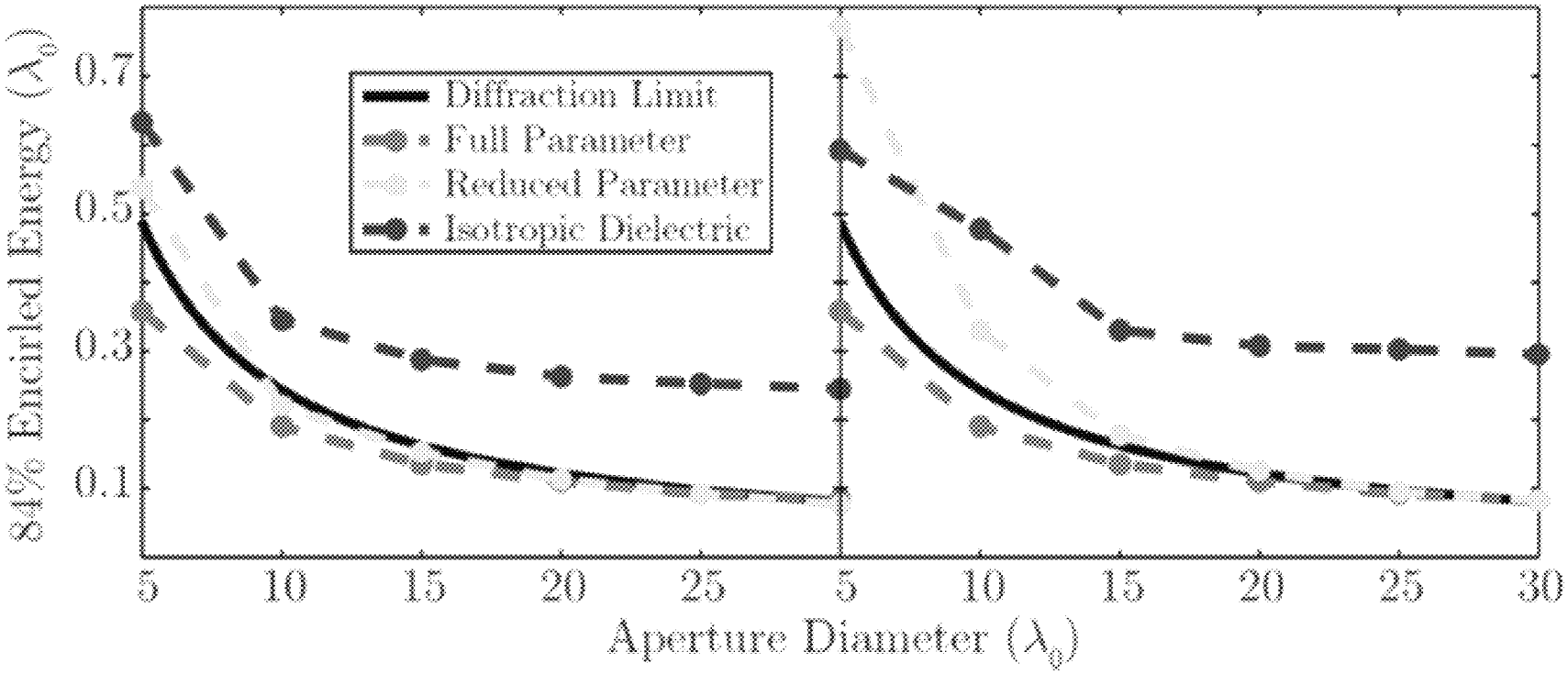
FIG. 13 depicts a comparison of spot sizes for various lenses using FEM.

The simulation results are plotted in FIG. 13, which depicts a comparison of spot sizes for various lenses using FEM. For comparison, the expected diffraction-limited spot diameter was plotted and given by $$D=2.44\lambda f/\#, \tag{3.13}$$

where f{#_f{D_1{2 is the f-number of the untransformed Luneburg lens. As expected, the full-parameter lens shows superior performance for all simulated aperture sizes. In fact, the spot size is a bit smaller than one would expect from Eq. 3.13, though both curves show the same behavior at short wavelengths.

At long wavelengths, the reduced-parameter and isotropic lenses have substantially degraded performance in comparison to the full-parameter implementation. However, the reduced-parameter implementation quickly regains performance as the aperture size is increased, so that by the time D=25λ, the reduced parameter curve is practically indistinguishable from the full-parameter curve. On the other hand, the performance of the isotropic curve quickly asymptotes to a non-zero value as predicted by previous ray-tracing analysis.

Figure 14:
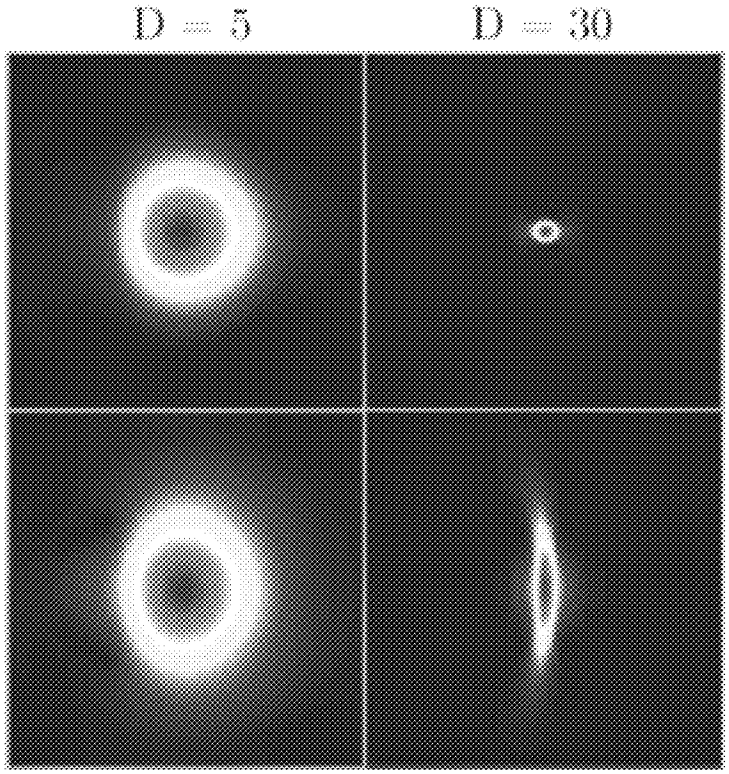
FIG. 14 illustrates intensity plotted in the focal plane of each lens.
Figure 14:
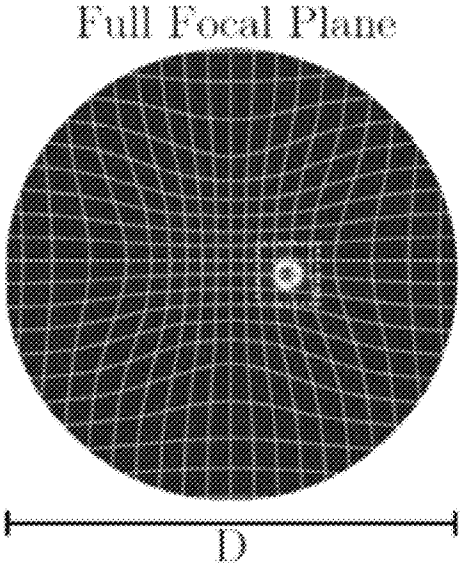

Lens performance in the five- to ten-wavelength range is difficult to understand since the scale of material variation is on the order of the free-space wavelength. From simulations, it appears that main performance limiting factor is reflections in the lens interior where the material variations are the most rapid; these reflections spread energy over the focal plane so that the diameter of 84% encircled energy is larger than would be expected from qualitative examination of the spot diagrams FIG. 14, which illustrates intensity plotted in the focal plane of each lens. The left side of FIG. 14 shows intensity over the full focal plane for a five wavelength, reduced parameter-set lens. A virtual domain grid is overlaid to show distortion in the focal plane. The dotted grey square indicates the relative dimensions of the spot diagrams on the right. The right, top shows spot diagrams for the reduced-parameter lens for apertures of five and thirty wavelengths. The right, bottom shows spot diagrams for the isotropic, dielectric-only lens at the five and thirty wavelengths.

While the short-wavelength behavior of the reduced-parameter lens is diffraction limited, the spot diagram shown in FIG. 14 clearly differs from the expected Airy disk. The full-parameter lens shows the same behavior at all frequencies: the distortion in the spot is due to the mapping itself. This is unsurprising in light of the Neumann boundary conditions that may be enforced when generating the map. In the focal plane, the lines of constant ρ, (virtual coordinates), are distorted to guarantee orthogonality in the mapping. To illustrate this distortion, the virtual coordinates was plotted in the physical focal plane in FIG. 14. It can be observed that an image near the center is de-magnified, whereas an image towards the edge is slightly magnified. Additionally, an image of the 30 degree incident plane wave is compressed vertically, as observed in the full wave simulation previously. The only way to circumvent this problem is to specify the virtual domain points directly as done in [53].

A Unidirectional Metamaterial Clock

Cloaking and Transformation Optics

Since the initial demonstration of the electromagnetic cloak [9], there has been a flurry of activity around the subject. However, the complexity of the TO material prescription has continually forced researchers to make simplifying approximations in order to achieve even a subset of the desired functionality [67, 68, 40, 69, 11, 8, 7], even when the dimensionality of the problem is reduced and the polarization is restricted. These approximations place profound limitations on the performance of TO devices in general [57], and cloaks especially [70, 44].

Most demonstrations of TO-enabled devices have relied on the so-called eikonal approximation; the permittivity and permeability tensors may be adjusted arbitrarily so long as the anisotropic index of refraction is maintained. This approximation is typically used to allow the designer to eliminate a material response in a single direction, thereby greatly simplifying the eventual metamaterial unit cell design. However, this approximation comes at a high cost: the wave-impedance is not inherently matched as it would be for a full-parameter design, and reflections may be created at the interface of the device with free space. Additionally, the eikonal approximation is a short wavelength approximation, and the notion of a locally-varying index of refraction loses all meaning for devices that are themselves inhomogeneous on the order of a wavelength. Herein, it is shown that the complexity of full-parameter design may be overcome by the judicious choice of transformation and metamaterial design. Specifically, an impedance-matched, unidirectional cloak is designed and experimentally characterized that realizes the full TO material prescription. The cloaking transformation is disclosed initially.

Unidirectional Cloaking and the Bi-Linear Transformation

Figure 15:
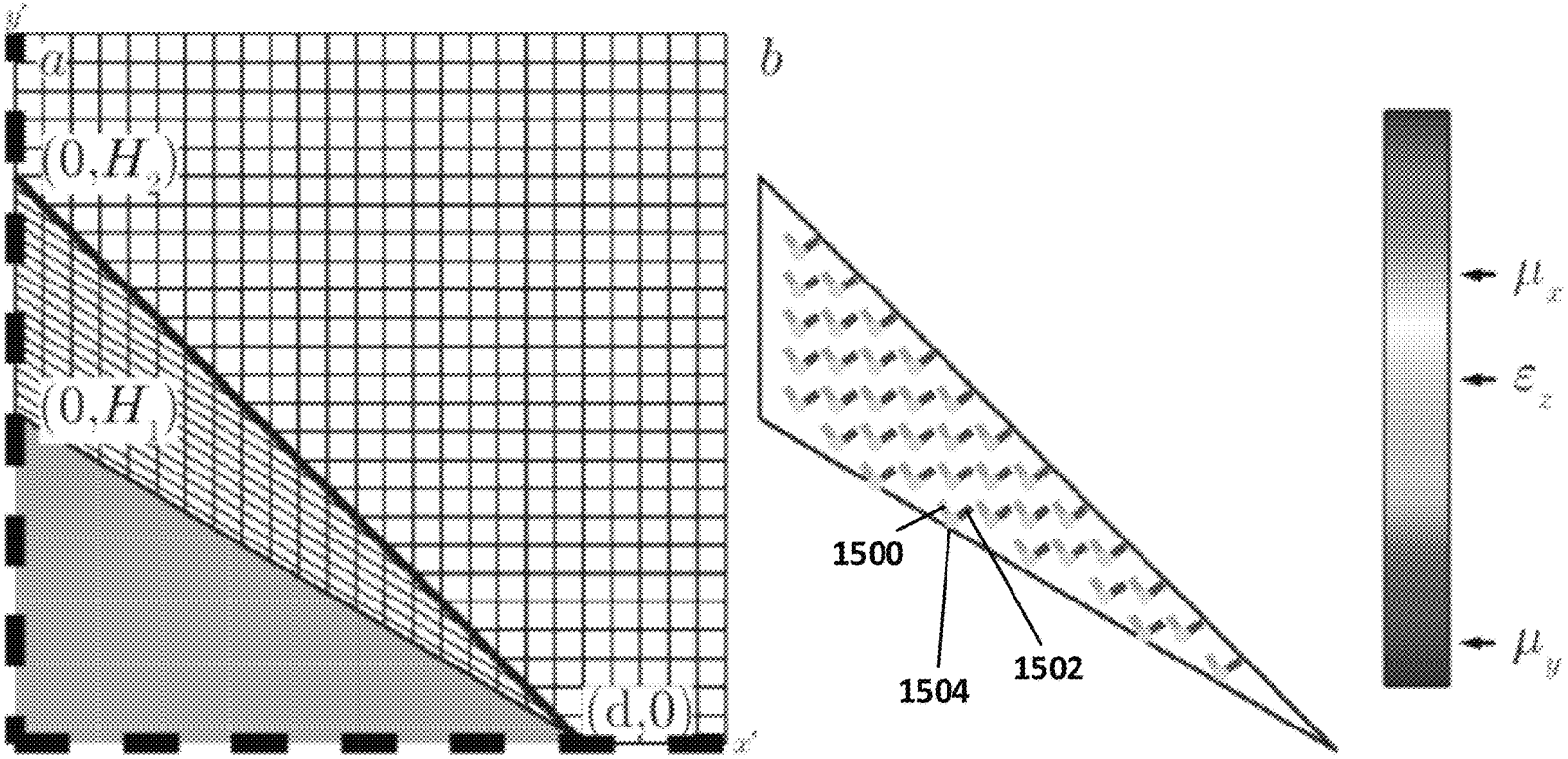
FIG. 15 illustrates a graphical depiction of the bilinear transformation and derived material parameters.

This particular cloaking configuration, variants of which were first introduced in [71, 72], may be viewed as a type of ground-plane or carpet cloak [40]. The carpet cloak is designed by applying a bi-linear transformation to reduce a two-dimensional (2D) region of space to a line segment. This transformation effectively cloaks any object placed within the 2D region to observers viewing the cloak along the axis of the transformation. The mathematical cloaking mechanism is the same as that of the cylindrical design in that the dimensionality of a region of space is reduced. The difference is that the reduction in the cylindrical cloak is 2D to 0D, (area to point), while in the unidirectional cloak it is 2D to 1D, (area to line). The general transformation, (in the x-y plane), is of the form:

$$x' = x \tag{4.1}$$
$$y' = \frac{H_2 - H_1}{H_2} y + \frac{d - x\,\mathrm{sgn}(x)}{d} H_1$$
$$z' = z$$

where the geometrical parameters H1, H2, and d are defined in FIG. 15, which illustrates a graphical depiction of the bilinear transformation and derived material parameters. Reference 1500 represents mu_x, reference 1502 represents mu_y, and reference 1504 represents epsilon_z. The transformation is plotted in the graph (a) on the left side of FIG. 15. In (a) of FIG. 15, the transformation is bounded by a triangle of height $H_2$ and length 2d, creates a cloaking region of height $H_1$. Lines of constant x and y, (virtual domain coordinates), are plotted in the physical domain, (x' and y'). In the full design, the transformation is mirrored over both the x- and y-axes. In (b) of FIG. 15, a grayscale plot of the material responses required by the cloaking transformation is shown. The full structure is mirrored in the vertical direction. The grayscaled lines, (dots for the out-of-plane component), indicate the direction of the response, and the grayscale indicates the magnitude as shown by the grayscale bar on the far right. Using the standard TO algorithm encapsulated by equation Eq. 1.2, the material parameters are found to have the form:

$$\frac{AA^T}{|A|} = \begin{bmatrix} \frac{H_2}{H_2 - H_1} & -\frac{H_1 H_2}{(H_2 - H_1)d}\mathrm{sgn}(x) & 0 \\ -\frac{H_1 H_2}{(H_2 - H_1)d}\mathrm{sgn}(x) & \frac{H_2 - H_1}{H_2} + \frac{H_2}{H_2 - H_1}\left(\frac{H_1}{d}\right)^2 & 0 \\ 0 & 0 & \frac{H_2}{H_2 - H_1} \end{bmatrix} \tag{4.2}$$

where the geometrical parameters H1, H2, and d are defined in FIG. 15. The transformation is plotted in FIG. 4.1*a*.

In accordance with embodiments, the cloak is required circumscribe a cylinder of radius R, and have a maximal extent of twice the cylinder radius, i.e.

$$H_1 = \frac{2R}{\sqrt{3}} \text{ and } H_2 = 2R.$$

Using standard techniques, Eq. 4.2 is diagonalized using the given geometrical parameters to obtain the material parameters. The direction of the response is given by the eigenvectors of Eq. 4.2. The magnitude and direction of the three responses are indicated on the FIG. 15. The benefits of the carpet cloak transformation are two-fold. First, the bilinear transformation yields spatially homogeneous constitutive parameters, with no zeros or singularities. Additionally, the homogeneity of the medium vastly reduces the complexity of the metamaterial design, since only one metamaterial element is needed, rather than the more challenging gradient structures common to many TO designs. In comparison to the omni-directional cloak designs [6, 9], the absence of extreme constitutive parameters implies that the cloak can operate at frequencies further removed from material resonances; materials that are less dispersive typically exhibit a larger bandwidth of operation with reduced material losses. The price of the carpet transformation is that an object can be effectively cloaked only for a narrow range of observation angles about the axis of the transformation. Permutations of the carpet cloak transformation have been applied to design electromagnetic cloaks operating at visible wavelengths [8, 7] and acoustic structures that cloak sound waves [73]. However, these implementations have relied on the aforementioned eikonal approximation, and are thus mismatched to the surrounding environment. Additionally, these devices could not operate in free space; they had to be immersed in a dielectric since the material could not provide a refractive index less than one.

Metamaterial Unit Cell Design

Figure 16:
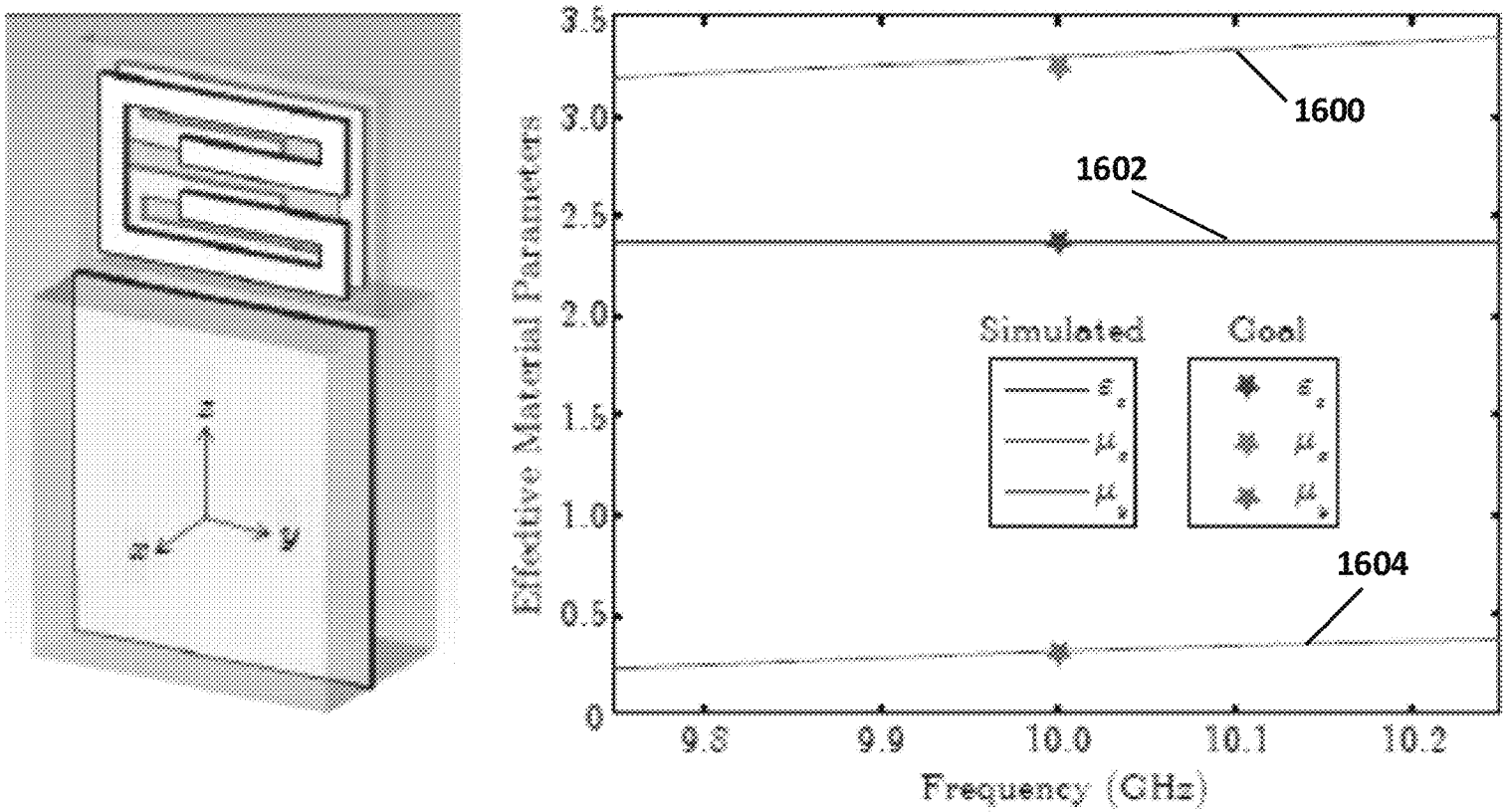
FIG. 16 illustrates a combined metamaterial unit cell.

Three distinct material responses were implemented with two separate metamaterial inclusions. $\mu_y$ and $\mu_z$ were coupled to with a canonical doubled-sided split-ring resonator (SRR) [24, 29] shown in FIG. 16, which illustrates a combined metamaterial unit cell. Referring to FIG. 16, the figure shows a diagram of the unit cell, where the PCB substrate is transparent to show the copper plating. On the right of FIG. 16, the figure shows retrieved material parameters for the optimized unit cell. Reference 1600 represents the curve for $\mu_y$, reference 1602 represents the curve for $\in_z$, and reference 1604 represents the curve for $\mu_x$. The magnetic and dielectric responses were tuned by changing the length of the capacitive arm lc and the unit cell height az, respectively. A similar design was used to couple to the diamagnetic and dielectric responses required for the eikonal-limit omnidirectional cloak [9]. It would have been possible to use another SRR in each unit cell to provide the paramagnetic response $\mu_x$, but this would have caused several complications that would have hampered cloaking performance. The primary concern was loss: SRRs only provide an appreciable paramagnetic response very close to resonance where the loss tangent is significantly greater [74, 75]. Additionally, the second SRR would significantly increase the effective dielectric in the medium. In order to keep this quantity at the designed value, the fill factor of each SRR may need to be decreased, which would increase losses even further [74, 75].

Figure 17:
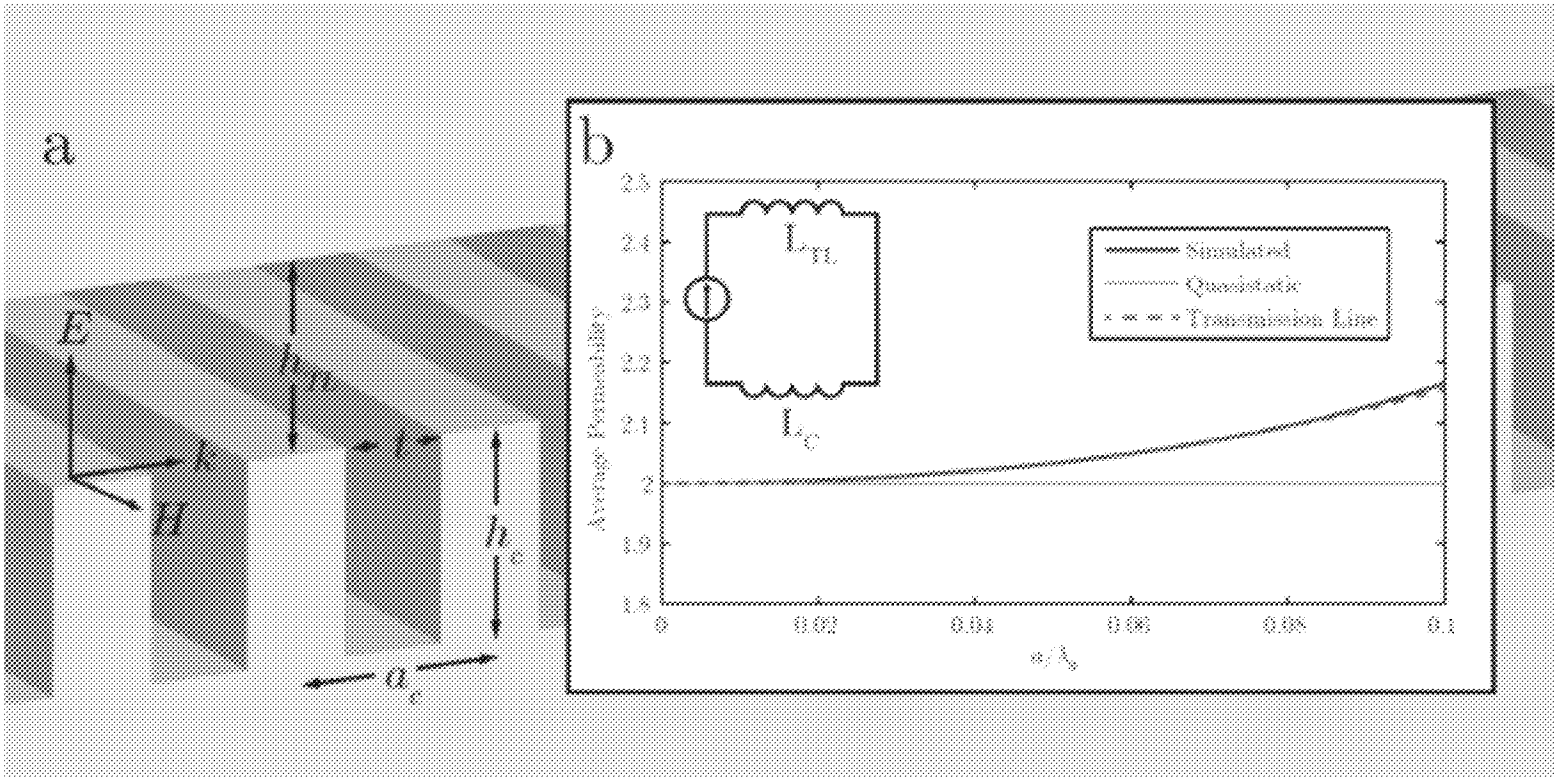
FIG. 17 depicts a corrugated transmission line and the derived material response.

Instead, the parallel-plate waveguide environment of the testing apparatus alluded to above was exploited; that is, a new degree of freedom was obtained by manipulating the waveguide itself to derive an effective response. Specifically, one-dimensional corrugations were added to the bottom plate of the waveguide. The corrugations provide an effective magnetic loading in the direction along the corrugations. Metallic corrugations are common in both guided-wave and radiating devices. These corrugations are typically ¼-wavelength in depth to provide a resonant response. Theoretically, these corrugations are often treated as lumped, high-impedance surfaces. Once the surface impedance is known, the effects on the modal fields may be determined. However, corrugations may be fashioned to provide an effective broadband material response. To motivate this reasoning, a simple field-averaging model [33] is introduced for the long-wavelength response of a corrugation in a parallel-plate transmission line, as shown in FIG. 17, which depicts a corrugated transmission line and the derived material response. (a) of FIG. 17 shows a corrugated transmission line, and the polarization and direction are as indicated. (b) of FIG. 17 shows a comparison of permeability retrieved from simulation with the permeability given by analytical models. In units of maximum wavelength, the simulated geometrical parameters are: $a_c$=0.1, $h_{TL}$=0.0, and $h_C$=0.1. The artifacts due to the nonzero lattice parameter a have been removed according to [21, 32]. The (b), inset shows the circuit model used in the analysis.

Consider the circuit model shown in FIG. 17. An ideal (surface) current source K is connected in series with a rectangular metallic cylinder of height $h_{TL}$ and length a. This represents a segment of the transmission line. A corrugation of length t and depth $h_c$ are inserted as shown. The average magnetic field [33] is determined by the current source through Amperes law:

$$H_{av} = \frac{1}{z}\oint H \cdot dl = K. \tag{4.3}$$

From Faradays law, the total magnetic flux through the circuit can be determined as follows:

$$j\omega\phi = j\omega K(L_{TL}+L_C), \tag{4.4}$$

where $L_{TL}$ and $L_C$ are the select inductances of the unloaded circuit and corrugation, respectively. The flux is the related to the average magnetic induction [33] by:

$$\int B \cdot ds = B_{av} h_{TL} t. \tag{4.5}$$

The average permeability is defined as the ratio of $B_{av}$ to $H_{av}$. Therefore, $$\mu_{av} = 1 + \frac{h_c t}{h_{TL} a} \tag{4.6}$$

where the approximations $L_{TL} \approx \mu_0 h_T La$ and $L_C \approx \mu_0 h_C t$ have been made. These approximations are valid in the limits t<<a and t<< $h_C$ so that the fields are quasi-uniform in the structure. According to Eq. 4.6, and in contrast with the response of an SRR, the corrugations provide an appreciable magnetic response far from the material resonance. This mitigates both material dispersion and losses around the operational frequency.

In the absence of all other considerations, the effective magnetic loading is maximized by setting t=a and maximizing $h_C/h_{TL}$. In reality, there is a need to remain in the quasi-static limit and by the need to fit a split-ring resonator in the transmission line. Additionally, it is noted that this effect is only appreciable for transmission lines that are narrow with respect to the corrugation height, which may limit its utility in many systems.

The frequency response of simulated corrugation is shown in FIG. 17. In contrast to the quasi-static model, there is clearly some dispersion. To account for the dispersive nature of the corrugation, the inductive impedance $j\omega L_C$ may be replaced in Eq. 4.4 with a generalized sheet impedance:

$$Z = j\omega\eta_0 t \tan(k_0 h_c) \tag{4.7}$$

This yields:

$$\mu_{av} = 1 + \frac{t\tan(k_0 h_c)}{k_0 h_{TL} a}. \tag{4.8}$$

The frequency responses of these models are plotted in FIG. 17. The transmission line model better predicts the dispersive behavior of the corrugation, but it has an explicit dependency on the wavenumber in the corrugation. This spatial dispersion limits the utility of the effective medium description, especially when the angle of the incident wave is allowed to vary. Fortunately, a series expansion shows that Eq. 4.8 is independent of k to first-order, and that the dispersion has the typical Lorentzian form. In accordance with the presently disclosed design, Eq. 4.8 may be used to generate an initial corrugation. The complete unit cell was then optimized using commercial electromagnetics code driven by a MATLAB script.

Polarization and Boundary Conditions

Figure 18:
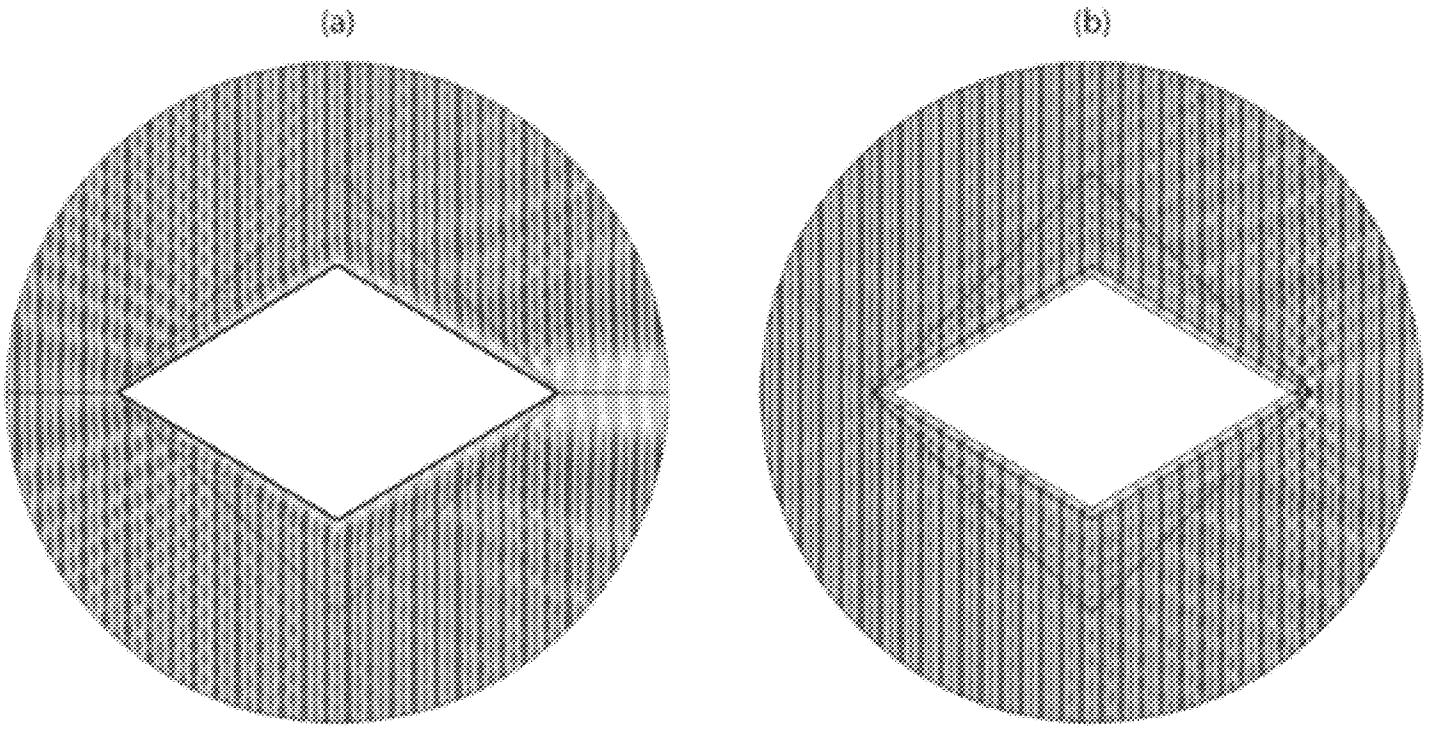
FIG. 18 illustrates the effect of PEC and PMC boundary conditions on cloaking performance for TMz polarization.

One subtlety arises from the boundary conditions that are enforced on the inner surfaces of the cloak. The mathematical considerations behind the transformation ignore the effect of differing boundary conditions for incident waves of different polarizations. Whereas the scattering cross-section of a point is identically zero, a line can scatter if it violates the boundary conditions of the incident wave. Specifically, a perfectly conducting line segment enforces $\hat{n}\times E=0$. If the incident wave has a component of the electric field along the line segment, a scattered wave must appear so that the total field obeys this boundary condition. This is the case in cloaking configurations disclosed herein, as depicted in FIG. 18, which illustrates the effect of PEC and PMC boundary conditions on cloaking performance for TMz polarization. (a) of FIG. 18 shows a unidirectional cloak with PEC inner core, and (b) of FIG. 18 shows the same cloak with a wavelength separation between the inner cloaking boundary and the PEC core. Fortunately, there is a straightforward method [76, 77, 78] to transform this boundary condition to that of a perfectly magnetic conductor (PMC). The PMC enforces the condition $\hat{n}\times H=0$. This boundary condition is obeyed by the incident field, so a surface of this type will not introduce scattering.

The thickness of a dielectric slab to form an effective PMC surface is derived. At normal incidence, the wavenumber in the cloak is equal to that of free-space, $k_0$. This wave is incident on a slab of dielectric $\in_r$ that acts as the impedance-transforming layer (ITL). Snells law requires that $$k_x^{cloak} = k_x^{dielectric} = k_0 \cos(\theta), \tag{4.9}$$

and the phase through the ITL is then $$k_y d = \sqrt{\in_r k_0^2 - k_0^2 \cos^2(\theta)}. \tag{4.10}$$

The PMC boundary condition is achieved when $k_y d = \Pi/2$ [76, 77, 78], so that the reflected is in-phase at the inner cloaking interface. Therefore, $$d = \frac{\lambda_0}{4\sqrt{\varepsilon_r - \cos^2(\theta)}}. \tag{4.11}$$

For fabrication and design simplicity, $\in_r$=1 was used. Combined with θ=30 degrees, this yields $d=_0 2$. FIG. 4.4(*b*) shows significant scattering reduction with the additional ITL. There is some residual scattering localized at the cloaking vertices where the half-wavelength condition cannot be fulfilled.

Figure 19:
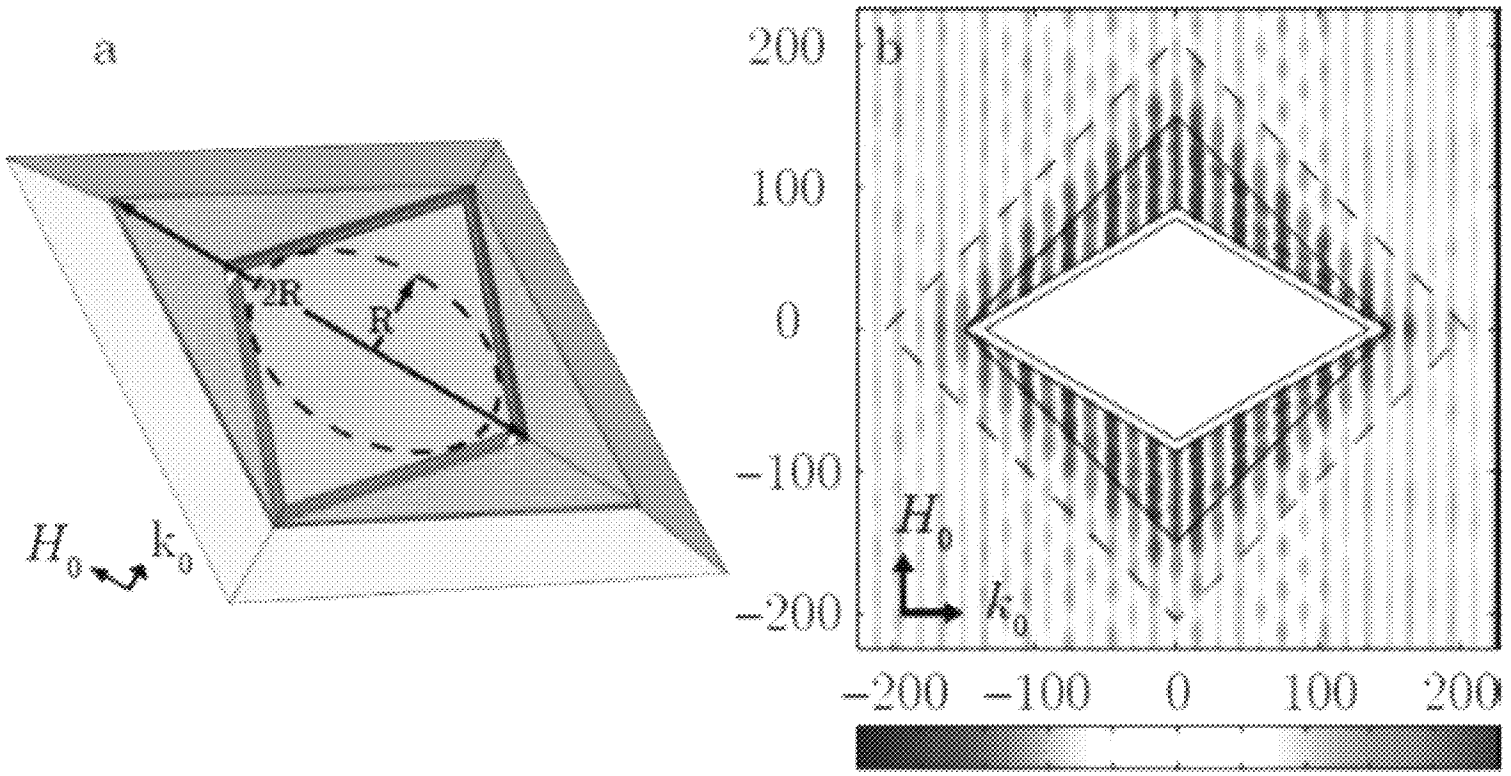
FIG. 19 shows in a 3D representation of the fabricated cloak and a 3D finite-element simulation of an electromagnetic wave incident from the left on the cloak.

However, this model does not account for differences in height between the 2D transmission line in the cloaking layer and ITL. The height difference introduces a shunt susceptance that increases the phase in the ITL, which in turn decreases the optimum thickness d. Numerical simulations revealed that the new optimum thickness for this configuration is $d \approx \lambda_0 4$, as depicted in the simulation from (b) of FIG. 19. FIG. 19 shows in (a) a 3D representation of the fabricated cloak. The cloak was designed to circumscribe a cylinder of radius R=7:5 cm. (b) of FIG. 19 depicts a 3D finite-element simulation of an electromagnetic wave incident from the left on the cloak. The dashed line indicates the extent of the taper beyond the edge of the metamaterial region.

Combined Design and Experimental Results

The use of corrugations can restrict the cloak to 2D operation. However, the cloak can be used outside of the 2D mapping environment by taking the design as shown in (a) of FIG. 19 and stacking it periodically in the out-of-plane direction. Additionally, the unit cell design and optimization assumed a parallel-plate wave-guiding environment with a height equal to the lattice parameter az of the unit cell. To accommodate the physical environment of the measurement apparatus, a waveguide taper is designed to squeeze the electromagnetic waves into this configuration. Full-wave simulations showed that a taper angle of 12.5 degrees was sufficient to minimize reflections while keeping the footprint of the taper relatively small, as shown in (b) of FIG. 19.

Figure 20:
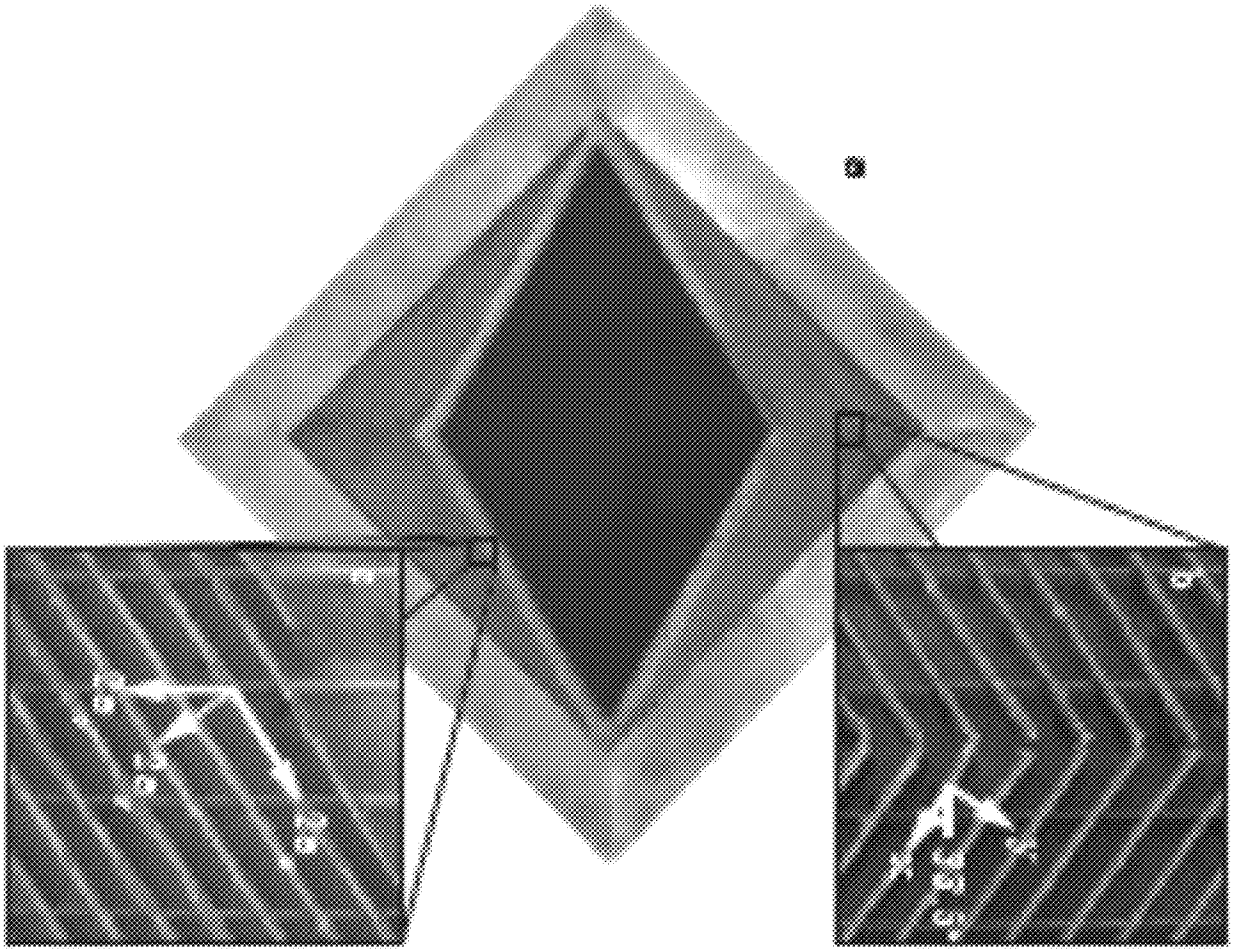
FIG. 20 shows photographs of the fabricated cloak. (a) of FIG. 20 shows a photograph of the full cloak.

Another subtlety of the design is that the bounding volume, (or unit cell), of the periodically positioned MM element is not rectangular. The MM unit cell was modified because a rectangular unit cell would introduce voids at the intersection of each quadrant of the cloak. Numerical simulations revealed performance was especially sensitive to defects in this region: even small gaps would result in large reflections. To ensure the correct material interface, the strips of SRRs have been shifted so that each strip meets its mirror image at the interior boundaries of the cloak. This shift is shown graphically in (b) of FIG. 19. The cloaking performance was characterized in a 2D planar waveguide apparatus previously reported [34]. For comparison, a bare copper cylinder with radius R=7.5 cm was measured. The measured field data are shown in FIG. 20. As expected, the electrically-large cylinder strongly scatters the incident wave, resulting in a deep shadow in the forward (right) direction and a large standing wave to the left. Both of these scattering features are almost completely absent in the field plots of the cloak.

FIG. 20 shows photographs of the fabricated cloak. (a) of FIG. 20 shows a photograph of the full cloak. (b) of FIG. 20 shows photograph of an internal material interface. The labeled arrows depict the orientation of the local coordinate system. The corrugations run along x, providing an effective response in that direction. Each strip has been shifted along x so that there is no discontinuity at the interior boundaries of the cloak. (c) of FIG. 20 shows a photograph of the material with overlaid arrows depicting the in-plane lattice vectors for the metamaterial unit cell. The vectors are twice the length of the lattice vectors to aid visibility.

Figure 21:
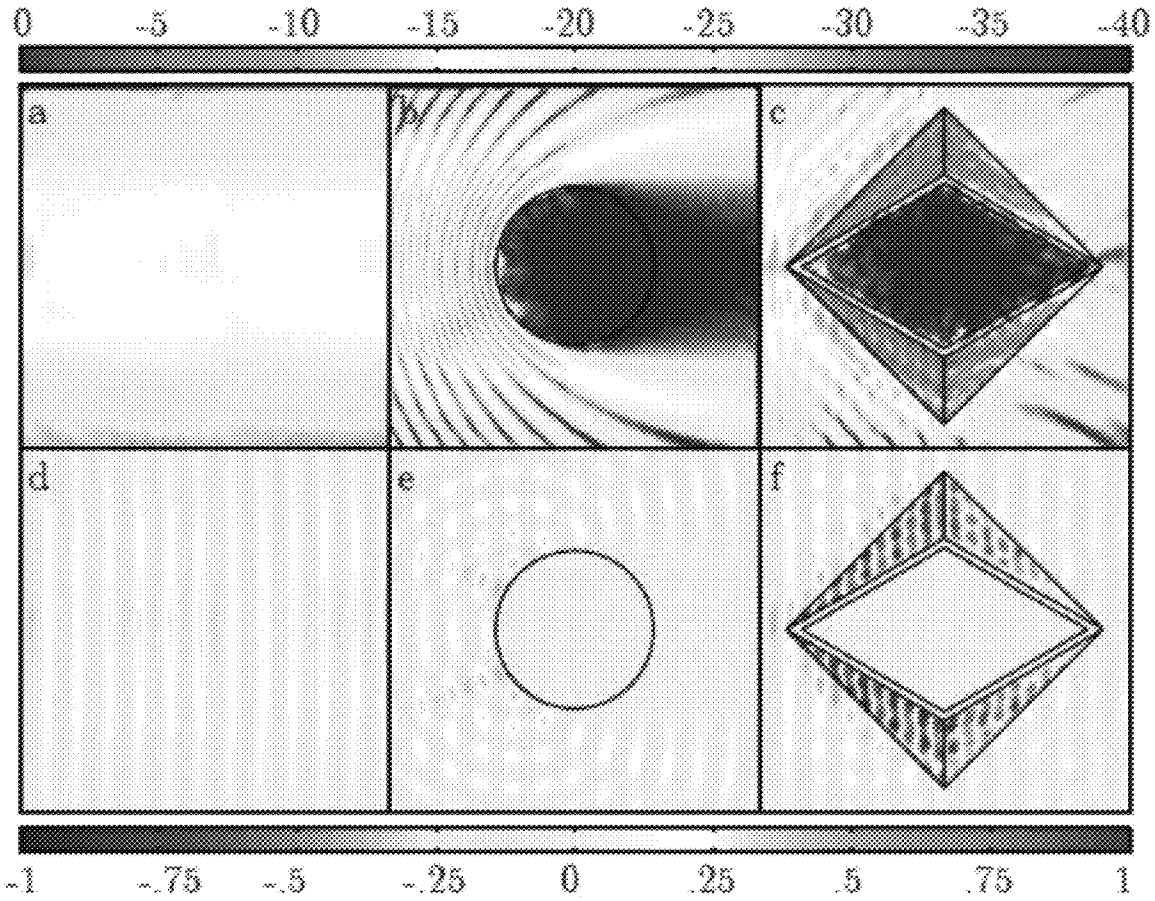
FIG. 21 depicts measured electric data for free space, the cloak, and a copper cylinder at the optimum cloaking frequency of 10.2 GHz.

The cloaking performance was characterized in a 2D planar waveguide apparatus previously reported [34]. For comparison, a bare copper cylinder with radius R=7.5 cm is measured. The measured field data are shown in FIG. 21, which depicts measured electric data for free space, the cloak, and a copper cylinder at the optimum cloaking frequency of 10.2 GHz. The electrically-large cylinder strongly scatters the incident wave, resulting in a deep shadow in the forward (right) direction and a large standing wave to the left. Both of these scattering features are almost completely absent in the field plots of the cloak.

Referring to FIG. 21, (a),(b), and (c) depict the absolute value of the field in decibels for free space, the cloak, and the cylinder, respectively. (d), (e), and (f) depict an instantaneous snapshot of the measured fields. The scaling on the top row is in dB, normalized to the maximum measured field. The scaling on the bottom row is linear and normalized to the maximum and minimum values of the instantaneous field. The scaling is given by the color bars on the top and bottom of the figure for the field amplitude, and instantaneous field, respectively.

The MM device guides the microwave radiation around its copper core so that the incident wave is restored in both amplitude ((c) of FIG. 21) and phase ((f) of FIG. 21) upon exiting the cloak on the right. The difference in performance is particularly striking in the shadow region: the field is almost 20 dB stronger to the right of the cloak than to the right of the cylinder.

Small imperfections in design and fabrication inevitably degrade cloaking performance. This degradation manifests as reflections from the cloaking boundary and improper reconstruction of the phase fronts of the incident wave. Additionally, it is noted that the cloaking frequency has shifted from 10 to 10.2 GHz upon implementation. This shift may be attributed to inter-unit cell coupling between MM elements, i.e. modifications to the mutual inductance and capacitances between individual resonant elements. Simulations show that $\mu_x$ is particularly sensitive to this coupling: small deviations in the resonant frequency of the SRR result in large a deviation of the permeability. Since the deviation is not the same in all the constitutive parameters, the cloaking efficacy is degraded at the shifted frequency.

Material Dispersion and Bandwidth

Figure 22:
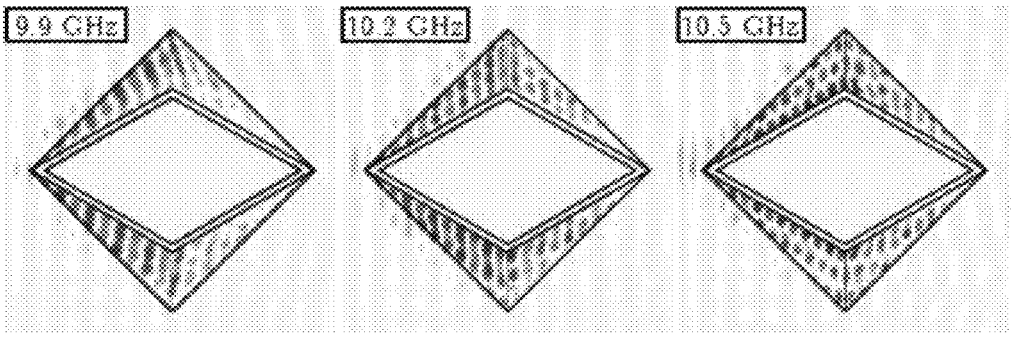
FIG. 22 depicts the measured field data at several frequencies showing the effects of material dispersion.
Figure 23:
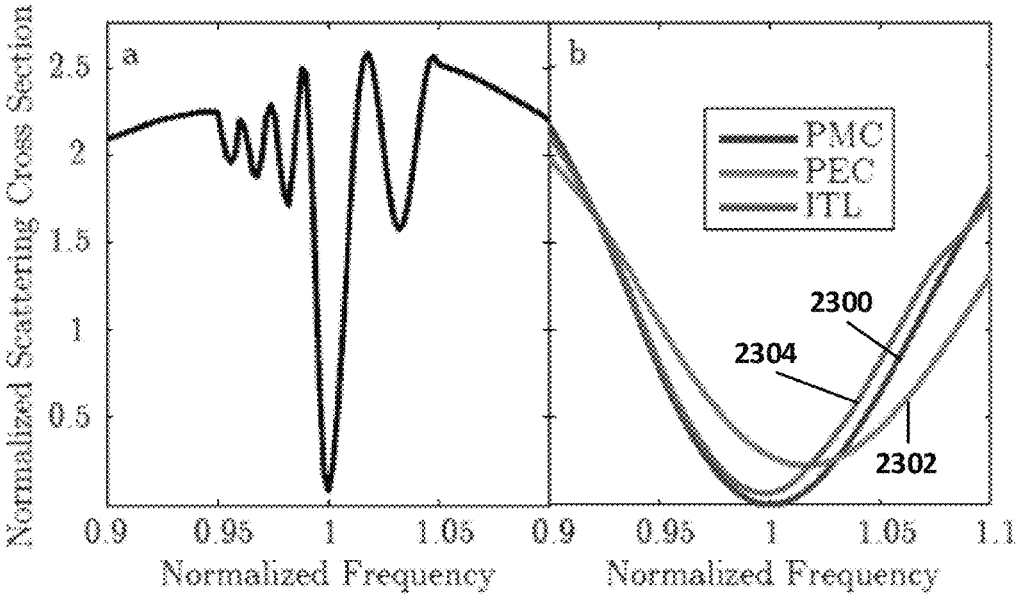
FIG. 23 shows simulated scattering cross-section of a cloak with the fabricated material parameters over a 20% frequency band and simulated performance comparison of a cloak with minimal dispersion in the presence of different boundary conditions.

All free-space cloaks require supra-luminal phase velocity and are therefore necessarily dispersive in frequency. To see the effect of this dispersion on the fabricated design, the measured instantaneous field values are plotted around the optimal cloaking frequency of 10.2 GHz in FIG. 22, which depicts the measured field data at several frequencies showing the effects of material dispersion. In FIG. 22, from left to right, the fields are depicted at 9.9, 10.2, and 10.5 GHz. There is clear distortion in the transmitted phase in the plots at 9.9 and 10.5 GHz. Referring to FIG. 22, it can be seen that both components of the permeability are fairly dispersive in the measured frequency range. At 9.9 GHz, the anisotropic index is slightly lower than required by the cloaking transformation, and the wave acquires less phase as it travels through the cloak than it would in free-space. At 10.5 GHz, the index is too high and the wave acquires too much phase in the cloak. However, it is noted that reflections are fairly minimal at all three frequencies, which indicates that the material parameters do not vary enough to significantly alter the wave impedance of the structure. Instead, the scattering is dominated by the sheer size of the cloak; and the long path length ensures that even small deviations in the material parameters can severely hamper performance. It can be seen that this effect quantitatively by simulating the cloak with the retrieved material values from FIG. 16 and calculating the total scattering cross-section, as shown in FIG. 23. Referring to FIG. 23, (a) shows simulated scattering cross-section of a cloak with the fabricated material parameters over a 20% frequency band. (b) of FIG. 23 shows simulated performance comparison of a cloak with minimal dispersion in the presence of different boundary conditions. Reference 2300 represents the line for PMC, reference 2302 represents the line for PEC, and reference 2304 represents the line for ITL. The SCS of each cloak is normalized to the SCS of the inscribed PEC cylinder. The phase error in the transmitted wave significantly alters the far-field scattering characteristics of the cloak, and limits it to an effective bandwidth of approximately 1%. However, there was no attempt to optimize the performance bandwidth for this design. It is therefore natural to ask what the bandwidth could be, subject to limitations of material response. To determine this bandwidth, it is assumed that the unit cell can be configured so that the only response with appreciable dispersion comes from the SRR due to its resonant nature. The SRR response is given by [24]:

$$\mu_y = 1 + \frac{F\Omega^2}{1-\Omega^2}, \tag{4.12}$$

where Ω is the frequency normalized to the resonant frequency of the SRR and F is the geometrical filling factor of the split ring. It is straightforward to show that the dispersion is minimized by maximizing F. However, for the response to be causal for a specified effective permittivity, it may be required that:

$$F \leq 1 - \epsilon_z^{-1}. \tag{4.13}$$

To determine the maximum cloaking bandwidth for a cloak with of dimensions disclosed herein, a cloak is simulated with the dispersion determined by Eq. 4.12 subject to Eq. 4.13. Additionally, it is noted that the ITL is dispersive and can affect bandwidth of the design disclosed herein. Therefore, the cloak may be simulated with the physical ITL as well as dispersion-less PEC and PMC inner boundaries. The calculated scattering cross-sections resulting from these simulations are shown in FIG. 23. Referring to FIG. 23, (a) shows simulated scattering cross-section of a cloak with the fabricated material parameters over a 20% frequency band. (b) Simulated performance comparison of a cloak with minimal dispersion in the presence of different boundary conditions. The SCS of each cloak is normalized to the SCS of the inscribed PEC cylinder. As expected, the dispersive cloak with the perfect PMC inner boundaries shows the lowest SCS (nominally zero subject to numerical noise), as well as a bandwidth of about 12%. The cloak with the ITL shows slightly decreased performance in both its minimum and SCS, and in bandwidth. The ITL-loaded cloak has a higher SCS, 7%, since the design cannot satisfy the correct separation from the material boundary to the PEC at the four sharp corners of the design. The bandwidth however is only decreased to 11% due to the dispersion of the ITL boundary. The material dispersion clearly dominates the overall bandwidth of the cloak. The PEC cloak shows the highest SCS minimum, 23%, as expected, but also a slightly enhanced bandwidth, 13%. This slight enhancement may be due to interaction with the scattered field from the imperfect cloak, as well as the fields from the effective PEC sheet.

The Discrete Dipole Approximation for Metamaterial Design

The Discrete-Dipole Approximation (DDA) is a numerical modeling tool motivated by physical reality. Purcell and Pennypacker [79] introduced the DDA to solve the scattering problem from irregularly shaped intersteller grains [79]. It is noted that the permittivity of a cubic crystalline structure is given by the Clausius-Mossotti equation:

$$\varepsilon = \varepsilon_0 + \frac{3}{d^3}\frac{\alpha}{1-3\alpha}, \tag{5.1}$$

meaning that the permittivity is determined by the average polarization of the ensemble, but the dipolar responses, ($p_i$), of individual elements i are influenced by all of the other elements in its vicinity. It is noted that a specified ∈ may be achieved on a relatively coarse grid by re-scaling the polarizabilities $\alpha_i$ to satisfy 5.1.

For a finite scatterer of arbitrary shape, both the polarization P and fields E and H may vary with position r. However, a linear system of equations may be constructed to solve for the individual pi in the structure for a known incident field E0. Once the dipole moments are determined, the scattered fields may be found from the superposition of equivalent-source dipole fields.

It was subsequently shown that the DDA was equivalent to other numerical methods, such as the VFIE and digitized Green's function method. However, the DDA has evolved relatively independently of these other techniques due to its early adoption by the astrophysics community, relative simplicity, and use in open-source codes. Over the past forty years, a number of modifications have been introduced to increase the capabilities of the method. Yurkin presented a comprehensive overview of the development of the DDA in [80]. Despite these advances, the DDA still suffers in comparison to other numerical tools. Performance drops sharply as the electrical size of the scatterer is increased [81, 82]. The DDA has been greatly hindered by its simplistic formulation and the numerical problems associated with the inversion the dense interaction matrices.

Fortunately, it may not be desired to use the DDA as a method to model continuum scatterers. Instead, the DDA may be used to model and understand some of the approximations inherent to TO-MM design. Some initial efforts have already been made in this direction. [83] used the DDA to investigate artifacts due to nonzero lattice spacing and crystalline defects on cylindrical cloaks. It is shown herein that the DDA may serve as a conceptual tool to improve both the accuracy of MM-TO models and the performance of physical devices.

The Discrete Dipole Approximation in 2D

The fundamental magneto-dielectric DDA equations are given by [84, 85, 83]

$$(\overline{\overline{\alpha}}^{ee})_i^{-1} p_i = E_0(r_i) + \epsilon_0^{-1}\sum_{j\neq i}\overline{\overline{G}}_{ij}^{ee} p_i + \sum_{j\neq i}\overline{\overline{G}}_{ij}^{em} m_i, \tag{5.2a}$$

$$(\overline{\overline{\alpha}}^{mm})_i^{-1} m_i = H_0(r_i) + \sum_{j\neq i}\overline{\overline{G}}_{ij}^{Me} p_i + \mu_0^{-1}\sum_{j\neq i}\overline{\overline{G}}_{ij}^{em} m_i, \tag{5.2b}$$

where $\overline{G}$ is the dyadic Green's function of the type indicated by the superscripts e and m. From reciprocity, $\overline{G}^{ee}=\overline{G}^{mm}$ and $\overline{G}^{em}=-\overline{G}^{me}$. This form of the DDA equation may be sufficient, but a more general formulation that includes local bianisotropy may be found in [84, 86]. In this development, restriction is made to $TM^z$ fields and each element i is considered to represent a z-oriented infinite column of scatterers with a periodicity $a_z$. In this case, the DDA equations can be written [83], e.g., for Eq. 5.2a:

$$\left[(\overline{\overline{\alpha}}^{ee})_i^{-1} - \varepsilon_0^{-1}\sum_{n=-\infty}^{\infty}\overline{\overline{G}}^{ee}(na_z\hat{z})\right]p_i = \tag{5.3}$$

-continued $$E_0(r_i) + \varepsilon_0^{-1}\sum_{j\neq i}\sum_{n=-\infty}^{\infty}\overline{\overline{G}}(\rho_{ij}+na_z\hat{z})p_i + \sum_{j\neq i}\sum_{n=-\infty}^{\infty}\overline{\overline{G}}^{em}(\rho_{ij}+na_z\hat{z})m_i,$$

and a similar equation exists for Eq. 5.2b. The summation over n on the LHS represents the response of all the identical elements in column i, and the prime (') indicates omitting the dipole at the origin. The summation over n on the RHS corresponds to the sum over identical dipoles in remote column j. Eq. 5.3 has been written in a leading way to show that the self-contribution on the LHS may be inserted into an effective polarizability representing each column. This is labeled as interaction constant $\mu_0 C_{yy}^{(1)}$. Methods exist for calculating this term effciently, but their explicit forms have been relegated to the Appendix A.

Now consider the field radiated by a single column of dipoles. The Hertzian potential (e.g., along z), can be of the form:

$$G = \frac{1}{4\pi}\sum_{n=-\infty}^{\infty}\frac{\exp - jk\left[\sqrt{x^2+y^2+(z-na_z)^2}\right]}{\sqrt{x^2+y^2+(z-na_z)^2}}. \tag{5.4}$$

In order to calculate the potential or derived fields at any point, Eq. 5.4 can be explicitly summed until suitable convergence is reached. Unfortunately, this convergence may be relatively slow since the fields decay only as $R^{-1}$. On the other hand, it can be expected that the fields far from the column to be those of a dipolar line current since the spacing $a_z$ is, (presumably), below $\lambda/2$. Therefore, the potential in terms of its discrete spectral components can be recast using the Poisson summation technique:

$$\sum_{n=-\infty}^{\infty} f(\alpha n) = \frac{1}{\alpha}\sum_{n=-\infty}^{\infty} F\left(\frac{2n\pi}{\alpha}\right). \tag{5.5}$$

Applying Eq. 5.5 to equation 5.4, it is found that:

$$G = \sum_{n=-\infty}^{\infty}\frac{1}{2\pi a_z}K_0(c_n\rho)e^{jz\frac{2\pi n}{a_z}}, \tag{5.6}$$

where $$c_n = \sqrt{\frac{2\Pi n}{a_z} - k^2}$$

and $K_0$ is the modified Bessel function of the second kind, or

Macdonald function. The Macdonald function is exponentially decaying and propagating for real and imaginary arguments, respectively, so only the n=0 term contributes in the far-field, as expected. The summation may converge quickly due to the exponential decay of the higher order terms. In analogous fashion to sinusoids, the fields derived from this potential function will also show exponential convergence.

Eqs. 5.4-5.6 represent the simplest case of the more general Ewald technique that combines both spatial and spectral terms [87]. The purely spectral method may be sufficient for some purposes described herein since meta-atoms are typically spaced below the Bragg diffraction limit at the frequencies of operation.

Polarizability Retrieval

The DDA is useful since it can accurately simulate a true physical system. It should also allow the evaluation of deviations from the optimum configuration present in the presently disclosed design. Such deviations can either stem from absorption in the meta-atoms, or constraints on material and fabrication that cause polarizabilities to deviate from the design value. It follows that the DDA may only be used for design if the polarizabilities of the elements can be discerned.

In conventional MM design, material parameters are often retrieved from numerical simulation. A number of methods are available to retrieve these parameters [88, 89, 33, 90, 91, 92, 93], but the modified retrieval is based on the inversion of scattering parameter data [94, 95] based on the Nicholson-Ross-Weir (NWR) experimental extraction method [96, 97].

Essentially, the NWR method inverts the known dependence of the S-Matrix to the material parameters of a slab of thickness d. In simulation, this process is typically performed on an infinite 2D array of MM elements. For a 2D array, the slab "thickness" is not well-defined, but it is often considered to be equal to the lattice parameter of a 3D cubic array. Additionally, this process implicitly assumes that the effective material parameters are local, and seemingly unphysical artifacts appear in the retrieved parameters [98, 99, 100, 101].

One of the fundamental limitations of this process is that element interactions are only accounted for in two directions. The retrieved parameters from a one-unit-cell-thick slab therefore do not accurately reflect the behavior of a bulk array. Additional unit cells may be added in the third dimension, but this adds complexity to the retrieval [102] as well as substantial artifacts due to small numerical errors in the S-parameters [103, 104]. In order to mitigate this problem, the individual elements may be extracted directly from the response of the array [105, 106]. This method attempts to account for the interaction of all the elements in the array in a manner consistent with the point dipole model.

Figure 24:
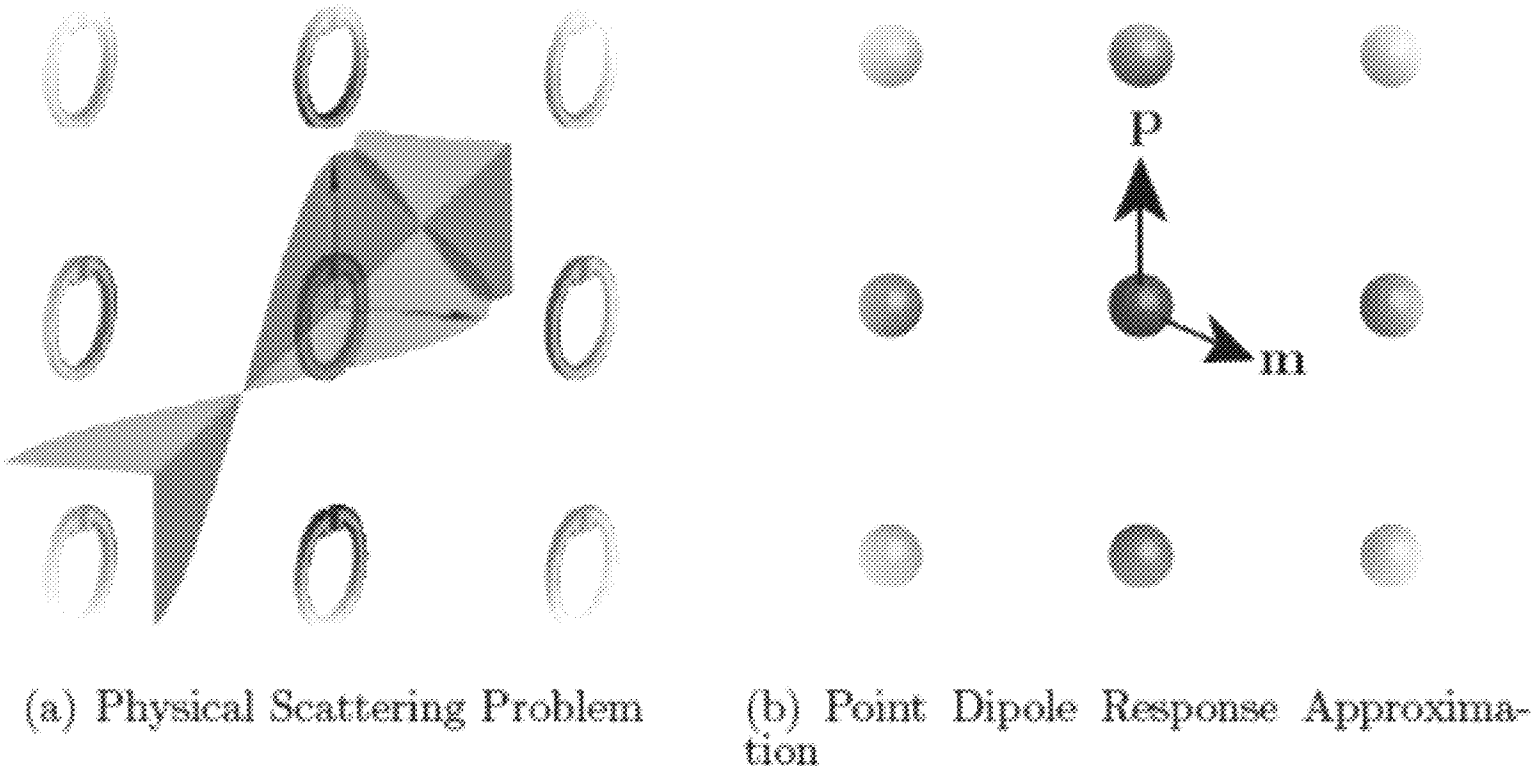
FIG. 24 shows plots of an array of SRRs.
Figure 25:
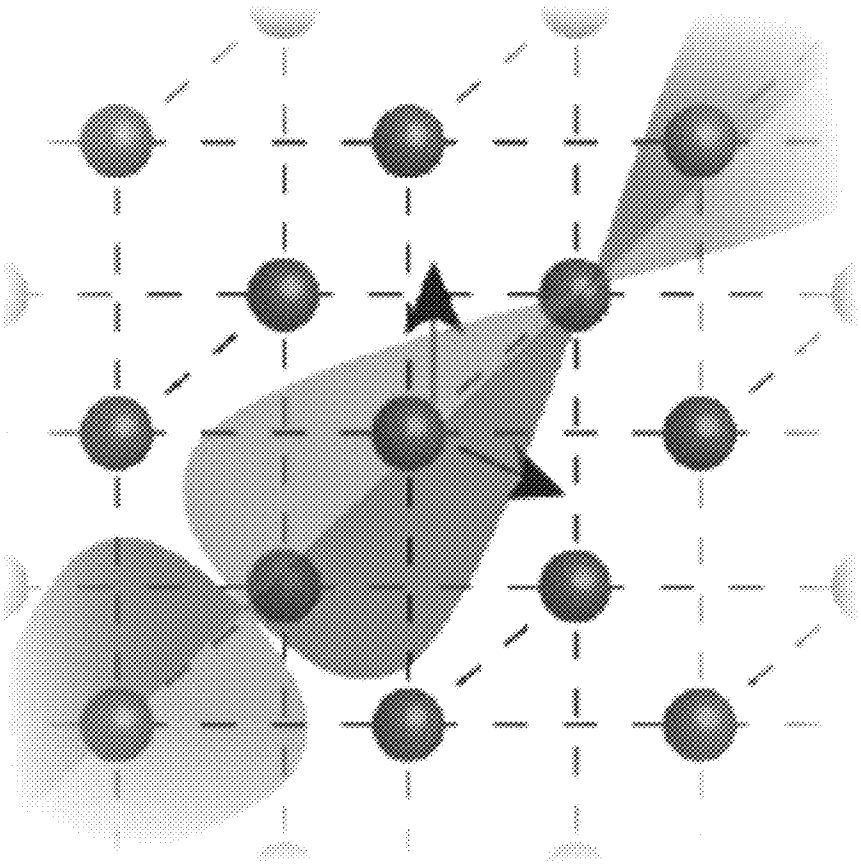
FIG. 25 depicts a diagram of a 3D lattice of dipolar elements.

In (a) of FIG. 24, an array of SRRs is plotted. It is assumed that the SRRs may be accurately modeled as zero-extent polarizable elements $\alpha_{yy}^{mm}$ and $\alpha_{zz}^{ee}$ such that the response is given by (b) of FIG. 24. A plane wave is incident as shown in (a) of FIG. 24. Due to the symmetry of the problem, magnetic and electric dipole responses are decoupled, and they may be considered separately. The local field exciting a magnetic element located at the origin is given by:

$$H_y^{loc}(0) = \mu_0^{-1}C_{yy}^{(2D)}m_y = \sum_{m=-\infty}^{\infty}\sum_{n=-\infty}^{\infty}G_{yy}(r_{mn})m_y, \tag{5.7}$$

where $r_{mn}=ma_y\hat{y}+na_z\hat{z}$ and $C_{yy}^{(2CD)}$ is the interaction constant for the 2D array. As before, a form more amenable to numerical computation is sought. An explicit expression may be found in Appendix A. The form of $C_{yy}^{(2CD)}$ is identical and is found immediately upon the substitution $(a_y, a_z)\rightarrow(a_z, a_y)$ in the expression for $C_{yy}^{(2CD)}$.

All of these interactions may be incorporated via introducing an effective probability given by:

$$\tilde{\alpha}_{yy}^{mm} = \frac{\alpha_{yy}^{mm}}{1 - \mu_0^{-1} C_{yy}^{2D} \alpha_{yy}^{mm}}. \tag{5.8}$$

Far from the array plane at (x=0), the electric and magnetic dipoles can be expected to radiate as electric and magnetic current sheets, respectively. The scattered electric fields at observation points ±d will therefore be:

$$E_z^{(s)}(x = \pm d) = \frac{j\omega}{2a_y a_z}(\eta p_z \mp m_y)e^{\mp jk_0 d}, \tag{5.9}$$

so that the S-parameters are given by:

$$S_{11} = \frac{E_z^{(s)}}{E_z^{(0)}} = \frac{-j\omega}{2a_y a_z}(\eta \tilde{\alpha}_{zz}^{ee} - \eta^{-1}\tilde{\alpha}_{yy}^{mm})e^{-j2k_0 d} \tag{5.10}$$

$$S_{21} = \frac{E_z^{(0)} + E_z^{(8)}}{E_z^{(0)}} = \left(\frac{-j\omega}{2a_y a_z}(\eta \tilde{\alpha}_{zz}^{ee} + \eta^{-1}\tilde{\alpha}_{yy}^{mm}) + 1\right)e^{-j2k_0 d}.$$

It is recognized these are the S-parameter equations [94, 95] for a magneto-electric slab in the limit of vanishing thickness but nonzero polarization. It is a simple matter to invert these equations to arrive at effective polarizabilities:

$$\tilde{\alpha}_{zz}^{ee} = j\frac{a_y a_z}{\omega\eta}(+S_{11} - S_{21} - 1)e^{j2k_0 d} \tag{5.11}$$

$$\tilde{\alpha}_{yy}^{mm} = -j\frac{a_y a_z \eta}{\omega}(1 + S_{11} + S_{21})e^{j2k_0 d}.$$

Using Eq. 5.11 and the known interaction constants, the polarizabilities of the element can be discerned. The clear limitation of this method is that the dipole must be spaced such that higher order interactions are negligible. However, this method neatly side-steps the problem of interactions out-of-plane since these interactions can be automatically included in the DDA analysis of finite structures and in the Eigenmodal analysis presented hereinbelow.

Bloch Modes in a 3D Magnetic or Electric Lattice

Design, material, and fabricational constraints can force meta-atoms to have a non-zero lattice spacing with respect to the wavelength. Limitations on available materials and fabricational tolerances may also require the meta-atoms to have some electrical size, which in turn enforces some minimum separation between elements. Additionally, the DDA formulation only considers dipolar interactions between meta-atoms. This requires considerable separation between adjacent elements to ensure that higher-order multipole coupling is negligible.

On the other hand, polarizability prescriptions disclosed herein are based on the Clausius-Mossotti relationship which is applicable only in the limit of infinite wavelength and vanishing lattice constant. Therefore, it is natural to seek an improved formulation that considers both the discrete lattice spacing and finite wavelength. Draine et. al. [107] considered this problem for a dielectric-only lattice in an attempt to improve the accuracy of DDA simulations. They suggested a polarizability prescription such that the refractive index of an infinite lattice was the same as a continuous dielectric along the direction of a given incident wave ko. They showed improved accuracy in their simulations for modest lattice spacings and low-index materials. However, as the index increased, this approximation proved less useful since appreciable scattering occurred in directions removed from $k_o$.

Figure 27:
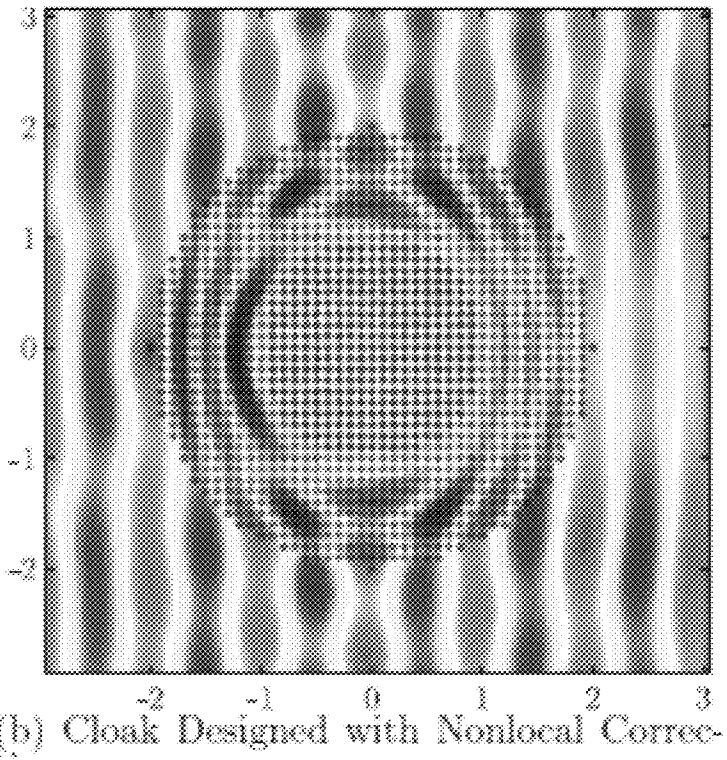
FIG. 27 shows DDA simulations of a cloak.

Clearly, Draine's prescription may not be well-suited for TO design since high indices of refraction may be needed. However, Draine's success can provide motivation to proceed in a similar fashion. An attempt was made in studies to find a polarizability prescription that produces the same anisotropic index of refraction along the principal axes of meta-atoms. By constraining to the principal axes, derivation may be simplified, and the matching of the index may not be possible in all directions as the band-edge of the crystal lattice is approached. A purely magnetic lattice may be considered. A 3D array of scatterers with polarizabilites $a_{yy}^{mm}$ may be considered as shown in FIG. 27. It is assumed that a wave propagate in x, and the fields are TMz. The local field acting on an element at the origin will consist of contributions from the 2D arrays of dipoles in the planes $x=\pm a_x$; $\pm 2a_x$; $\pm 3a_x$; etc., as well as those from the other dipoles in the array x=0.

(a) of FIG. 27 shows DDA simulation of a cloak designed with Clausius-Mossotti. (b) of FIG. 27 shows the same simulation but with polarizabilities corrected to account for nonlocal wave interactions. The shaded circles represent the quasi-PEC dipoles that comprise the cloaked object.

The interaction constants for the dipoles in the plane are x=0, and they are included in a renormalized polarizability $\tilde{a}_{yy}^{mm}$ as before. The dyadic subscripts are retained since it is anticipated that other vector components may be needed later on. Now the contributions from dipoles are considered in the other planes. The dipole moments in the other planes must obey the Bloch condition:

$$m_y(la_x) = m_y(0)e^{-jqa_x}, \tag{5.12}$$

where q is the unknown Bloch wave-number. The field exciting element at the origin is therefore $$H'_y(0) = \mu_0^{-1}\Sigma_{l=-\infty}^{\infty}{}' G_{yy}(r_{lmn})m_y e^{(-jqla_x)}, \tag{5.13}$$

where the primes, (′), indicate that the dipoles are omitted in the plane x=0, and $r_{lmn} = la_x\hat{x} + ma_y\hat{y} + na_z\hat{z}$. The dispersion relation for this system is then $$(\tilde{\alpha}_{yy}^{mm})^{-1} - \mu_0^{-1} C_{yy}^{(3)} = 0, \tag{5.14}$$

where $c_{yy}^{(3)}$ is given by Eq. A.15 for a unit dipole. Clearly, an unmodified version of the triply-periodic periodic Green's function represented by Eq. A.15 may not be suitable since q is unknown. Instead, techniques similar to those described the previous section can be used to obtain an alternative form:

$$C_{yy}^{(3)} = \frac{1}{2\pi a_y}\sum_{n=-\infty}^{\infty}\sum_{m=-\infty}^{\infty}{}'\sum_{l=-\infty}^{\infty}{}'\left[k^2 - \left(\frac{2\pi m}{a_y}\right)^2\right]K_0(c_m\Gamma_{ln})e^{-jqla_x} + \frac{k^2}{2a_y a_z}\sum_{n=-\infty}^{\infty}{}'\sum_{l=-\infty}^{\infty}{}'\frac{e^{-c_n|l|a_x - jqla_x}}{c_n} + \frac{k}{2a_y a_z}\frac{\sin ka_x}{\cos ka_z - \cos qa_x}. \tag{5.15}$$

The derivation of Eq. 5.15 is given in the appendix Eq. A. Surprisingly, the complicated expression for $C_{yy}^{mm}$ can provide some insight into the behavior of the system. The first two lines represent the contributions from evanescent waves generated by the completed dipole arrays. The last line represents the contributions from homogeneous plane waves generated by sheets of dipolar current $jm_y/(a_y a_z)$. For ax>>ay; az, it is found that the dispersion relation reduces to:

$$\cos qa_x = \cos ka_x - \frac{\tilde{\alpha}_y^m \omega}{2\eta a_y a_z} \sin ka_x, \tag{5.16}$$

which is equivalent to Eq. 13 in [101]. It can be shown that Eq. 5.15 reduces to the static interaction constant of a 3D dipole array given in [108] in the limit $qa_x \to 0$.

Unsurprisingly, the phase delay between adjacent planes of dipoles introduces spatial dispersion into the model. However can now use Eq. 5.15 and Eq. 5.14 to determine the effective index $n \equiv q/k_0$ for a given lattice and polarizability. Alternatively, the equations can be used to find the polarizability that gives $n=\sqrt{\mu_r}$, where $\mu_r$ is the desired effective permeability. It can be expected that using this corrected polarizability for a given lattice spacing will more closely resemble a continuous medium of relative permeability $\mu_r$ then when the polarizability assigned by Clausius-Mossotti. The DDA, in turn, can be used to assess this improvement.

Figure 26:
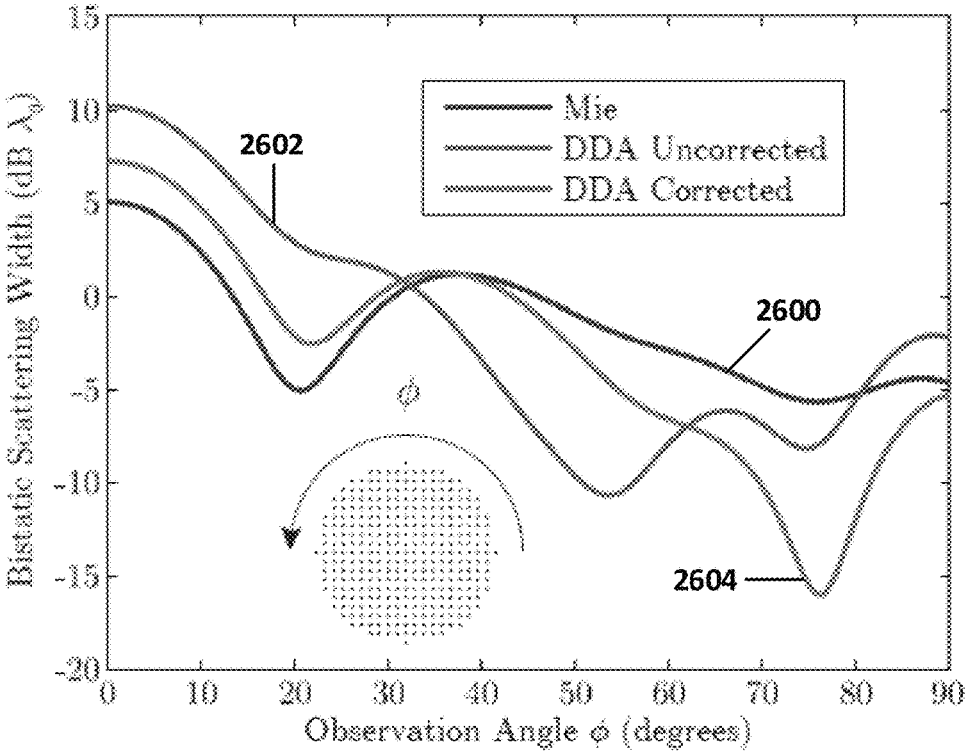
FIG. 26 shows a comparison of DDA simulations of magnetic cylinders with and without a correction.

In FIG. 26, DDA simulations of magnetic cylinders with and without this correction are compared. The lattice spacing of $a=\lambda_0/10$ represents a typical spacing of meta-atoms. It can be seen that the forward SCS of the uncorrected model yields a five-dB error for the relatively modest permeability $\mu_r=4$. The nonlocal correction yields a two-dB error in the same direction. Reference 2600 represents line Mie, reference 2602 represents line DDA Uncorrected, and reference 2604 represents line DDA Corrected.

This error may persist for two reasons. The first is spatial dispersion: even though the refractive index has been corrected along the principal axes of the lattice, the isofrequency contours cannot be forced to be correct for all q. However, this may not be expected to be a large source of error, since the dispersion remains quite elliptical even as the band-edge is approached [109]. Instead, most of the error most of the error may be attributed to the electromagnetic interactions at the boundary of the cylinder. The electromagnetic environment for the meta-atoms at the boundary differs considerably from those deep in the interior. These boundary elements are often termed Drude transition layers [110], and their effective properties can be drastically different from the interior, especially when the polarizability of the atoms is considerable. Moreover, as the effective-medium limit is left, the concept of a well-defined wave impedance may be lost [34, 111, 112], and scattering at the surface may be somewhat unpredictable. This is seen in FIG. 26, as explained now. The nonlocal correction gives the most improvement in the forward SCS, and agreement worsens as the observation angle increases. In a transparent material, the forward SCS is primarily determined by the phase delay of the wave transmitted through the material. However, reflections play a more prominent role as the forward direction is moved away from. Therefore, it can be expected that the correction can quickly yield diminishing returns as the polarizabilities become more extreme.

However, this correction may still prove a good initial step towards intelligent optimization of devices, especially when used in conjunction with DDA analysis. If the primary error in the prescription is due to error at the surface, then optimization efforts may be concentrated on the surface polarizabilties and assign the polarizabilities using the methods disclosed herein. It is shown herein that the validity of this method in the next section after a more general model suitable for TO design is developed.

Bloch Modes in a 3D Magnetic-Electric Lattice

The analysis for the magneto-electric case proceeds in a similar fashion to the previous section. However, it may no longer consider the magnetic and electric interaction constants separately since there is no guarantee that magnetic and electric elements will not interact. In fact, it has been shown in [101] that infinite arrays of magnetoelectric sheets will exhibit a nonlocal bianisotropic response due their nonvanishing separation. The treatment described herein will show a similar bianisotropy encapsulated by a magneto-electric dynamic interaction constant.

Following the methods of the previous section, local magnetic and electric fields can be found at the origin as given by:

$$H'_y(0)=\Sigma_{l=-\infty}^{\infty}{}'\Sigma_{m=-\infty}^{\infty}\Sigma_{n=-\infty}^{\infty}[G_{yz}^{me}(r_{lmn})p_z+\mu_0^{-1} G_{yy}(r_{lmn})m_y]e^{(-jql_a x)} \tag{5.17a}$$

$$E'_Z(0)=\Sigma_{l=-\infty}^{\infty}{}'\Sigma_{m=-\infty}^{\infty}\Sigma_{n=-\infty}^{\infty}[G_{zy}^{em}(r_{lmn})p_z+\in_0^{-1} G_{zz}(r_{lmn})m_y]e^{(-jql_a x)}. \tag{5.17b}$$

This system of equations may be written more compactly as:

$$\begin{bmatrix} \mu_0^{-1}C_{yy}^{(3)}(q)-(\tilde{\alpha}_{yy}^{mm})^{-1} & C_{yz}^{me}(q) \\ C_{yz}^{me}(q) & \varepsilon_0^{-1}C_{zz}^{(3)}(q)-(\tilde{\alpha}_{zz}^{ee})^{-1} \end{bmatrix} \begin{bmatrix} m_y \\ p_z \end{bmatrix} = 0, \tag{5.18}$$

where $C_{yy}^{(3)}$ and $C_{zz}^{(3)}$ are given as before, and $C_{yz}^{me}=C_{zy}^{em}$ as required by reciprocity. Once again, the expression for $C_{zy}^{em}$ as described herein is developed. This final expression is:

$$C_{zy}^{em} = -j\omega\frac{\partial G_y}{\partial x} = -\frac{j\omega a_x}{2\pi a_y}\sum_{n=-\infty}^{\infty}\sum_{m=-\infty}^{\infty}{}'\sum_{l=-\infty}^{\infty}{}' e^{-jqla_x}\frac{c_m l K_1(c_m\Gamma_{ln})}{\Gamma_{ln}} - \frac{j\omega}{2a_y a_z}\sum_{n=-\infty}^{\infty}\sum_{l=-\infty}^{\infty}{}' \operatorname{sgn}(l)e^{-c_n\Gamma_{ln}}e^{-jqla_x} + \frac{\omega}{2a_y a_z}\frac{\sin qa_x}{\cos ka_x - \cos qa_x}. \tag{5.19}$$

As before, it can be seen that the interaction consists of both homogenous and inhomogeneous plane-wave terms. However, in the limit $q_a x \to 0$, the evanescent terms become the antisymmetric function in 1, and these terms vanish identically.

The dispersion relation for this system can be found by enforcing $|C|=0$:

$$[\mu_0^{-1}C_{yy}^{(3D)}(q)-(\tilde{\alpha}_{yy}^{mm})^{-1}][\in_0^{-1}C_{zz}^{(3D)}(q)-(\alpha_{zz}^{ee})^{-1}]-(C_{zy}^{me})^2=0. \tag{5.20}$$

Again, numerical techniques may be used to find the $q(\omega)$. Some simplification is possible if it is assumed that the plane-wave interaction dominates, in which case Eq. 5.20 reduces to:

$$\cos qa_x = \cos ka_x - \frac{\omega}{4a_y a_z}(\tilde{\alpha}^e\eta^2 + \tilde{\alpha}^m)\sin^2 ka_x \pm \frac{\omega}{2a_y a_z}\sqrt{(\tilde{\alpha}^e\eta^2 + \tilde{\alpha}^m)^2\sin^2 ka_x + \tilde{\alpha}^e\tilde{\alpha}^m\sin^2 qa_x}, \tag{5.21}$$

which is equivalent to Eq. 49 in [101]. The derivation can be verified application to a TO device. For a cylindrical cloak of inner radius $R_1$ and outer radius $R_2$, the relevant material parameters are:

$$\varepsilon_z = \left(\frac{R_2}{R2 - R_1}\right)\frac{\rho - R_1}{\rho} \tag{5.22}$$

$$\mu_\phi = \frac{\rho - R_1}{\rho}$$

$$\mu_\rho = \frac{\rho}{\rho - R_1}.$$

Figure 28:
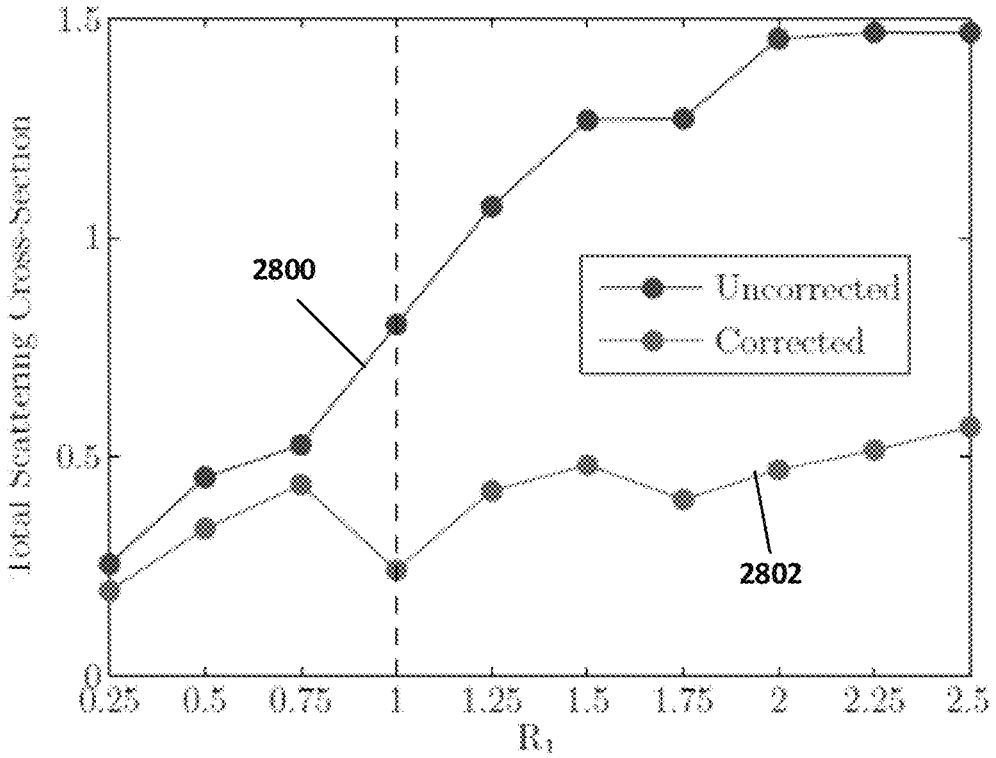
FIG. 28 shows cross-section comparison of cloaks with- and without-corrections.

Assuming the elements lay in a cubic array of lattice constant a, the polarizabilites at each site may be determined by inserting Eq. 5.22 into the Clausius-Mossotti equation. The simulated results are plotted from such a device on the left of FIG. 27. Highly conductive elements in the interior of the cloak to create a quasi-PEC scatterer. Cloaking performance may be poor even for the relatively modest lattice spacing of $a=\lambda_0/10$. By eye, it seems that the phase fronts are not properly combined upon exiting the cloak. Instead, the transmitted waves appear to be "refracted" at an angle away from the incident direction. This indicates that the locally-varying anisotropic index of refraction is not correct. Since phase error accumulates as the wave traverses the cloaking volume, it is most apparent as it exits on the right. FIG. 28 also shows performance continues to degrade as the electrical size of the cloak is increased and the phase errors increase. Reference 2800 represents Uncorrected, and reference 2802 represents Corrected.

FIG. 28 shows cross-section comparison of cloaks with- and without-corrections. The vertical dashed line indicates the cloaks simulated in FIG. 27.

In order to correct these aberrations, locally-varying anisotropic index of refraction $n(\hat{q})$ must first be defined such that $$n(\rho, \hat{q}=\hat{\rho})=\sqrt{\epsilon_z\mu_\phi}$$

$$n(\rho, \hat{q}=\hat{\phi})=\sqrt{\epsilon_z\mu_\rho} \tag{5.23}$$

This definition immediately implies that the eikonal limit is reached and such a prescription is valid. Then Eq. 5.20 may be numerically inverted to find the polarizabilities that yield the correct n. For simplicity, $\alpha_z^e$ may be used as specified by Clausius-Mossotti, and solve for $\alpha_\phi^m$ or $\alpha_{zp}^m$. Fixing $\alpha_z^e$ in this fashion can guarantee that the quasi-static solution is converged to as a is decreased. The simulated results are plotted on the right hand side of FIG. 27. Improved cloaking performance can immediately be observed: the wave fronts are properly combined upon exiting the cloak on the right, although a faint shadow is still visible. The performance improvement is confirmed when the scattering-cross section is calculated for both designs in FIG. 28. The SCS has been normalized to that of the quasi-PEC core, and thus the corrected cloak has a normalized SCS of 0.25, whereas the uncorrected cloak has an SCS of 0:80. Additionally, the corrected cloaking performance is quite consistent as the size of the cloak is decreased. It can be expected that performance will eventually degrade as the cloak size is increased due to residual scattering from the surface and small errors in the refractive index.

Despite these small imperfections, the results clearly demonstrate improved performance over a conventional cloaking design. Since the index of refraction can only rigorously be specified in one direction, it can be expected that this method would be more ideally suited for the unidirectional design described herein. However, the cylindrical design presented above may certainly be used as the basis for further numerical optimization.

Extensions for the DDA

Formulations for DDA disclosed herein make several assumptions. Specifically, it assumes that elements only interact via their dipolar responses, and that the excitation fields are uniform over the element volume. To ensure the validity of these assumptions, highly sub-wavelength elements that are separated by distances that are at least comparable to the element size may be required. Highly sub-wavelength elements in turn require very fine features, and the relatively large element spacing may dilute the material response.

A solution in accordance with embodiments disclosed herein is to incorporate the interaction of higher-order multipoles into the DDA. This was pursued in [113], but it is noted that their analysis was restricted to spherical elements for which the induced quadrupoles could be calculated analytically. Additionally, higher-order terms may increase the numerical complexity of the problem, which in turn decreases the advantages gained using the methods disclosed herein. Instead, improvements to the approximations are considered that stem from additional knowledge about the meta-atoms themselves.

For instance, many meta-atoms consist of simple shapes arrayed in some regular pattern. If restriction is made to the quasi-static regime, then use of the physical models of the elements themselves can be made to increase the accuracy of simulations without increasing the number of interacting terms. Two specific examples to clarify methods disclosed herein are provided below.

Coaxial Ring Resonators

Consider a loop of area $S_1=\Pi R_1^2$. A uniform incident H-field induces an EMF:

$$V_{ind}=-j\omega\mu_0 H_0 S_1=j\omega L_1 I+IR_r \tag{5.24}$$

The polarizability is therefore:

$$\alpha = \frac{I_1 S_1}{H_0} = -\frac{j\omega\mu_0 S_1^2}{Rr + j\omega L_1}. \tag{5.25}$$

If another loop $S_2=\Pi R_2^2$ is introduced, this will also contribute some flux:

$$V_0(r_1)-j\omega\mu_0\int H_{12}\cdot dS_1=I_1 Z_{11},$$

$$V_0(r_2)-j\omega\mu_0\int H_{21}\cdot dS_2=I_2 Z_{22}. \tag{5.26}$$

From reciprocity, the mutual impedances are the same, and the result is:

$$Z_{12}=j\omega M_{12}=j\omega\mu_0\int H_{12}\cdot dS_1, \tag{5.27}$$

$$M_{12}=\mu_0\oint[\int\overline{G}I_2]\cdot S_1. \tag{5.28}$$

In this context, the DDA assumes that the distance between loops $r_{12}$ is sufficiently great that the field originating form the second loop is uniform over the first loop, (and vice-versa). However, this may fail when the two loops are very close to one another. When the loops are positioned arbitrarily, Eq. 5.28 can be evaluated explicitly. Fortunately, in most real circumstances, the loops are positioned with some sort of regularity. Specifically, if the two loops are positioned coaxially, this term may be approximated analytically.

If $r_{12} << \lambda_0$, Eq. 5.28 reduces to the Nuemann form, and the mutual inductance has the analytical solution:

$$M_{12}^{QS} = \mu_0 \sqrt{R_1 R_2 \left[\left(\frac{2}{k} - k\right) K(\kappa) - \frac{2}{k} E(\kappa)\right]} \tag{5.29}$$

where $$\kappa^2 = \frac{4R_1 R_2}{r_{12}^2 + (R_1 + R_2)^2}, \tag{5.30}$$

and K( )and E( )are the complete elliptical integrals of the first and second kind, respectively.

In the DDA, the mutual inductance term is given by:

$$M_{12}^{DDA} = \frac{\mu_0}{2\pi} \frac{e^{-jk_0 r_{12}}}{r_{12}} \left(\frac{jk_0}{r_{12}} + \frac{1}{r_{12}^2}\right) S_1 S_2. \tag{5.31}$$

It is noted that in the same quasi-static approximation, Eq. 5.31 reduces to:

$$M_{12}^{DDA,near} \approx \frac{\mu_0}{2\pi} \frac{1}{r_{12}^3} S_1 S_2. \tag{5.32}$$

Conversely, if at large distances, $\kappa^2 \approx R_1 R_2 / r^{12}$ the asymptotic forms for K(κ) and E(κ) yield:

$$M_{12}^{QS,far} \approx \frac{\mu_0}{2\pi} \frac{1}{r_{12}^3} S_1 S_2. \tag{5.32}$$

This suggests that the following should be used:

$$M_{12}^{DDA+QS} = M_{12}^{QS} e^{-jk_0 r_{12}} + \frac{jk_0 \mu_0}{\pi} \frac{e^{-jk_0 r_{12}}}{r_{12}^2} S_1 S_2 \tag{5.34}$$

to improve the accuracy of the simulations. Using this circuit analysis, and restricting to the scalar magnetic problems, the DDA Eq. 5.2 may be rewritten as:

$$I_i Z_i = V_0(r_i) - \sum_j I_j Z_{ij}. \tag{5.35}$$

It is desired to be able to incorporate this correction directly into the DDA equation. Therefore, the effective interaction term may be defined as:

$$\tilde{G}_{ij} = \frac{M_{ij}}{S_i S_j}, \tag{5.36}$$

which differs from the regular DDA equation only for coaxial resonators.

Figure 29:
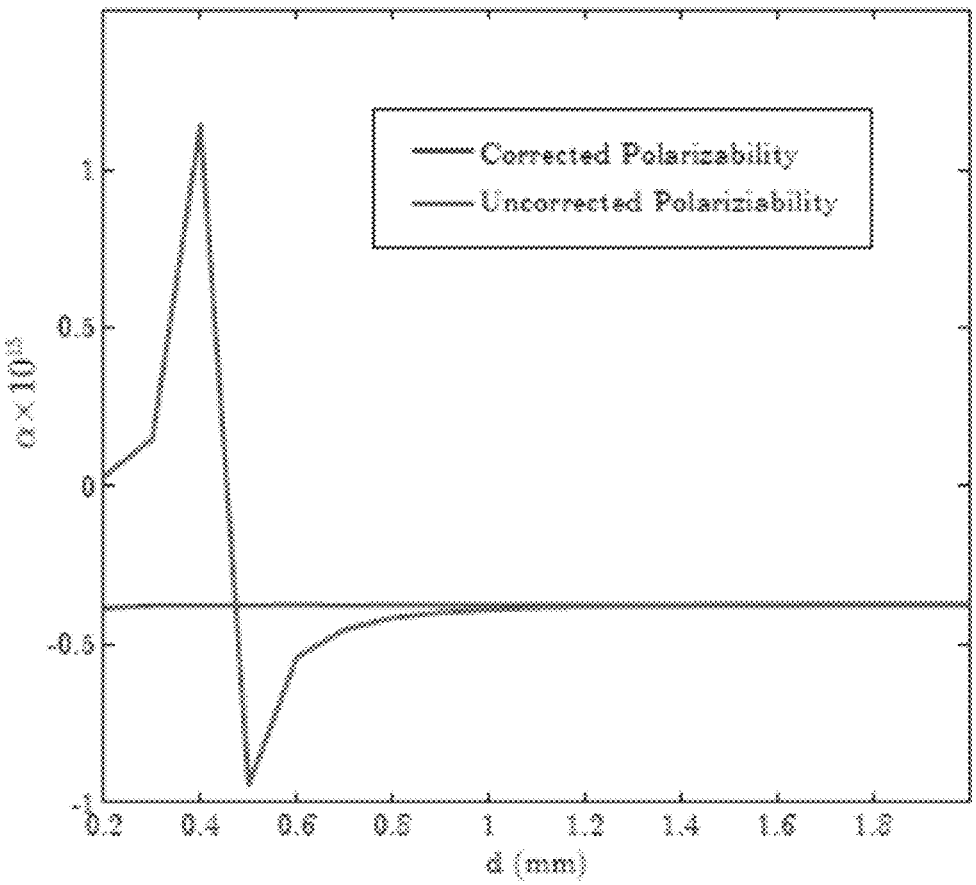
FIG. 29 illustrates a graph comparing retrieved polarizabilities with and without corrections to the mutual inductance between loops.

The method was evaluated by simulating a 2D infinite array of loops and extracting the polarizabilities for various separations $a_y$. This extraction was performed with both the conventional interaction constant C, and one that incorporates the modifications, (derivation provided herein). It can be expected that the conventional polarizability retrieval may fail when the loops are tightly packed. This error may manifest as a variation of the retrieved polarizability as a function of $a_y$. On the other hand, the modified interaction $\tilde{C}$ may show little- to no-variation. These expectations are confirmed in FIG. 29, which illustrates a graph comparing retrieved polarizabilities with and without corrections to the mutual inductance between loops. The conventional method begins to fail when the separation is about one loop radius. Past that point, the retrieved polarizability varies rapidly and even changes signs as the separation becomes substantially smaller than r. On the other hand, the polarizability retrieved via the corrected method disclosed herein is virtually unchanged for all simulated separations. It is noted that a slight deviation in the retrieval when the separation is very small; the self-inductance of the loop is no longer well represented by that of an isolated loop, and the finite trace width can become significant.

The idea of using DDA analysis for metamaterial elements has been developed in the discussions herein. It has been shown that the DDA can be used to diagnose some of the artifacts that occur when the limits of the quasi-static approximations disclosed herein are violated. However, it has also been shown that the DDA is more than a simple diagnostic tool. Using the dipolar model, a method of design has been developed that begins to correct some of these troubling artifacts.

Complementary Metamaterial Devices

In 1944, Hans Bethe considered the electromagnetic problem of diffraction through an electrically small aperture in a conducting plane [114]. By introducing fictitious magnetic currents and charges in place of the aperture, both magnetic and electric polarizabilities can be assigned to the aperture, and that the transmitted field may be determined by the dipole moments induced by the incident field. This theory has since been generalized to apertures of arbitrary shape [108], and apertures have found use both as couplers [115, 116] and frequency selective surfaces [117].

However, these apertures did not enter the realm of metamaterials until 2004. Falcone et. al. used Babinet's principle to show that apertures patterned in the shape of split ring resonators would provide a resonant electric response [118]. This greatly simplified the analysis of these apertures since the theory was able to bring to bear all of prior research on conventional metamaterials and metasurfaces. These elements are labeled complementary metamaterials (CMMs) to highlight this duality. It has since been shown that the complements of electrically-coupled elements similarly provide a magnetic response [119]. This latter result has generated a great deal of interest since it introduced a straightforward means of providing a relatively broadband paramagnetic response, a feature split-ring resonators lack. For instance, Yang et. al used a complementary metamaterial to both miniaturize and increase the performance of a conventional microstrip antenna [120].

Complementary Metamaterials

The duality between conventional metamaterials and CMMs may be more complex than the simple exchange of the effective material tensors $\overline{\overline{\epsilon}}$ and $\overline{\overline{\mu}}$. Some of these new complexities are illustrated via a concrete example. The complementary splitring resonator (C-SRR) introduced by Falcone et. al. [118] was the first example of a complementery metamaterial, and it is used herein as a tool in analsyis. First analyze this structure is analyzed in terms of Babinet's principle, and it will be shown that Babinet's principle limited in it's applicability. To overcome the limits of such a model, present an analysis based on an equivalent circuit model. Finally, some subtleties are examined that arise from point-dipole description of the aperture disclosed herein.

Babinet's Principle in Electromagnetism

Figure 30:
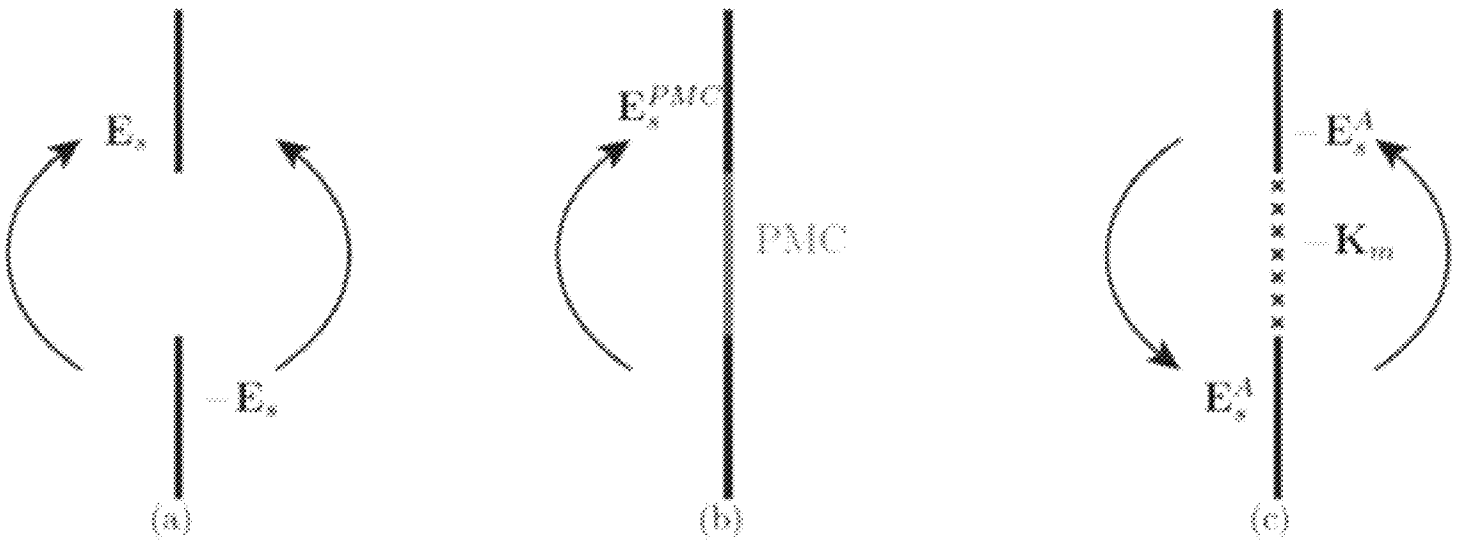
FIG. 30 depicts diagrams of a field scattered from an aperture, fields scattered from a PMC surface of the same dimensions embedded in a PEC plane, and fields radiated by a magnetic surface current source.

Consider the aperture in a PEC plane as shown in (a) of FIG. 30. An electromagnetic wave is incident from the left, causing currents to flow in the PEC, which in turn generate fields on both sides of the aperture. The aperture may be filled with a fictitious magnetic conductor (PMC) as shown in (b) of FIG. 30. The boundary conditions on the PMC surface are:

$$\hat{n}\times H_0=-\hat{n}\times H_S^{PMC} \tag{6.1a}$$

$$\hat{n}\times E_0=-\hat{n}\cdot E_S^{PMC}, \tag{6.1b}$$

where $\hat{n}$ is taken as the surface normal pointing left. The scattered fields are determined by the induced magnetic currents and charges on the PMC:

$$\rho_m=\hat{n}\cdot B_S^{PMC} \tag{6.2a}$$

$$K_m=-\hat{n}\times E_S^{PMC}. \tag{6.2a}$$

If now the aperture is opened, it can be observed that these fields no longer satisfy the boundary conditions of the problem. For instance, $\hat{n}\times E$ is not continuous across the aperture. However, if a magnetic current source $-K_m$ is placed in the open aperture, then the following results:

$$\hat{n}\times H_1^A=\hat{n}\times H_2^A \tag{6.3a}$$

$$-K_m=-\hat{n}\times(E_2^A-E_1^A). \tag{6.3b}$$

If the fields scattered by the PMC surface are combined with the fields radiated by the current source $-K_m$, the following results:

$$\hat{n}\times(H_0+H_S^{PMC}+H_1^A)=\hat{n}\times H_2^A \tag{6.4a}$$

$$\hat{n}\times(E_0+E_S^{PMC}+E_1^A)=\hat{n}\times E_2^A \tag{6.4b}$$

Referring to Eq. 6.4a, the tangential components of $H^{PMC}=H_0+H_S^{PMC}$ are identically zero according to Eq. 6.1a, so Eq. 6.4a reduces to Eq. 6.3a and the continuity of H has been preserved. Similarly, combining Eq. 6.2b and Eq. 6.3b yields $E_S^{PMC}=E_1-E_2$. Inserting this into Eq. 6.4b shows that tangential E is likewise preserved. Disclosed herein is a solution that obeys the imposed boundary conditions.

The preceding derivation is equivalent to Babinet's principle, but the scattering of the aperture is not directly related to the scattering from a conventional structure. However, for the special case that the material parameters are the same on both sides of the aperture, now $E_1^A=-E_2^A$ is provided, and the total scattered field is shown to be $E_S=\pm E_S^{PMC}/2$, and similarly for $H_S$. Since the scattered aperture fields are one-half those of the shaped PMC surface, it can be concluded that the scattering characteristics are dual to a PEC scatterer of the same geometry. Explicitly, for the case of a flat, PEC SRR, the magnetic dipole moment is given by:

$$m=\int r\times K ds, \tag{6.5}$$

where K is the electric surface current. For the PMC case, the electric dipole moment is given by:

$$p=\int r\times K_m dS. \tag{6.5}$$

A similar relationship holds for the electric dipole moment of the SRR and the magnetic moment of the PMC SRR. The complementary SRR (C-SRR) scatters as a magnetic dipole of half the strength of the electric dipole moment of the SRR.

Quasi-Static Model of a Complementary Split-Ring Resonator

While Babinet's principle provides a rigorous theoretical basis for properties of complementary metamaterials, it may be somewhat difficult to extract a meaningful cause-and-effect relationship between the incident field and scattering properties of the apertures through that principle alone. Additionally, an explicit relationship between the aperture and its complement is obtained when the materials are the same on both sides of the aperture. In reality, these apertures may be fabricated on a substrate, and the dielectric function may suffer a large discontinuity directly at the aperture surface. Finally, effective medium properties cannot immediately be ascribed to an array of such apertures, since the effective dipole moments exist in the presence of an infinite PEC surface. This PEC surface may be accounted for in some manner in the homogenization scheme.

Owing to these limitations, quasi-static circuit models may be created as has been done for conventional metamaterials elements. Development disclosed herein parallels the derivation that is presented for the convectional SRR as described herein. When an incident electromagnetic wave encounters the aperture, electric and magnetic fields develop to satisfy the boundary conditions presented. In particular, in-plane electric fields and out-of-plane magnetic fields must exist to satisfy the Dirichlet boundary conditions on the tangential and normal components of H and E, respectively. On the source-free aperture surface, $\nabla\cdot D=0$ and D may be written as the curl of an auxiliary vector potential F [26]. It follows that:

$$H_0+H_S=H_0-\nabla\phi_m^S-j\omega F_S=0. \tag{6.7}$$

Figure 31:
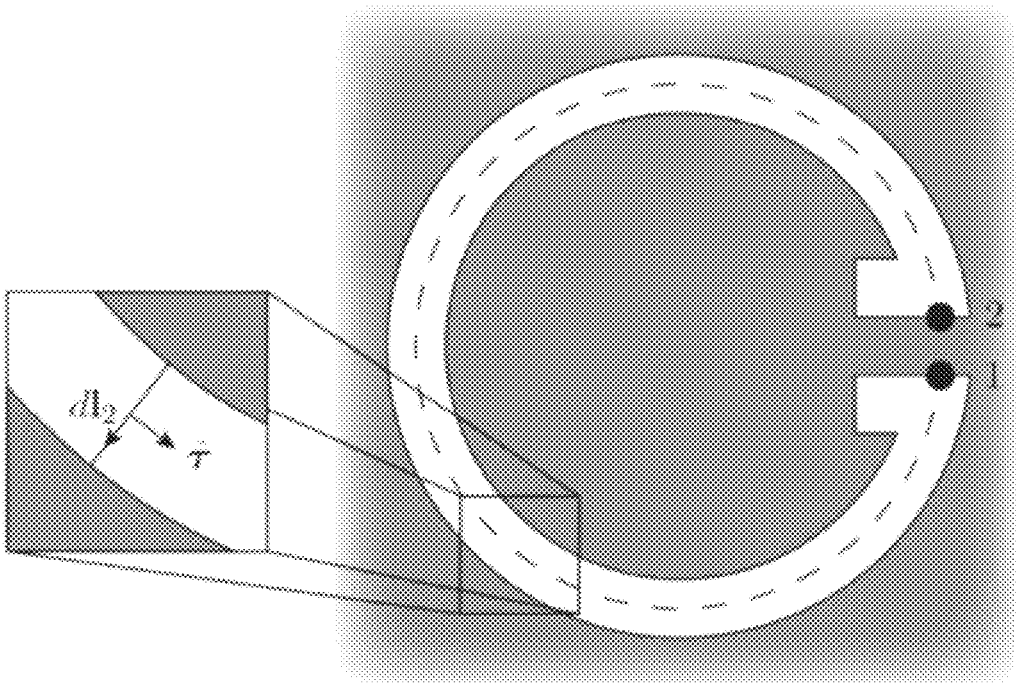
FIG. 31 depicts a C-SRR showing the integration contour for the circuit analysis disclosed herein.

In order to obtain a cause-and-effect relationship as before, integration from points 1 to 2 as indicated in FIG. 31 may be made:

$$\int_1^2 H_0\cdot dl=\int_1^2\nabla\phi_m^S\cdot dl+j\omega\int_1^2 F_S\cdot dl. \tag{6.8}$$

FIG. 31 depicts a C-SRR showing the integration contour for the circuit analysis disclosed herein. The first term on the LHS, $$\int_1^2 H_0\cdot dl, \tag{6.9}$$

once again represents the source. It is assumed that the integral can be closed in E without effecting its solution, (the integration of $H_0$ over the narrow PEC "gap" is negligible). Stoke's theorem and Ampere's law may be used to find:

$$\int H_0\cdot dl=j\omega\int D_0\cdot dS. \tag{6.10}$$

It is noted that this still holds when there are currents associated with the incident field, (such as in a parallel plate), since they will be confined to the plane. Upon comparison of Eq. 6.10 and Eq. 1.7, it can be seen that the source in the C-SRR is indeed the electric field as the magnetic field is considered the source in the conventional SRR.

Now attention is drawn to the first term on the RHS. It can be assumed that the integral can be closed without perturbing the solution. It is found that:

$$j\omega\int F\cdot dl=j\omega\int\nabla\times F\cdot dS=\int D\cdot dS. \tag{6.11}$$

The term on the RHS is the "electrical flux" through the circuit. However, this term can present a complication: D is abruptly discontinuous on the PEC surface, and the flux calculation may differ depending on which side of the surface is chosen to perform the calculation. This is an important aspect of at least some of the present disclosure, as the circuit may only present a self-consistent solution on the side that calculations are performed. Therefore, care must be taken to specify the proper surface normal and half-space in the analysis.

Considering this complication, "electrical inductance" may be defined as:

$$L_e = j\omega \frac{\int D \cdot \hat{n} dS}{I_m} \tag{6.12}$$

where the "magnetic current" I. has been introduced. The concept of magnetic current already has been used in the development of Babinet's principle, but now the concept is explored a bit farther. To explicitly calculate I. from its definition in Eq. 6.2b:

$$I_m = \int K_m \cdot \hat{\tau} dl = -\int (\hat{n} \times E_S) \cdot \hat{\tau} dl = -\int E_S \cdot dl_2, \tag{6.13}$$

where the integration is depicted along the contour shown in the inset of FIG. 31. So it can be seen that physically, the so-called magnetic current corresponds to the potential difference on either side of the C-SRR "wire" due the presence of induced charges. From Faraday's law, the following equation results:

$$\hat{n} \cdot (\nabla \times E) = \nabla \cdot (-\hat{n} \times E) = -j\omega(\hat{n} \times B), \tag{6.14}$$

or $$\nabla \cdot J_m = -j\omega\rho_m, \tag{6.15}$$

and a continuity equation is recovered for the fictitious current. If it is assumed that the physical currents are contained in the "complementary gap" of the C-SRR, then the irrotational magnetic fields can also be localized there. From this continuity equation, it can be seen that $I_m$ will be constant elsewhere in the circuit, and the definition of electrical inductance is consistent with the conventional case. This leads to a final term, which unsurprisingly corresponds to a magnetic capacitance:

$$\int \nabla \phi_m \cdot dl = \frac{Q_m}{C_m}, \tag{6.16}$$

where the so-called "magnetic charge" $Q_m$ only appears due to the incomplete integration around the SRR. The circuit model can allow the immediate calculation of the dipole moments using Eq. 6.6.

The formulation disclosed herein may be limited in that it does not directly relate to real physical quantities, but it allows the use of well-developed intuition regarding conventional circuits in the analysis of complementary structures. The physical currents in the C-SRR are distributed over the entire PEC surface and do not follow a simple or intuitive path. By comparison, the fictitious magnetic currents follow the same well-defined path as electrical currents in true wire circuits. This formulation also has the benefit that it exists independently of a well-defined transmission line. For instance, when used as couplers, apertures are often modeled as series or shunt inductive loads. However, the loading effect of a finite aperture in an infinite parallel plate waveguide is somewhat ill-defined since only the impedance per-unit-length is defined for such as structure.

Energy Balance and the Modified Sipe-Kranendonk Condition

Figure 32:
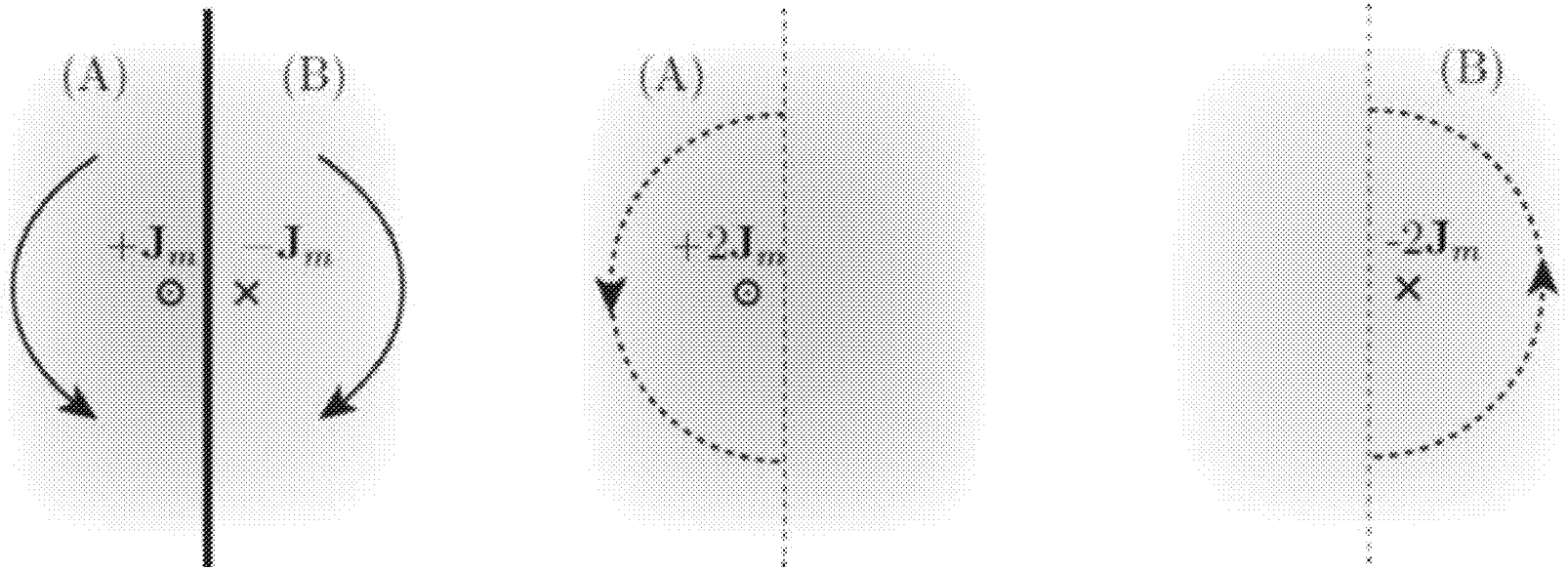
FIG. 32 depicts diagrams of integration of power radiated by equivalent magnetic sources.

The quasistatic model disclosed herein does not consider the effect of radiation damping. This effect typically manifest as a loss term in circuit descriptions of antennas. Similarly, in scattering calculations, a losseless element may have a nonvanishing imaginary part to its polarizability determined by the relationship:

$$\mathrm{Im}\left[\frac{1}{\alpha}\right] = \frac{k^3}{6\pi\varepsilon}, \tag{6.17}$$

which is sometimes referred to as the Sipe-Kranendonk condition [121]. This condition must be satisfied for a self-consistent description of a passive scatterer due to power balance considerations. It will be demonstrated that this condition must be modified when considering small apertures as polarizable elements. This modified condition may be integral to an understanding of the behavior of these apertures, and it may also be necessary to any implementation of discrete-dipole analysis. Consider the problem of an electromagnetic wave impinging on a PEC surface, creating two dielectric half-spaces, (A) and (B). An aperture exists in the PEC such that it is described by a magnetic polarizability $\overline{\alpha} = \alpha\hat{z}\hat{z}$. The incident field is on side (A). The problem reduces to the scalar form, and the dyadic subscripts may be forgone for the sake of compactness. The induced magnetic dipole m is produced on either side of the PEC surface as shown in (a) of FIG. 32. FIG. 32 depicts diagrams of integration of power radiated by equivalent magnetic sources. The power expended by the plane wave on the induced current is given by:

$$P^{ext} = \frac{1}{2} J_m^* \cdot H_0 \tag{6.18}$$

The power expended to excite the dipole may be given by:

$$P^{ext} = \frac{1}{2}\mathrm{Re}[J_m^* \cdot H_0] = \frac{1}{2}\mathrm{Re}[-j\omega m^* H_0] = \frac{1}{2}\mathrm{Re}[-j\omega\alpha^*]|H_0|^2 = -\frac{\omega}{2}\mathrm{Im}[\alpha]|H_0|^2. \tag{6.19}$$

Now the power radiated by a complementary metamaterial may be determined. The scattered fields are those of a point magnetic current source M=+jωm on top of a PEC ground plane on side (A). Using image theory, this is equivalent to a point current of twice the amplitude radiating in free-space. The Poynting vector can be integrated in the far-field using the free-space magnetic Green's function:

$$P^{rad,A} = \int_0^{\pi}\int_0^{\pi} \frac{1}{2}\mathrm{Re}[E_\phi H_\theta^*]\rho^2 \sin\theta d\phi d\theta = \frac{\omega^2 k^2}{6\pi\eta}|\alpha|^2|H_0|^2 \tag{6.20}$$

where the integration is only over the top half-space, as shown in (b) of FIG. 32. However, the dipole may also radiate into the bottom half-space pBq, as shown in (c) of FIG. 32. The total radiated power is therefore $$P^{rad} = \frac{\omega}{6\pi\mu_0}(k_A^3 + k_B^3)|\alpha|^2|H_0|^2. \tag{6.21}$$

In the lossless case, $P^{ext}=P^{rad}$ and $$\mathrm{Im}[\alpha] = -\frac{k_A^3 + k_B^3}{3\pi\mu_0}, \tag{6.22}$$

or $$\mathrm{Im}\left[\frac{1}{\alpha^{mm}}\right] = \frac{k_A^3 + k_B^3}{3\pi\mu_0}. \tag{6.23}$$

A similar analysis leads to a similar condition on the electrical polarizability:

$$\mathrm{Im}\left[\frac{1}{\alpha^{ee}}\right] = \frac{k_A^3 + k_B^3}{3\pi\varepsilon}. \tag{6.24}$$

Since the DDA operates on the inverse polarizability, this quantity may be added to the nominal value to obey conservation of energy, (half this value with the renormalized polarizability that is introduced in the next section). If the polarizability is retrieved via simulation, this condition should be satisfied automatically. However, if the electrical size of the element is considerable, the point-dipole description might fail, and the radiation condition might not be satisfied. Additionally, elements such as the SRR have considerable quadrupole moments that are not considered in retrieval [27, 28], and this condition may not be met in the retrieved polarizability [106]. At least some self-consistency may be enforced in the model by making the substitution:

$$\frac{1}{\alpha^{e(m)}} = \mathrm{Re}\left[\frac{1}{\alpha_{sim}}\right] + j\frac{k^3 + k_0^3}{3\pi\varepsilon(\mu)}. \tag{6.25}$$

The DDA model is very sensitive to this parameter, especially near resonance. However, enforcing this condition can yield surprisingly good accuracy for structures with dimensions upwards of $\lambda/5$.

DDA Simulation

Since complementary elements may be described by electric and magnetic polarizabilities, they may be amenable to DDA simulations. Indeed, it can be found with the 2D formulation as disclosed herein with only minor modifications. It can then be demonstrated that the power of this method by comparing the DDA results to those of full-wave simulations. A CMM cloak is described herein with knowledge of the modified interactions in these apertures.

Interactions in a CMM-Loaded Waveguide

The analysis here is constrained to the scalar problem by considering elements with only an appreciable magnetic response along y. The axes are as depicted in FIG. 33, which depicts application of the surface equivalence principle and image theory to CMMs.

Figure 33:
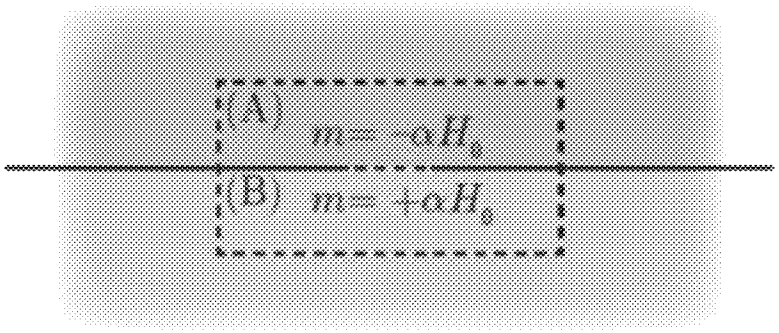
FIG. 33 depicts application of the surface equivalence principle and image theory to CMMs.
Figure 33:
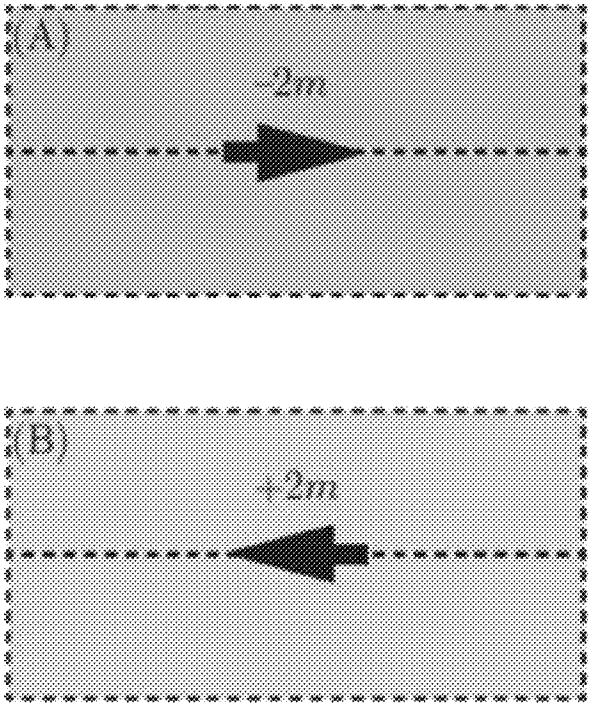

The analysis begins by considering a PEC plane separating two dielectric half-spaces (A) and (B), with corresponding dielectrics constants $\in_r^A$ and $\in_r^B$, as shown in (a) of FIG. 33. An aperture is etched in this plane, so that the cross-section is as shown. A $TM_z$ wave is incident on this aperture from side (A). In (A), the incident magnetic fields induce magnetic dipoles as expected from the circuit model. The scattered fields are therefore those of a Hertzian point source m radiating in the presence of a conducting sheet. By image theory [26], these fields are identical to fields radiated by point sources 2m in a homogeneous medium, as shown in (b) of FIG. 33. It can therefore use the Green's function of a homogenous medium to calculate the scattered fields as long as the effective magnetic dipole moments generating the fields is doubled. On side (B), the magnetic dipole will be equal in magnitude, but opposite in sign, of that on side (A). The scattered fields on side (B) can therefore be the same as those from a dipole −2m. The factor of 2 that comes from the image dipole can be absorbed if simultaneously double both the effective polarizability $\tilde{\alpha}$, and effective dipole moment $\tilde{m}$. This will be useful since all fields may be calculated using the effective dipole moment.

Figure 34:
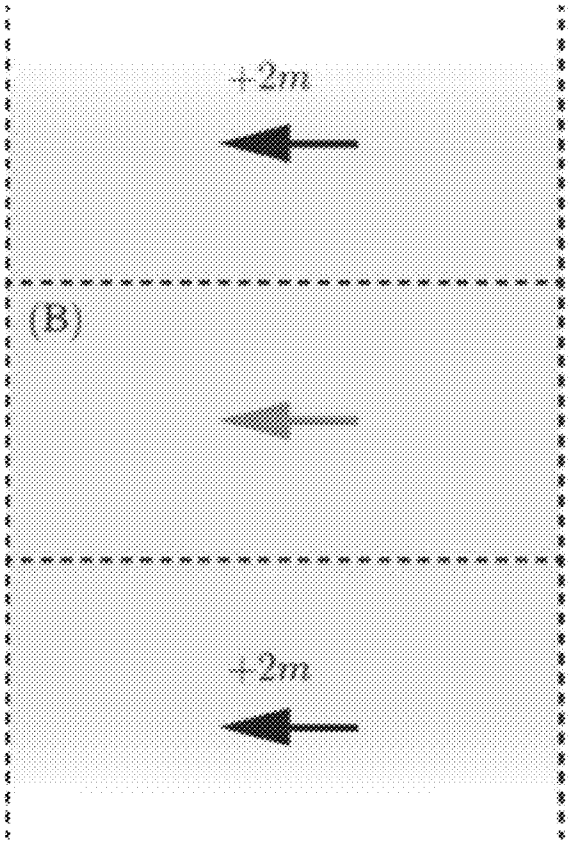
FIG. 34 depicts a diagram illustrating a scattering problem for an isolated aperture.
Figure 34:
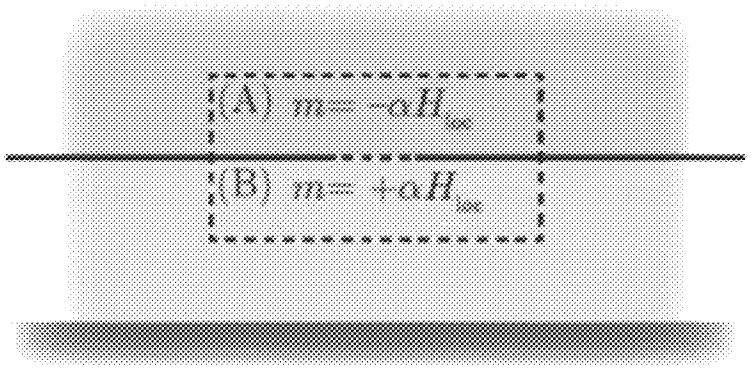

Another PEC plane may be added in (A) to form a parallel plate waveguide of height h as shown in FIG. 34, which illustrates the scattering problem for an isolated aperture. The left of FIG. 34 shows the original scattering problem, and the right of FIG. 34 shows the equivalent-source problem for the scattered fields. The Green's function on side (B) may be unchanged, but that on side (A) may be modified by the new boundary condition. Using image theory once again, it can be seen that the presence of the two plates is equivalent to the presence of infinite columns of identical dipoles. The 2D system has been created that was discussed herein, and the Green's functions that were developed in that section may be used to describe the interactions of dipoles on side (A). Additionally, the image dipoles can contribute to the local field exciting the aperture, so those interactions can be used as part of an effective polarizability, $\tilde{\alpha}$.

Now additional apertures of polarizabilities $\tilde{\alpha}_i$ can be patterned. Each aperture i can be excited by the incident field as well as those generated by the columns of dipoles j on side pAq. However, the dipoles on side (B) can also contribute to the local field. These fields act against the fields in (A), but they are also generated by dipoles of the opposite sign, so the overall contribution is once again positive. These interaction mechanisms have been graphically depicted on the right of FIG. 34. The local field acting on an element i is therefore:

$$\tilde{\alpha}_i^{-1}\tilde{m}_i = H_0(r_i) + \sum_{j\neq i}\tilde{m}\left[\tilde{G}^A(\rho_{ij}) + G^B(\rho_{ij})\right], \tag{6.26}$$

where $\tilde{G}$ represents the Green's function corresponding to a column of dipoles, and $k^{A,B}=\sqrt{\in_r^{A,B}}k_0$ is the dielectric-loaded wave-number.

Once the dipole moments are completed, the scattered field can be found by summing up the contribution from all the columns:

$$H_s^A(\rho) = \sum_i \tilde{m}_i \tilde{G}_r^A(\rho - \rho_i), \tag{6.27}$$

and the radiated field may be given by:

$$H_s^B(r) = -\sum_i \tilde{m}_i G^B(r - r_i). \tag{6.28}$$

Figure 35:
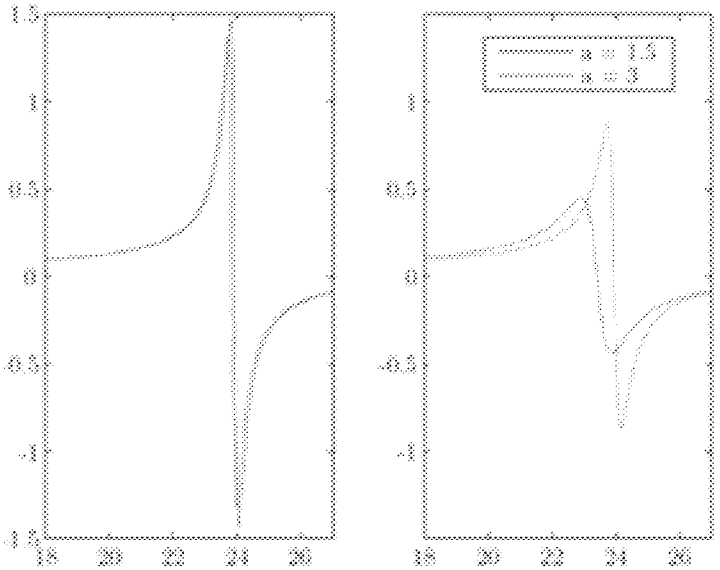
FIG. 35 shows polarizability retrieval of CMMs.
Figure 35:
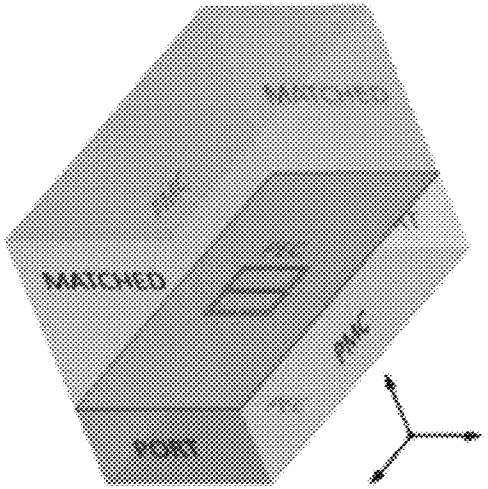

Now that it has been deduced how these dipoles interact, the 2D interaction constants can be modified to retrieve the polarizability of a simulated structure, as shown in (b) of FIG. 35. FIG. 35 shows polarizability retrieval of CMMs. The mirroring effect of the PEC and PMC boundary conditions on side (A) can create an infinite 2D array of polarizability elements that contribute to the local field exciting the element. It has been shown herein that these contributions are encapsulated in the interaction constant C. However, the contributions from side (B) should be added:

$$C_m^{(B)} = C_m^{(1)} = \sum_{m=1}^{\infty} \frac{e^{-jk^{(B)}ma_y}}{4\pi\mu_0}\left(\frac{jk^{(B)}}{a_y^2 m^2} + \frac{1}{a_y^3 m^3}\right). \tag{6.29}$$

This interaction constant may be added to that of a conventional array. As before, the accuracy of the retrieval is verified by performing it on the same aperture for two different lattice spacings as shown in (a) of FIG. 35. As before, the retrieved element polarizability is essentially unchanged for both lattice constants. On the other hand, $\alpha$ is clearly affected by the interactions of the other dipoles in the array.

Figure 36:
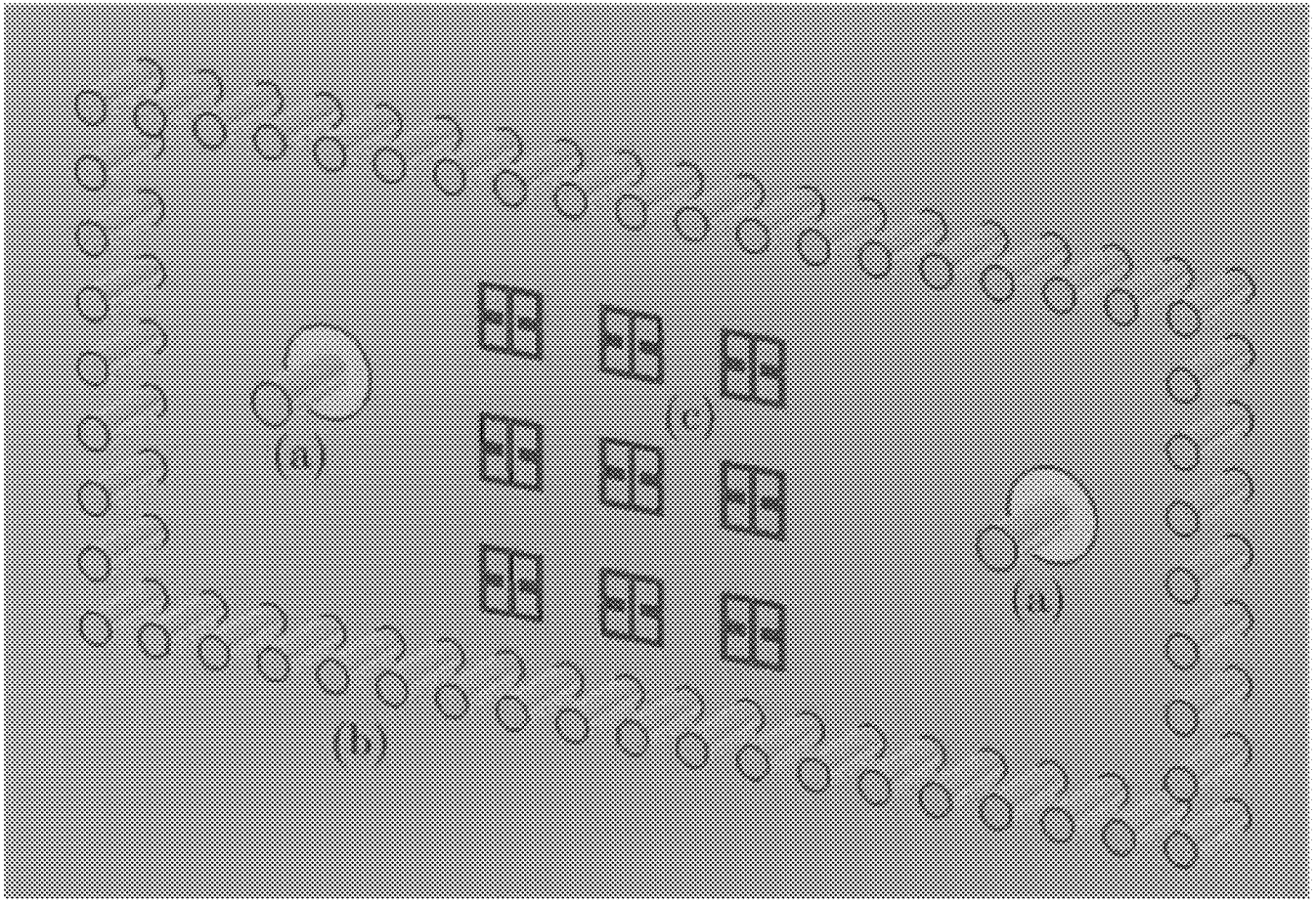
FIG. 36 depicts a diagram of a CMM-DDA test device.

Now, a physical device may be simulated. As a test, a device of modest electrical size is simulated so that it can be compared to full wave simulations. This device consists of a 3×3 array of C-ELCs as shown in FIG. 36, which depicts a diagram of a CMM-DDA test device. (a) of FIG. 36 is the coax probe, (b) of FIG. 36 is the PEC via, and (c) of FIG. 36 is the C-ELC. The simulation domain can be confined with a rectangular fence of metallic vias, and the structure can be excited with two probes using the model that were developed in the previous section. In order to increase the accuracy of the simulations, the effect of the magnetic polarizability of the vias has been included:

$$\alpha_{xx}^{mm} = \alpha_{yy}^{mm} - 2\mu_0 a^2, \tag{6.30}$$

as well as the electrical polarizabilities of the C-ELCs.

Figure 37:
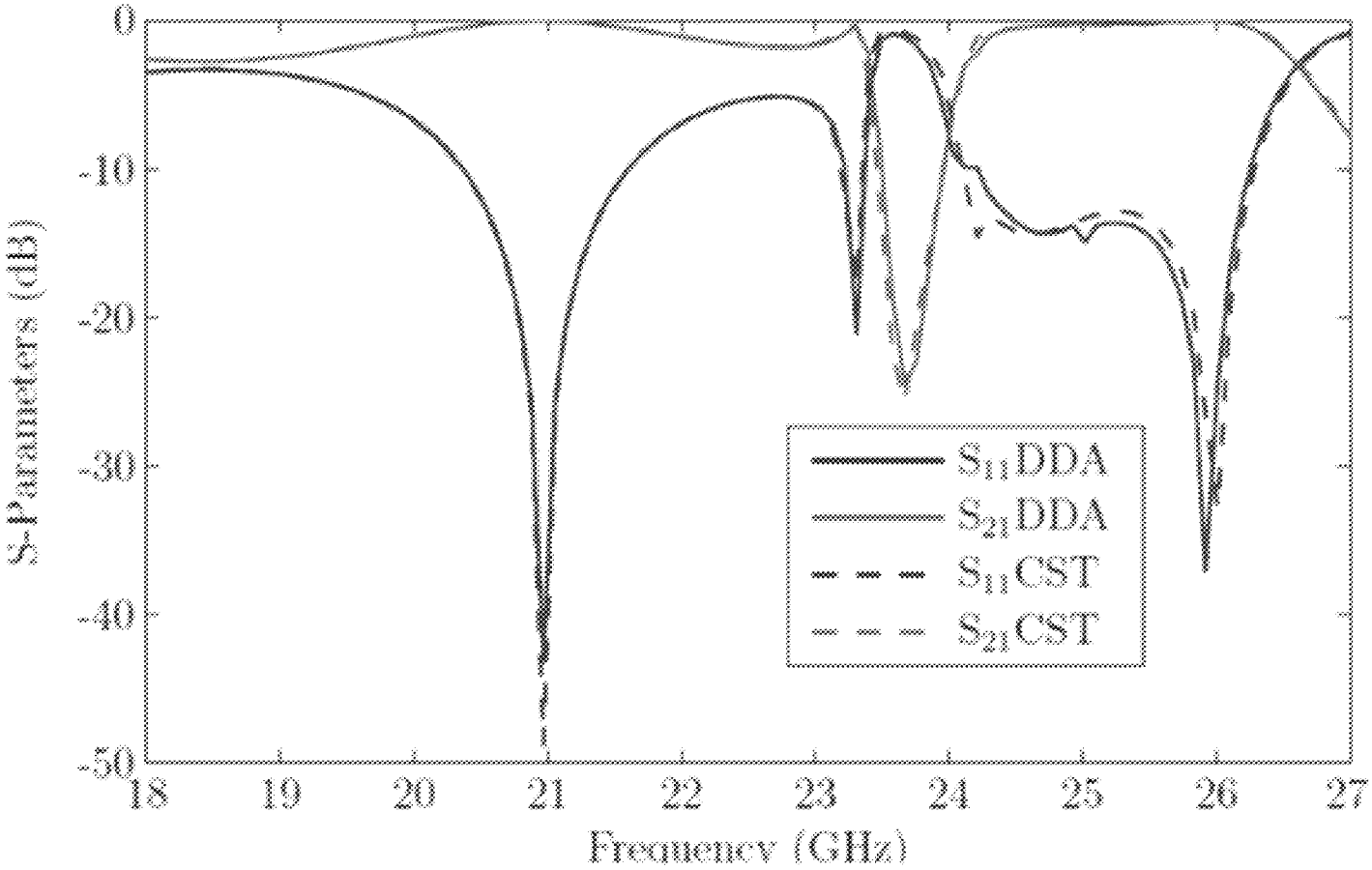
FIG. 37 shows a comparison of two-port S-parameters to those calculated in CST Microwave Studios.

In FIG. 37, a comparison of the two-port S-parameters to those calculated in CST Microwave Studios is made. Details for the calculation of network parameters in the DDA may be found herein below, along with a model for the coaxial probe. The agreement is quite good across the entire simulated frequency range, though some error in the model is apparent past the resonance at 24 GHz. This error appears because the magnetic quadrupoles' resonance is being approached in the structure, and it is neglected in the model. At lower frequencies, the agreement is almost perfect since the behavior is dominated by both the probe and the vias characteristics, which are well-described by the model.

TO Design with CMMs

In the previous Subsection, it was shown that the DDA simulations of CMMs compare favorably with full-wave numerical solvers. It has also been shown that a CMMs may be regarded as effective material fillings in a parallel plate waveguide. Therefore, it may reasonably be expected that TO devices could be produced by patterning CMMs on one- or both-sides of a parallel plate waveguide. Indeed, this has already been demonstrated in [18]. Similar conclusions can be made with some qualifications.

Figure 38:
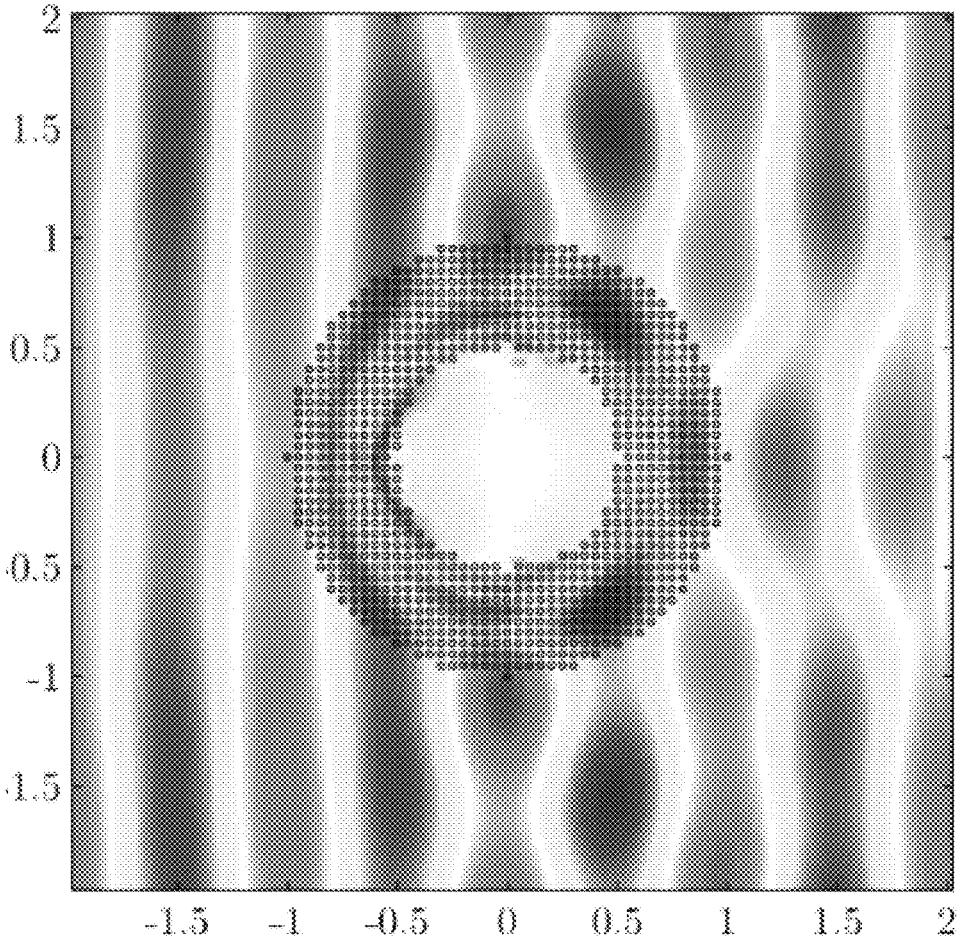
FIG. 38 shows a cloak designed with CMMs and C=I⅓. Clear phase errors appear in the forward direction.

Previously, it was noted that the DDA and retrieval process had to be modified to account for coupling between CMMs both inside and outside the parallel-plate waveguide. This modification took the form of additional terms the interaction constants. Additionally, it was previously noted that the imaginary part of the polarizability di_ered from the conventional case. Both of these differences can be considered when designing a TO device. It can be observed that the effect of this complication can be used to design a cloak using the conventional Clausius-Mosotti relationship. A DDA simulation of such a Cloak is shown plotted in FIG. 38, which shows a cloak designed with CMMs and C=I⅓. Clear phase errors appear in the forward direction. This does not appear to be caused by nonlocal interactions between elements: a small lattice parameter a=0.05 has been used, and the overall size of the cloak has been reduced relative to the one described previously herein. Instead, the error is due to use of Clausius-Mossotti with an interaction constant C=I⅓, which does not accurately account for all the interactions between the elements. A modified version is provided herein to design a cloak.

To simplify the analysis, restriction is made to quasi-static interactions between elements in a cubic lattice. For a conventional lattice, the interaction constant has the approximate form [108]:

$$C_{xx}^{(A)} = C_{yy}^{(A)} = C_{zz}^{(A)} \approx \frac{.3365}{a^3} \tag{6.31}$$

This would be the correct interaction constant for the system if only the interactions of dipoles were included in the waveguide. On the other side of the parallel plate, the interaction effects of a infinite 2D lattice is included with its surface normal directed in z. For the x- or y-directed magnetic dipoles, this interaction constant takes the form:

$$C_{xx}^{(B)} = C_{yy}^{(B)} \approx \frac{.3589}{a^3}. \tag{6.32}$$

Therefore, the total interaction constant is, (e.g. for $C_{yy}$):

$$C_{yy} = C_{yy}^{(A)} + C_{yy}^{(B)} \approx \frac{0.6954}{a^3}. \tag{6.33}$$

It can be seen that the contributions from (B) have increased the interaction constant: the additional dipole fields add constructively to the local field exciting the element. On the other hand, for the z-directed electric dipoles, $$C_{zz}^{(B)} \approx -\frac{0.7179}{a^3}. \tag{6.34}$$

This reflects the depolarizing effects of a plane of dipoles oriented in the same direction as the surface normal of that plane.

The modified interaction constants can be entered in the Clausius-Mossotti equation to determine the necessary polarizabilities. The DDA simulation results can be plotted in (a) of FIG. 39 for the same lattice parameter a=0.025.

Figure 39:
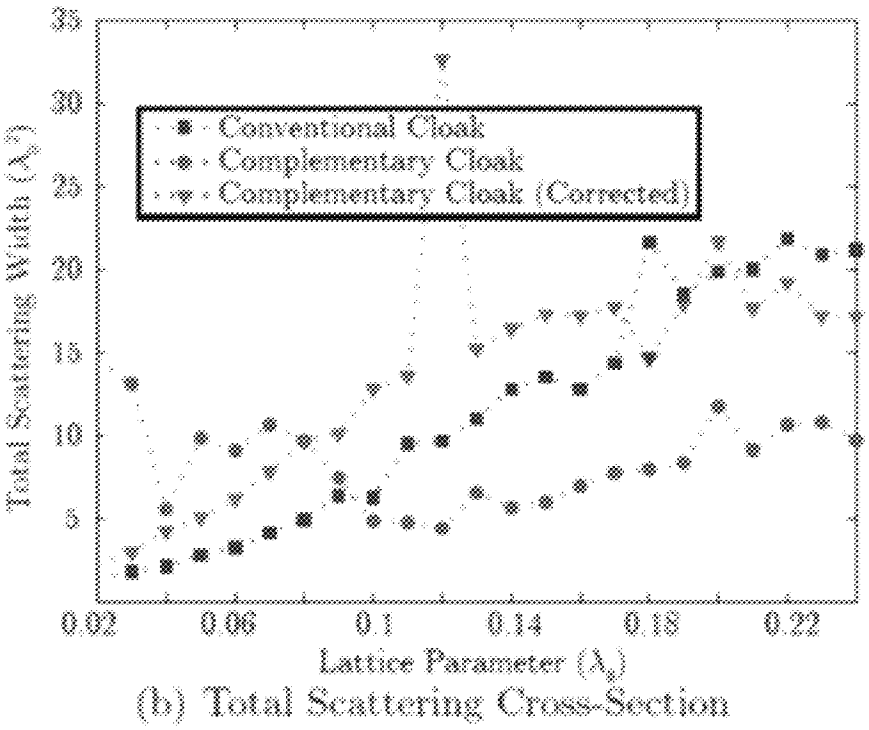
FIG. 39 shows a comparison of CMM cloaks.
Figure 39:
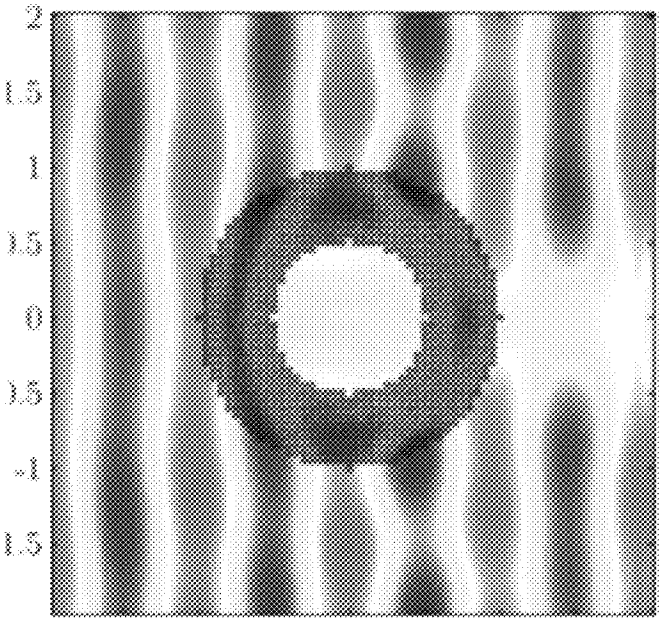

FIG. 39 shows a comparison of CMM cloaks. The results are not particularly encouraging. The phase error may have been slightly reduced, but now there is a strong forward shadow due to an apparent attenuation of the transmitted fields. This result can be explained qualitatively. The improved interaction constant disclosed herein provides a better impedance-match to free space, and back-scattering is somewhat reduced. However, the CMMs scatter into free-space modes on side (B) that manifest as an effective loss term in the guided waves. This is reflected in the modified Sipe-Kranendonk condition: the imaginary part of the 3D interaction constant no longer balances the imaginary constant as it would in a conventional array [109], and the guided wave amplitude is attenuated. This may not be surprising since $q<k_0$ in the device, and an odd leaky-wave antenna has been created [122].

Despite this complication, the total SCS does decrease as the lattice parameter is decreased, as shown in (b) of FIG. 39, though the convergence towards zero SCS is a bit slower than for the conventional case, (also shown). Nevertheless, it is a clear improvement over an initial design. It may be concluded that a complementary cloak is feasible theoretically, though the required unit cell size might not be compatible with current lithographic techniques. However, it may be possible to mitigate the radiative loss by other means [123], though this may require more modifications to the DDA method.

Herein complementary metamaterials have been examined. At the element level, they have been related to conventional metamaterial circuit elements by developing a circuit model based on fictitious magnetic currents. It has been shown that the peculiarities of CMMs may require the modification of the DDA retrieval and simulation methods. It has also been shown that TO design is possible with CMMs.

Evaluation of Dynamic Interactions Constants in a Magneto-Dielectric Lattice Evaluation of 2D Interaction Constants An infinite 2D of identical elements with an assigned magnetic polarizability $\alpha_m$ and electric polarizability $\alpha_e$ immersed in a dielectric $\in$ is considered. An incident electromagnetic wave $E_0 z \exp(-jkx)$ can excite magnetic dipoles $m_y$ and electric dipoles $p_z$. From the symmetry of the problem, the magnetic and electric responses are decoupled and they may be treated separately. The magnetic response will first be considered.

The local field exciting an element located at the origin of the coordinate system may be written:

$$H_y^{loc}(0) = \mu_0^{-1} C_{yy} = \mu_0^{-1}\left(k^2 + \frac{\partial^2}{\partial y^2}\right) G(r_{mn})\Big|_{y=0}, \tag{A. 1}$$

where G is the scalar Green's function:

$$G = \frac{1}{4\pi}\frac{e^{-jkr}}{r} = 107. \tag{A. 2}$$

Equation A.1 is a doubly infinite sum consisting of the contribution from all the dipoles excluding the one under consideration. The sum is broken into two parts $C_{yy}^{(2D)} = C_{yy}^{(1)} + C_{yy}^{(2)}$ and similarly for $G_y$. $G_y^{(1)}$ consists of the contribution from the elements in the column (z=0), and $G_y^{(2)}$ consists of the contributions from all of the other columns. The explicit expression for $C_{yy}^{(1)}$ is $$C_{yy}^{(1)} = \sum_{m=1}^{\infty} \frac{e^{-jkma_y}}{4\pi}\left(\frac{jk}{a_y^2 m^2} + \frac{1}{a_y^3 m^3}\right). \tag{A. 3}$$

These geometric series have known analytical solutions [108]. The calculation for $C_{yy}^{(2)}$ is substantially more involved. An initial expression for $G_y^{(2)}$ is:

$$G_y^{(2)} = \frac{1}{4\pi}\sum_{n=-\infty}^{\infty\prime}\sum_{m=-\infty}^{\infty} \frac{\exp\{-jk_0[n^2a_2^2 + (y-ma_y)^2]^{1/2}\}}{[n^2a_z^2 + (y-ma_y)^2]^{1/2}}, \tag{A. 4}$$

where (') indicates that the dipole at the origin are being omitted. Using the Poisson summation technique, the contributions are calculated from all remote columns:

$$G_y^{(2)} = \frac{1}{2\pi a_y}\sum_{n=-\infty}^{\infty\prime}\sum_{m=-\infty}^{\infty} e^{j2\pi my/a_y} K_0(c_m|na_z|) \tag{A. 5}$$

where $$c_m = \left[\left(\frac{2m\Pi}{a_y)^2} - k_0^2\right]\right.$$

When m=0 the summation over n may have poor convergence since the MacDonald Function with imaginary arguments decays asypmtotically as $\rho^{-1/2}$. It may therefore be separated from the others:

$$G_y^{(2)} = \frac{1}{2\pi a_y}\sum_{n=-\infty}^{\infty\prime} K_0(jk_0na_z) + \frac{2}{\pi a_y}\sum_{m=1}^{\infty}\sum_{n=1} e^{j2\pi my/a_y} K_0(c_m na_z). \tag{A. 6}$$

The convergence of the first term in Eq. A.6 may be improved by using the method of dominant series. This may be accomplished by allowing x to vary and then taking the limit as $x \to 0$. The Poisson Summation technique is used to reach the following equation:

$$\frac{1}{2\pi a_y}\sum_{n=-\infty}^{\infty\prime} K_0[jk_0(x^2 + n^2a_z^2)] = \frac{1}{2a_y a_z}\sum_{n}^{\infty}\frac{e^{-c_n x}}{c_n} - \frac{1}{2\pi a_y}K_0(jk_0x), \tag{A. 7}$$

where $c_n = [(2n\pi/a_z)^2 - k_0^2]$. It is noted that for large $n/a_z$, $cn \approx 2n\pi/a_z$. Therefore motivation is provided to break up the first term in Eq. A.7 to reflect this fact:

$$\frac{1}{2a_y a_z}\sum_{n}\frac{e^{-c_n x}}{c_n} = \tag{A. 8}$$

-continued $$\frac{e^{jk_0x}}{j2k_0a_ya_z}+\sum_{n=1}\frac{e^{-2\pi nx/a_z}}{2\pi na_y}+\sum_{n=1}^{\infty}\left[\frac{e^{-c_nx}}{a_ya_zc_n}-\frac{e^{-2\pi nx/a_z}}{2\pi ma_y}\right].$$

The second summation can converge rapidly as it represents the difference between the true series and its approximate representation. The approximate series is geometric and may be summed explicitly:

$$\sum_{n=1}^{\infty}\frac{e^{-2\pi nx/a_z}}{2\pi ma_y}=-\frac{\log(1-e^{-2\pi x/a_z})}{2\pi\mu_0a_y}. \tag{A. 9}$$

It may be shown that the logarithmic singularity in Eq. A.9 may cancel the singularity in the MacDonald function in Eq. A.7 in the limit x→0. The final expression for $G_y^{(1)}$ is therefore:

$$G_y^{(2)}=\frac{e^{\pi^2/(12ln2)}+\log(jk_0a_z/4\pi)}{4\pi a_y}-\frac{j}{4k_0a_ya_z}+\sum_{n=1}^{\infty}\left[\frac{1}{2a_ya_zc_n}-\frac{1}{4\pi na_y}\right] \tag{A. 10}$$

Inserting Eq. A.10 into Eq. A2, it may be found that that $$C_{yy}^{(2)}=\frac{k_0^2}{2a_y}\left[\frac{e^{\pi^2/(12ln2)}+\log(jk_0a_z/4\pi)}{2\pi}-\frac{j}{2k_0a_z}+\sum_{n=1}^{\infty}\left(\frac{1}{a_zc_n}-\frac{1}{2\pi n}\right)\right]+\frac{1}{\pi a_y}\sum_{m=1}^{\infty}\sum_{n=1}^{\infty}\left[k_0^2-\left(\frac{2\pi m}{a_y}\right)^2\right]K_0(c_mna_z). \tag{A. 11}$$

It is noted that the remaining series in Eq. A.10 may be neglected for moderate or large dipole spacings.

The calculations for the other component of the interaction tensor $C_{zz}$ may have an identical form upon the substitution (ay, az)→(az, ay).

A modified version of the DDA is developed herein that uses the analytical form of the mutual inductance between coaxial loops. This modification is incorporated into the interaction constant by adding the analytic term (Eq. 5.29) as a correction series to Eq. A.3:

$$\tilde{C}_{yy}^{(2)}=\sum_{m=1}^{\infty}\frac{e^{-jk_0ma_y}}{\pi}\left(\frac{jk_0}{a_y^2m^2}+\frac{1}{a_y^3m^3}\right)+\sum_{m=1}^{\infty}e^{-jk_0ma_y}\left[\frac{2M^{QS}(ma_y)}{S^2}-\frac{1}{\pi a_y^3m^3}\right] \tag{A. 12}$$

which should converge rapidly due to the asymptotic behavior of $M^{QS}$ discussed in the main text.

Evaluation of 3D Interaction Constants

The interaction constants has been calculated for dipoles in a 2D array centered at the origin. The potential function corresponding to a complete sheet of magnetic dipoles has been developed, (Eq. A.5 with a complete sum at nonzero x):

$$G_y^{(3)}=\frac{1}{2\pi a_y}\sum_{n=-\infty}^{\infty}\sum_{m=-\infty}^{\infty}\sum_{l=-\infty}^{\infty\prime}e^{-jqla_x}e^{j2\pi my/a_y}K_0\left[c_m\sqrt{(x-la_x)^2+n^2a_z^2}\right], \tag{A. 13}$$

where q is the unknown wavenumber of the Bloch-Floquet mode propagating in the lattice. Once again, the propagating MacDonald Functions is separated:

$$\sum_{n=-\infty}^{\infty}\sum_{l=-\infty}^{\infty\prime}K_0\left[jk\sqrt{(x-la_x)^2+n^2a_z^2}\right]=\frac{\pi}{a_z}\sum_{n=-\infty}^{\infty}\sum_{l=-\infty}^{\infty\prime}\frac{e^{-c_n|x-la_x|}}{c_n}=\frac{\pi}{a_z}\sum_{n=-\infty}^{\infty\prime}\sum_{l=-\infty}^{\infty\prime}\frac{e^{-c_n|x-la_x|}}{c_n}+\frac{\pi}{a_z}\sum_{l=-\infty}^{\infty\prime}\frac{e^{-jk|x-la_x|}}{jk}, \tag{A. 14}$$

where $$c_n=\sqrt{\left(\frac{2\pi l}{a_z}\right)-k^2}.$$

The H-field is calculated as:

$$\mu_0C_{yy}^{(3)}=\left(k^2+\frac{\partial^2}{\partial y^2}\right)G_y^{(3)}=\frac{1}{2\pi a_y}\sum_{n=-\infty}^{\infty}\sum_{m=-\infty}^{\infty\prime}\sum_{l=-\infty}^{\infty\prime}\left[k^2-\left(\frac{2\pi m}{a_y}\right)^2\right]K_0(c_m\Gamma_{ln})e^{-jqla_x}+\frac{k^2}{2a_ya_z}\sum_{n=-\infty}^{\infty\prime}\sum_{l=-\infty}^{\infty\prime}\frac{e^{-c_n|l|a_x-jqla_x}}{c_n}-\frac{jk}{2a_ya_z}\sum_{l=-\infty}^{\infty\prime}e^{-jk|l|a_x-jqla_x} \tag{A. 15}$$

where $\Gamma_{ln}=\sqrt{l^2a_x^2+n^2a_z^2}$. The last term on the RHS is summed explicitily:

$$\frac{jk}{2a_ya_z}\sum_{l=-\infty}^{\infty\prime}=\frac{k}{2a_ya_z}\frac{\sin ka_x}{\cos ka_x-\cos qa_x} \tag{A. 16}$$

to obtain the result given in the main text.

In a similar fashion, the local E-field was calculated at the origin:

$$C_{zy}^{em}=-j\omega\frac{\partial G_y}{\partial x}=-\frac{j\omega a_x}{2\pi a_y}\sum_{n=-\infty}^{\infty}\sum_{m=-\infty}^{\infty\prime}\sum_{l=-\infty}^{\infty\prime}e^{-jqla_x}\frac{c_mlK_1(c_m\Gamma_{ln})}{\Gamma_{ln}}-\frac{j\omega}{2a_ya_z}\sum_{n=-\infty}^{\infty\prime}\sum_{l=-\infty}^{\infty\prime}\mathrm{sgn}(l)e^{-c_n\Gamma_{ln}}e^{-jqla_x}+\frac{\omega}{2a_ya_z}\frac{\sin qa_x}{\cos ka_x-\cos qa_x}. \tag{A. 17}$$

Once again, $C_{zz}^{(3)}$ an identical form as Eq. A.17 upon the substitution (ay, az)→(az, ay). It is noted that in the limit $qa_x \to 0$, the first two terms in equation A.17 become anti-symmetric and vanish identically. However, the plane wave terms persist as discussed herein.

Interaction Constants for a CMM-Loaded Waveguide

As discussed herein, the interaction constant of CMMs is given by that of a conventional MM array with the addition of the contribution from dipoles on the other side of the PEC surface. This side is labeled (B) for consistency with the previous description herein. The potential function from the unit dipoles on side (B) is therefore:

$$G_y^{(3)} = \frac{1}{2\pi a_y}\sum_{m=-\infty}^{\infty}\sum_{l=-\infty}^{\infty\prime} e^{-jqla_x} e^{j2\pi my/a_y} K_0(c_m|l|a_x), \tag{A. 18}$$

where $c_m[(2m\pi/a_y)^2-k_0^2]$. Once more, the propagating terms are separated:

$$\sum_{l=-\infty}^{\infty} e^{-jqla_x} K_0\left[jk_0(z^2+l^2a_x^2)^{1/2}\right] - K_0(jk_0|z|) \tag{A. 19}$$

$$\sum_{l=-\infty}^{\infty} e^{-jqla_x} K_0\left[jk_0(z^2+l^2a_x^2)^{1/2}\right] = \frac{\pi}{a_x}\sum_{l=-\infty}^{\infty}\frac{e^{-\alpha_l|z|}}{\alpha_l}, \tag{A. 20}$$

where $$\alpha_l = \sqrt{\left(\frac{2\pi l}{a_x}+q\right)^2 - k_0^2},$$

and the branch of the square root is chosen according to Re[√]>0.

Assuming kd<<1 and qd<<1, $$\frac{\pi}{a_x}\sum_{l=-\infty}^{\infty}\frac{e^{-\alpha_l|z|}}{\alpha_l} \approx -j\frac{\pi}{a_x}\frac{1}{\sqrt{k_0^2-q^2}} + \sum_{l=1}^{\infty}\frac{e^{-2\pi l/ax|z|}}{l}. \tag{A. 21}$$

The final term on the RHS can be summed as before:

$$\sum_{l=1}^{\infty}\frac{e^{-2\pi l/ax|z|}}{l} = -\log\left(1-e^{-\frac{2\pi|z|}{a_x}}\right). \tag{A. 22}$$

This term cancels the logarithmic singularity in Eq. A.19 in the limit z→0. The approximation in Eq. A.20 can be used as a dominant series so that the final expression for the potential is:

$$G_y^{(3,B)} = \frac{1}{2\pi a_y}\sum_{m=-\infty}^{\infty\prime}\sum_{l=-\infty}^{\infty\prime} e^{-jqla_x} e^{j2\pi my/a_y} K_0(c_m|l|a_x) - \frac{1}{2\pi a_y}\left[j\frac{\pi}{a_x}\frac{1}{\sqrt{k_0^2-q^2}} + e^{\pi^2/(12ln2)} + \log\frac{2\pi k}{a_x} + j\frac{\pi}{2}\right] + \frac{1}{2\pi a_y}\sum_{l=1}^{\infty}\left(\frac{2\pi}{\alpha_l a_x} - \frac{1}{l}\right) \tag{A. 23}$$

$$C_{yy}^{(3,B)} = \frac{1}{2\pi a_y}\sum_{m=-\infty}^{\infty\prime}\sum_{l=-\infty}^{\infty\prime}\left[k_0^2 - \left(\frac{2\pi m}{a_y}\right)^2\right] e^{-jqla_x} e^{j2\pi my/a_y} K_0(c_m|l|a_x) - \frac{k_0^2}{2\pi a_y}\left[j\frac{\pi}{a_x}\frac{1}{\sqrt{k_0^2-q^2}} + e^{\pi^2/(12ln2)} + \log\frac{2\pi k}{a_x} + j\frac{\pi}{2}\right] + \frac{k_0^2}{2\pi a_y}\sum_{l=1}^{\infty}\left(\frac{2\pi}{\alpha_1 a_x} - \frac{1}{l}\right). \tag{A. 24}$$

Power Expanded by a Plane Wave on an Induced Current Source

Our derivation for the modified Sipe-Kranendonk condition is based on the fact that the power spent by a wave exciting an element is described by:

$$P^{ext} = \frac{1}{2}J_m^* \cdot H_0, \tag{B. 1}$$

which is equal to the power radiated by the dipole acting as a source. An electromagnetic wave $E_0$ is considered as impinging on a magnetic element. The total fields are considered to be given by:

$$E=E_0+E_S, \tag{B.2}$$

and similarly for H. The incident fields satisfy Maxwell's equations in the absence of the source, and the scattered fields satisfy Maxwell's equations in the absence of the incident fields with the induced dipole acting as a source M. The integral form of Poynting's theorem may then be written as:

$$\frac{1}{2}\oint[E_0\times H_0^*]\cdot dS + \frac{1}{2}\oint[E_S\times H_S^*]\cdot dS + \frac{1}{2}\oint[E_0\times H_S^* + E_S\times H_0^*]\cdot dS = -\frac{1}{2}\int(H^*\cdot J_m)dV. \tag{B. 3}$$

The first term on the LHS of is identically zero since no power is generated in the absence of the dipole. The second term is the power radiated by the source M. The term on the RHS is the power absorbed. The remaining term on the LHS bears more investigation. First this term is written in differential form using Gauss's Theorem:

$$\frac{1}{2}\oint[E_0\times H_S^* + E_S\times H_0^*]\cdot dS = \frac{1}{2}\nabla\cdot[E_0\times H_S^* + E_S\times H_0^*]\cdot dV. \tag{B. 4}$$

Using the vector identity $\in_{ijk}\partial_i A_j B_k = \in_{ijk} A_i \partial_j B_k - \in_{ijk} B_i \partial_j A_k$ and Maxwell's Equations, the integrand is found to reduce to:

$$\nabla\cdot[E_0\times H^*_S + E_S\times H^*_0] = -H_0\cdot J^*_m. \quad \text{(B.5)}$$

From conservation of power, this must be equal to the negative of the power expended by the incident field, $P^{ext}$ and Eq. B.1 may be used with confidence.

Network Parameters and the Discrete Dipole Approximation

Previously, a DDA model was generated based on the assumption that the incident fields were specified. Additional steps may be taken to integrate the DDA into a fully-realized network model. This model may self-consistently account for all possible excitation modes for a DDA array, as well as the effect of the array on other subsystems.

A model is developed for the case of MMs in a parallel plate waveguide. Further, a semi-analytical is derived for a common excitation source; a coaxial probe. Further, it is shown that a small probe can be integrated self-consistently into DDA simulations to compute network parameters in a single step.

Antenna Reciprocity in a Parallel Plate Waveguide

Figure 40:
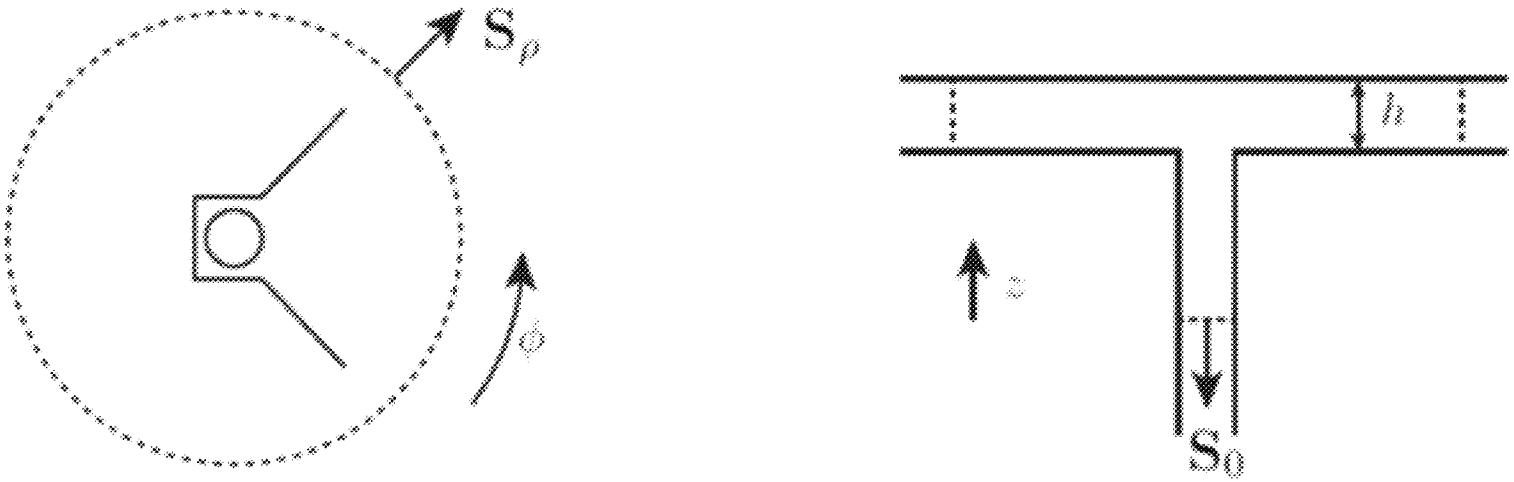
FIG. 40 illustrates a geometry for the derivation of $T_n$ and $R_n$.

In this section, a derivation from [124] is reproduced for the transmit and receive property of an antenna in a parallel plate waveguide in terms of the cylindrical harmonics of the fundamental $TM^z$ mode of the guide. The antenna geometry is given by FIG. 40, which illustrates a geometry for the derivation of $T_n$ and $R_n$. An arbitrary antenna is placed at the origin of the coordinate system.

The contribution from the fields in the waveguide is considered. It is assumed only a single mode propagates in the waveguide so that the contribution from higher-order modes is negligible at the surface $S_0$. Equivalent voltages and currents can be defined such that the tangential fields are given by:

$$E_t = Ve_t$$

$$H_t = Ih_t, \quad \text{(C. 1)}$$

subject to the normalization condition $\S e_t \times h^*_t dS = 1$.

For the first set fields, the antenna is considered to be operating in the transmit mode. In general, there can exist a forward travelling wave from the source and a reflected wave from the impedance mismatch between the waveguide and the antenna. The forward travelling voltage amplitude is defined as $a_0$ and reflected amplitude as $b_0$. Defining the terminal plane at $S_0$, the following results:

$$V^{(1)} = a_0 + b_0$$

$$I^{(1)} = Y_c(a_0 + b_0), \quad \text{(C.2)}$$

where $Y_c$ is the characteristic impedance of the waveguide mode. For the second set of fields (2), it is assumed that the antenna is receiving and so only backwards travelling waves of amplitude $b'_0$ exist in the guide. Therefore on $S_0$ the following results:

$$V^{(2)} = b'_0$$

$$I^{(2)} = -b'_0. \quad \text{(C.3)}$$

Since there are no sources within the surfaces $S_\rho$ and $S_0$, the Lorentz Reciprocity theorem reduces to:

$$\oint (E^{(1)}\times H^{(2)} - E^{(2)}\times H^{(1)})\cdot dA = 0. \quad \text{(C.4)}$$

The total contribution to Eq.C.4 from $S_0$ is then:

$$\int_{S_0} (E^{(1)}\times H^{(2)} - E^{(2)}\times H^{(1)}) = -2Y_c a_0 b'_0. \quad \text{(C. 5)}$$

Now attention is drawn to the cylindrical surface in the parallel plate, $S_\rho$. On this surface, the fields may be decomposed in the cylindrical harmonics so that:

$$E_z^{(1)} = \sum_{n=-\infty}^{\infty} H_n^{(2)}(k\rho)e^{jn\phi} \quad \text{(C. 6)}$$

$$E_z^{(2)} = \sum_{m=-\infty}^{\infty} [a_m J_m(k\rho) + b'_m H_m^{(2)}(k\rho)]e^{jm\phi}$$

where the height h of the parallel-plate is such that only the $TM^z$ modes propagate. The φ-component of H is given by $H_\phi = -j(\omega\mu_0)^{-1}\partial_\rho E_z$. Inserting these expressions for the fields into Eq. C.4 and using the orthogonality of complex exponentials, the contribution from $S_\rho$ may be written as:

$$2\pi\rho(E_z^{(1)}H_\phi^{(2)} - E_z^{(2)}H_\phi^{(1)}) = -j\rho(-1)^n a_{-n}b_n(jY'_n J_n - J'_n Y_n) \quad \text{(c.7)}$$

where the identities $J_{-n}(x)$ and $H_n^{(2)}(x) = J_n(x) - jY_n(x)$ have been used. Using the Wronskian for Bessel functions:

$$J_p Y'_p - J'_p Y_p = \frac{2}{\pi x}, \quad \text{(C. 8)}$$

and the C.7 reduces to $$\frac{4}{k\eta}(-1)^n a_{-n} b_n. \quad \text{(C. 9)}$$

Defining $b_n = T_n a_0$ as the transmitting vector and $b'_0 = R_n a_n$ as the receiving vector, $$R_n = 2\frac{Z_c}{k\eta h}(-1)^n T_{-n}, \quad \text{(C. 10)}$$

where $Z_c$ is the characteristic impedance of the waveguide.

Network Parameters for the DDA

Initially, an arbitrary junction can be considered between a waveguide of arbitrary cross-section and the top or bottom of a parallel plate waveguide of height h. This waveguide can be considered to be connected to a source so that the junction can be considered an antenna radiating in the parallel plate environment. Both h and the waveguide dimensions are determined so that a single mode propagates in each. A cylindrical surface can be drawn around the antenna. The radius of this surface is sufficiently great that the fields on the surface are solely those of the fundamental $TM^z$ modes of the parallel plate. On this surface, the electric field can be written in terms of the cylindrical harmonics:

$$E_z = \sum_{n=-\infty}^{\infty} [a_n J_n(k\rho) + b_n H_n^{(2)}(k\rho)]e^{jn\phi} \quad \text{(C. 11)}$$

where $b_n$ represent sources inside or on the surface of the probe antenna and $a_n$ represent the fields scattered from the MM array. In practice, only a finite number of modes N may be considered. It some cases only enough terms are needed in the summation to account for the cylindrical modes at the evaluation boundary:

$$N = Ceil(k\rho_0) + 6 \quad \text{(C. 12)}$$

There must be a linear relationship between the vectors a and b:

$$a = S^{(DDA)} b, \quad \text{(C. 13)}$$

where $S^{(DDA)}$ is a scattering matrix that relates the vectors exciting the MM array and the fields scattered by the array. The DDA is used to calculate the dipole moments that are created for an excitation $b_n$. Thus dipole moments can be translated into the coefficients $a_n$ directly, as shown in the following.

Consider an isolated element that can be described by a polarizability-per-unit-length, such as a metallic via in the parallel plate. Using the addition theorem for Bessel functions, an element located at ρ' and φ' may be expressed as:

$$E_{mn}^s = -j(\alpha_e / l) E_n^i|_{\rho',\phi'} \frac{k^2}{4\epsilon} \sum_m M(k\rho) H_m^{(2)}(k\rho') e^{jm(\phi-\phi')}. \quad \text{(C. 14)}$$

where $E_n^i|_{\rho',\phi'} = H_n^{(2)}(k\rho')e^{jn\phi'}$. The matrix elements $S_{mn}^{DDA}$ are therefore:

$$S_{mn}^{(DDA)} = -j(\alpha_e / l) \frac{k^2}{4\epsilon} H_m^{(2)}(k\rho') H_n^{(2)}(k\rho') e^{j(n-m)\phi'} \quad \text{(C. 15)}$$

In the case of multiple dipoles, the polarizability and incident fields directly is no longer used, but instead the dipole moments are calculated using the DDA method. Each DDA simulation for an excitation mode $H_n^{(2)}(k\rho)$ returns a list of dipole moments l=(1, 2, . . . L). The matrix elements are therefore:

$$S_{mn}^{(DDA)} = -j \frac{k^2}{4a_z\epsilon} \sum_l p_l^{(n)} H_m^{(2)}(kp_l) e^{-jm\phi_l}, \quad \text{(C. 16)}$$

The contributions from magnetic dipoles may be included in a similar manner. The field radiated by a per-unit-length dipole m at the origin is given by:

$$E_z = \frac{k}{2a_z} [(jm_x - m_y) H_1^{(2)} e^{j\phi} + (jm_x + m_y) H_{-1}^{(2)} e^{-j\phi}] \quad \text{(C. 17)}$$

Using the addition theorem again, it is found that the total scattering matrix is given by:

$$S_{mn}^{(DDA)} = \frac{k}{2a_z} \sum_i \left\{ \frac{-jk}{2\epsilon} p_i^{(n)} H_m^{(2)}(kp_i) e^{-jm\phi_i} + [(jm_x - \right. \quad \text{(C. 18)}$$

-continued $$m_y) H_{m+1}(kp_i)^2 e^{j(m+1)\phi} + (jm_x^{(n)} + m_y^{(n)}) H_{m-1}(kp_i)^2 e^{-j(m-1)\phi}] \Big\}$$

Now these scattered fields may be related to the signal in the waveguide that excites the antenna. Un the waveguide, the fields can consist of an excitation wave of amplitude $a_0$ traveling towards the antenna and an oppositely-directed wave of amplitude $b_0$ that contains contributions from the parallel plate modes exciting the antenna and any impedance mismatches between the waveguide and antenna. The waves propagating away from the antenna in the parallel plate will consist of both the waves transmitted by the antenna and waves scattered by the antenna from the MM array:

$$b_n = T_n a_0 + \sum_m S_{nm} a_m, \quad \text{(C. 19)}$$

where $S^{(A)}$ is now the scattering matrix for the antenna itself, and T is the transmitting row vector. Similarly, the receive vector R is a column vector that maps the antenna excitation modes in the parallel plate to the waveguide mode $b_0$:

$$b_0 = \Gamma_0 a_0 + R_n a_n, \quad \text{(C. 20)}$$

where $\Gamma_0$ is the input reflection for the junction in the absence of the array. In general, the quantities T and $S^{(A)}$ may be determined through numerical simulation of the antenna. The transmission vector T is simply the coefficients of the outgoing Hankel functions in the absence of the array with unit incident waveguide amplitude. These coefficients are found using the orthogonality of exponentials:

$$T_n = \frac{1}{2\pi H_n^{(2)}(k\rho')} \int_0^{2\pi} E(\rho', \phi) e^{-jn\phi} d\phi. \quad \text{(C. 21)}$$

Similarly $S^{(A)}$, may be calculated from:

$$S_{mn}^{(A)} = \frac{1}{2\pi H_m^{(2)}(k\rho')} \int_0^{2\pi} E_n(\rho', \phi) e^{-jm\phi} d\phi \quad \text{(C. 22)}$$

R can be calculated via reciprocity according to Eq. C10:

$$R_n = (-1)^{-n} \frac{2Z_0}{k\eta_0 h} T_{-n} \quad \text{(C. 23)}$$

Eqs. C.19 and C.20 may be combined into a single matrix equation that describes the junction:

$$\begin{pmatrix} b_0 \\ b \end{pmatrix} = \begin{pmatrix} \Gamma_0 & R \\ T & S^{(A)} \end{pmatrix} \begin{pmatrix} a_0 \\ a \end{pmatrix} \quad \text{(C. 24)}$$

The input reflection coefficient may be calculated as:

$$\Gamma = \Gamma_0 + \frac{Ra}{a_0} \quad \text{(C. 25)}$$

and all the array excitation coefficients:

$$b=(1-S^{(1)}S^{(2)})^{-1}Ta_0, \quad (C.26)$$

which in turn allows the determinion of the dipole moments in the array.

Figure 41:
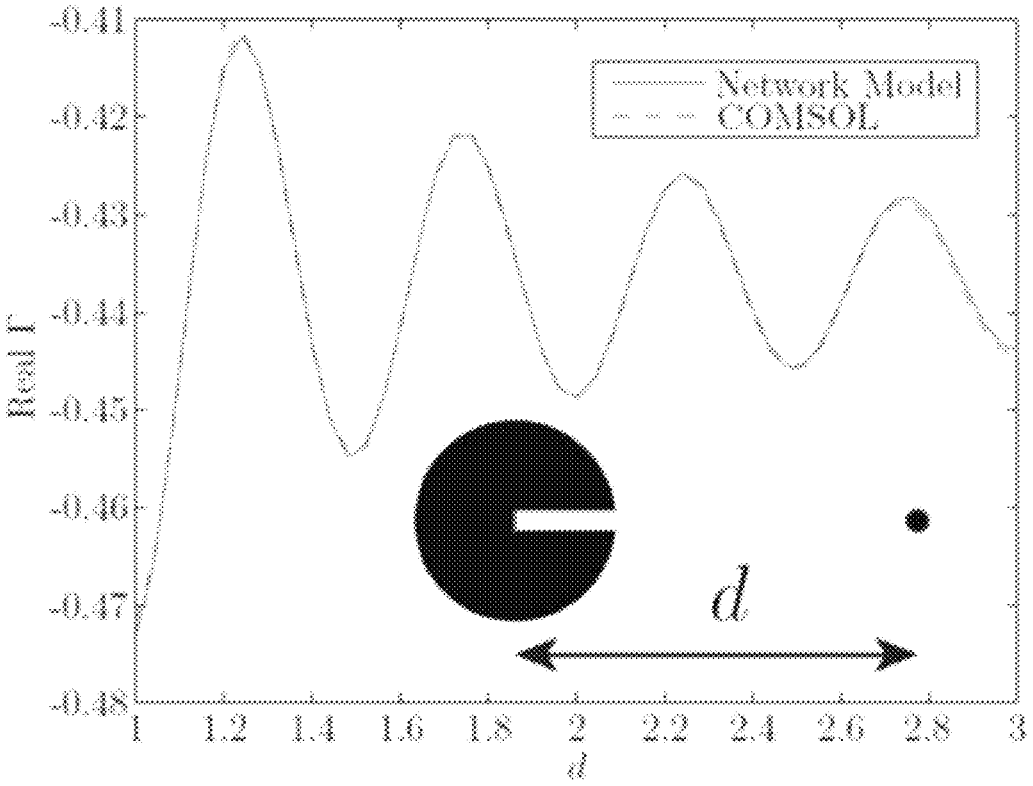
FIG. 41 depicts a comparison of a network model to 2D full-wave simulation.

This formulation may require a DDA calculation to be performed for all N cylindrical harmonics to account for both the fields radiated by the antenna as well as the fields caused by multiple scattering events between the array and antenna. If it is assumed that these back scattered fields are weak, then the fields scattered by the diagram shown in FIG. 41, which depicts a comparison of a network model to 2D full-wave simulation. The inset of FIG. 41 shows the displacement of the scatterer with respect to the antenna. The antenna may be negligible and the scattering matrix $S^{(1)}$ may be neglected in the calculations [125]. The approximation may therefore be:

$$b \approx Ta_0, \quad (C.27)$$

and $$\Gamma \approx \Gamma_0 + RS^{(2)}T. \quad (C.28)$$

This approximate model is tested using a simple 2D simulation in COMSOL, as shown in the inset to FIG. 41. The antenna consists of a PEC cylinder with a portion cutout to provide a well-defined waveguide region. The walls of the waveguide are PMC to that the mode in the waveguide is TEM. The scatter is a single small PEC cylinder. The polarizability per-unit-length is calculated directly from Mie theory:

$$\alpha_e = \frac{2\pi\epsilon a_z}{k^2[\log(0.89ka) + j\pi/2]}, 123 \quad (C.29)$$

Figure 42:
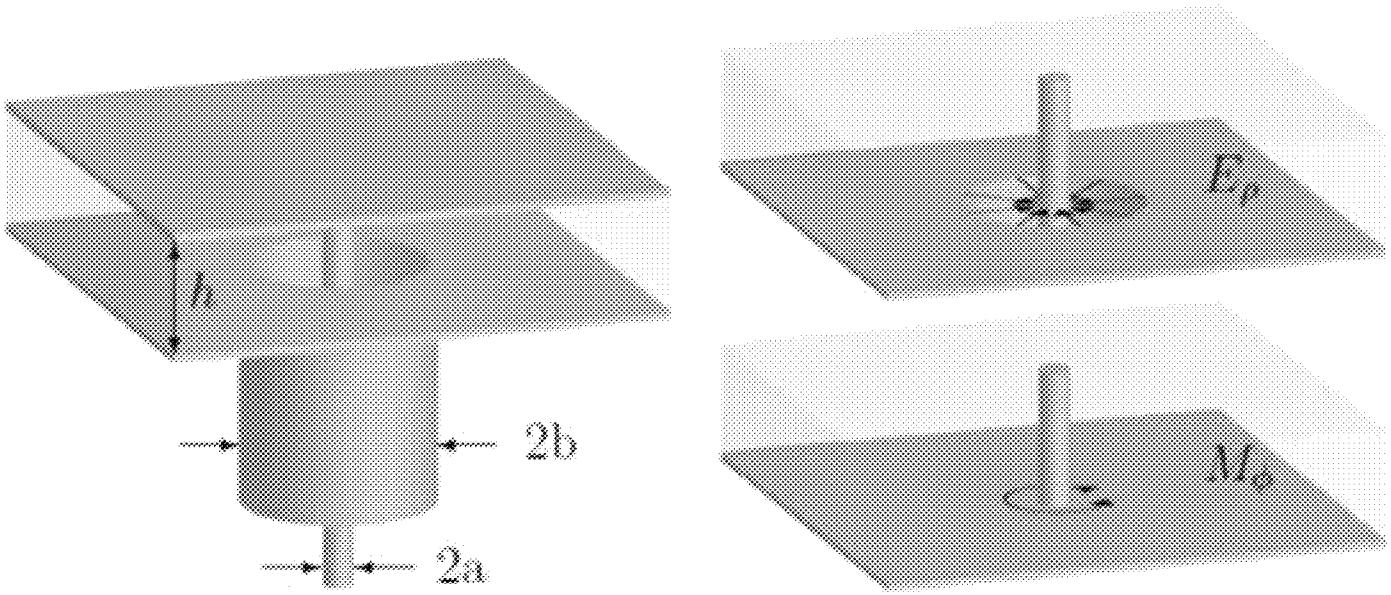
FIG. 42 shows a magnetic frill model for probe radiation scattering, and a presumed aperture field.

The left of FIG. 42 illustrates a diagram of a coaxial probe in a parallel-plate waveguide where a is the cylinder radius. The right of FIG. 42 shows a magnetic frill model for probe radiation and scattering. The top, right of FIG. 42 shows a presumed aperture field. The bottom, right of FIG. 42 shows a magnetic frill current equivalent.

In COMSOL, the antenna is simulated in isolation and use Eq. C.21 and Eq. C.22 to calculate the relevant parameters ($\Gamma_0$ is returned automatically by COMSOL). The antenna was simulated with the small scatterer placed at various separations and compare the presently disclosed model against COMSOL. FIG. 41 shows the variation in the real part of F as a function of this displacement. Both the full model (Eq. C.26 and Eq. C.25 and the approximate model (Eq. C.27 and Eq. C.28) show excellent agreement to the COMSOL model. Residual error may be due to the omission of the magnetic polarizability.

Probe Coupling and Scattering Model

In simulations, at least three parameters of the probe antenna may be known at each frequency: the transmission coefficient, the receive coefficient, and the scattering coefficient. This assumes that only the TEM mode propagates in the probe and that the probe scatters appreciably into the zeroth order cylindrical mode of the parallel plate. For larger probes, it may be necessary to include the response to the m=±1 modes which can be represented by a magnetic polarizability.

These quantities may be determined numerically, but multiple simulations must be performed at every frequency of interest. Any changes made to the electrical characteristics of the probe or the waveguide will require a new set of simulations. Additionally, power conservation enforces strict relationships between the various probe parameters. Any numerical error might cause the DDA simulations to become unstable. Therefore, a semi-analytical model is developed for the probe. While approximate, this model guarantees stability in the simulations and allows changes to be made to the geometry without running additional simulations on the probe itself. The presently disclosed model is based on the theoretical development presented in [126] for the input impedance of a transmitting probe. This derivation is produced, and then extended to include the receiving and scattering parameters.

Consider the probe as shown in FIG. 42. The symmetry of the problem allows the consideration to be restricted to $TM^z$ modes propagating in both the coaxial cable and the parallel plate.

It will also prove beneficial to first consider a related problem. The aperture is replaced with an infinitesimal gap between the closed bottom conductor and the center pin. The impressed field in is given by $E_z(a, z)=-\delta(z)$ since $E_z$ zero on the pin surface. Away from the pin, the fields are given by:

$$E_z(\rho, z) = \sum_{m=0}^{\infty} B_m H_0^{(2)}(k_m\rho)\cos\frac{m\pi z}{h} \quad (C.30)$$

where $$k_m = \sqrt{k^2 - \left(\frac{m\Pi z}{h}\right)^2}.$$

The coefficients $B_m$ may be found with a suitable technique. Eq. C.30 is set equal to $-\delta(z)$ on the pin surface and the orthogonality of cosines yields:

$$B_m = \frac{-2}{h(1+\delta_{m0})H_0^{(2)}(k_m a)}. \quad (C.31)$$

Now attention is turned back to the original problem. It is assumed that the field at the junction between the coaxial cable and the bottom plate can be represented by the fundamental mode of the probe, normalized to produce one volt at the aperture. This constitutes the only approximation in the formulation, but it greatly simplifies the rest of the derivation. Love's equivalence principle allows the closure of the aperture and its replacement with a magnetic surface current:

$$K_\phi^{(m)} = -\frac{1}{\rho\log b/a}. \quad (C.32)$$

The input admittance may be the current flowing in on the inner conductor of the poin for the 1V impressed potential. The current may be found using reciprocity arguments. The first set of solutions for the reciprocity theorem are the impressed magnetic current given by Eq. C.32 and it's fields. A "test" ring of magnetic current $l_m=\delta(\rho-a)\delta(z)$ and its fields as the second set. The reciprocity theorem then reads $$I_z^m = H_\phi^{(1)} = \int_0^{2\pi}\int_a^b H_\phi^{(2)} M_\phi^{(1)} \rho d\rho d\phi, \quad \text{(C. 33)}$$

where $$H_\phi^{(2)}(\rho, 0) = -\frac{j}{\omega\mu_0}\sum_{m=0}^{\infty} B_m k_m H_0^{(2)\prime}(k_m\rho), \quad \text{(C. 34)}$$

since the ring of magnetic current is equivalent to the infinitesimal gap previously discussed. Inserting Eq. C.32, Eq.C.31, and Eq. C.34 into Eq. C.33 yields:

$$Y_{in} = -\frac{j4\pi k}{h\eta \log b/a}\sum_{m=0}^{\infty}\frac{H_0^{(2)}(k_m b) - H_0^{(2)}(k_m a)}{k_m^2(1+\delta_{m0})H_0^{(2)}(k_m a)}. \quad \text{(C. 35)}$$

To determine the the transmission coefficients of the probe, how the frill radiates in the presence of the pin may need to be known. Eqs. C.30 and C.31 cannot be used since these are only valid for a ring of zero thickness.

Instead, reciprocity may be used again. The frill will generate fields that consist of all $TM^z$ modes, but only the fundamental TEM mode will radiate. The magnetic surface current at the aperture is:

$$K_\phi^{(m)(1)} = -\frac{2Z_c}{Z_c + Zi}\frac{1}{\rho \log b/a}, \quad \text{(C. 36)}$$

where the aperture voltage $V=1+\Gamma$ has been calculated from the known impedance $Z_i$. The corresponding fields may be designated as:

$$E_z^{(1)} = T_0 H_0^{(2)}(k\rho) \quad \text{(C. 37)}$$

$$H_\phi^{(1)} = \frac{k}{j\omega\mu} T_0 H_0'^{(2)}(k\rho),$$

where $T_0$ is the to-be-deterimed transmission coefficient. The second set of fields is chosen as those of an incident field $E_z^i = J_0(k\rho)$ and the scattered fields from the metal pin:

$$E_z^{(2)} = J_0(k\rho) - \Gamma_{00} H_0^{(2)}(k\rho) \quad \text{(C. 38)}$$

$$H_\phi^{(2)} = \frac{k}{j\omega\mu}[J_0'(k\rho) - \Gamma_{00} H_0'^{(2)}(k\rho)],$$

where $\Gamma_{00} = J_0(ka)/H_0^{(2)}(ka)$. The Lorentz Reciprocity Theorem in integral form reduces to:

$$\oint (E_z^{(1)} H_\Phi^{(2)} - E_z^{(2)} H_\Phi^{(1)})\rho d\phi dz = \int (H_\Phi^{(2)} M_\Phi^{(1)})\rho d\rho d\phi \quad \text{(C. 39)}$$

Evaluation of the RHS may be trivial. Using the Wronskian of Bessel functions on the LHS, the following is found:

$$T_0 = \frac{Z_i}{Z_i + Z_c}\frac{\pi}{h \log b/a}\frac{J_0(0, kb)Y_0(0, ka) - J_0(0, ka)Y_0(0, kb)}{H_0^{(2)}(0, ka)} \quad \text{(C. 40)}$$

The last quantity of interest is the polarizability of the probe. To find this quantity, it is assumed an incident field $E_z^i = J_0(ka)$. Fields may be scattered due to the presence of the pin and the surrounding aperture. However, these scattered fields are not independent; the scattering from either obstacle must be determined in the presence of the other.

The aperture may be closed and the aperture field may be replaced with an unknown magnetic surface current density. The total scattered fields are now seen to be a superposition of the magnetic current radiating in the presence of the pin and the fields scattered by the pin in the absence of the aperture. This magnetic current may be determined by the aperture fields in the receive mode of the antenna, which have already calculated.

The receiving coefficient from Eq. C.23 is:

$$R_0 = \frac{2Z_C}{k\eta h} T_0 \quad \text{(C. 41)}$$

The received signal is simply $R_0$, so the field at the aperture is simply $$-\frac{R_0}{\rho \log b/a}.$$

Figure 43:
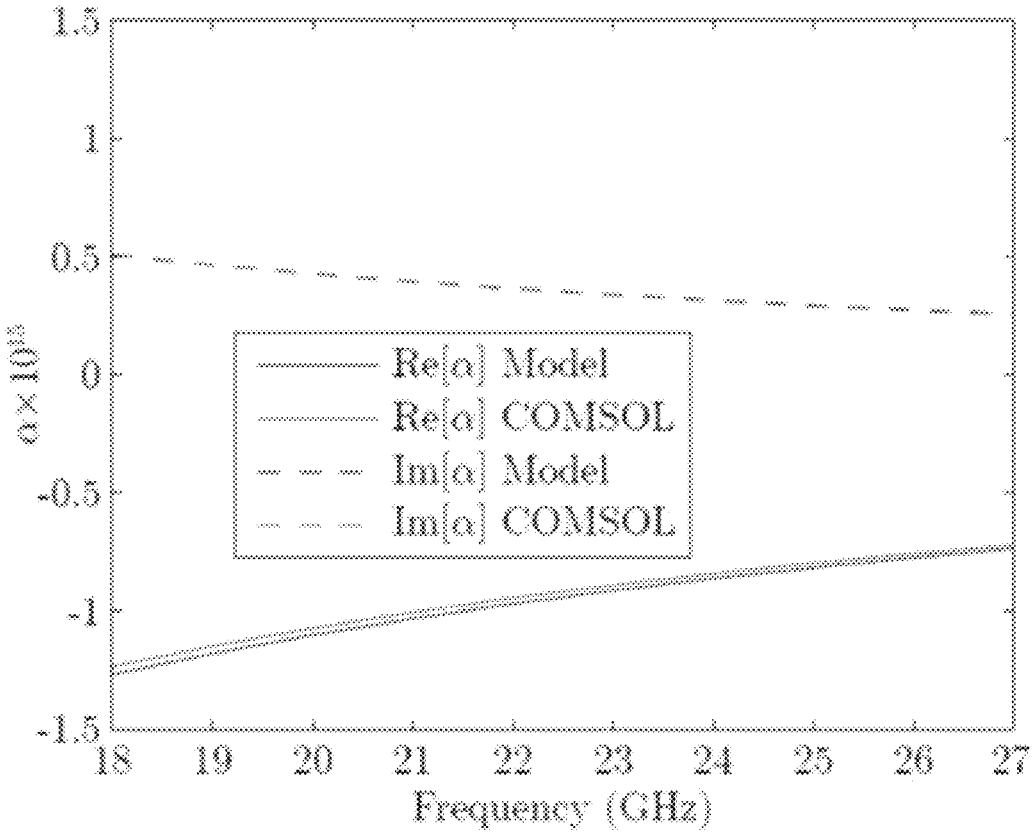
FIG. 43 shows the retrieved polarizability from as standard probe simulated COMSOL and the polarizability calculated from the model.

This field radiates in the same manner as the transmit antenna. Then to this the scattered field is added from the pin to and compared to the field radiated by a p.u.l dipole to determine the polarizability:

$$\alpha = j\frac{4\epsilon Z_c}{k^3\eta h} T_0^2 + \alpha_{00}, \quad \text{(C. 42)}$$

where $\alpha_\infty$ is the polarizability of the isolated pin calculated from Eq. C.29. FIG. 43 shows the retrieved polarizability from as standard probe simulated COMSOL and the polarizability calculated from the model. Agreement is excellent for all the frequencies simulated, and this model may be used in design.

Most coaxial probes are electrically small and therefore well characterized by an electrical polarizability. This may allow their inclusion in the DDA simulations self-consistently without forcing multiple simulations to be run to account for all the different excitation and scattering modes.

Specifically, a simulation may be run using a normalized source centered at the probe. There is clearly a singularity in the field at this position, but the excitation field may be set to be identically zero at this point since the probe does not scatter from its own excitation. Once the simulation has been performed, the signal recieved by the probe is determined by the local field exciting the probe in the parallel plate, i.e.

$$V_s = R_0 \frac{p_z}{\alpha_{zz}^{ee}} \quad \text{(C. 43)}$$

In this manner, the S-parameters may be calculated for a device in accordance with embodiments of the present disclosure.

In accordance with embodiments, methods are disclosed for quantitatively evaluating the effects of complementary metamaterial interaction using a modified version of DDA. In the DDA method, each metamaterial element may be approximated as a point-dipole scatterer. Once the response of each individual element is known, the collective response of N elements may be evaluated via matrix inversion. Modifications to DDA disclosed herein can allow it to accurately predict the response of complementary metamaterials in a guided-wave environment.

Figure 44:
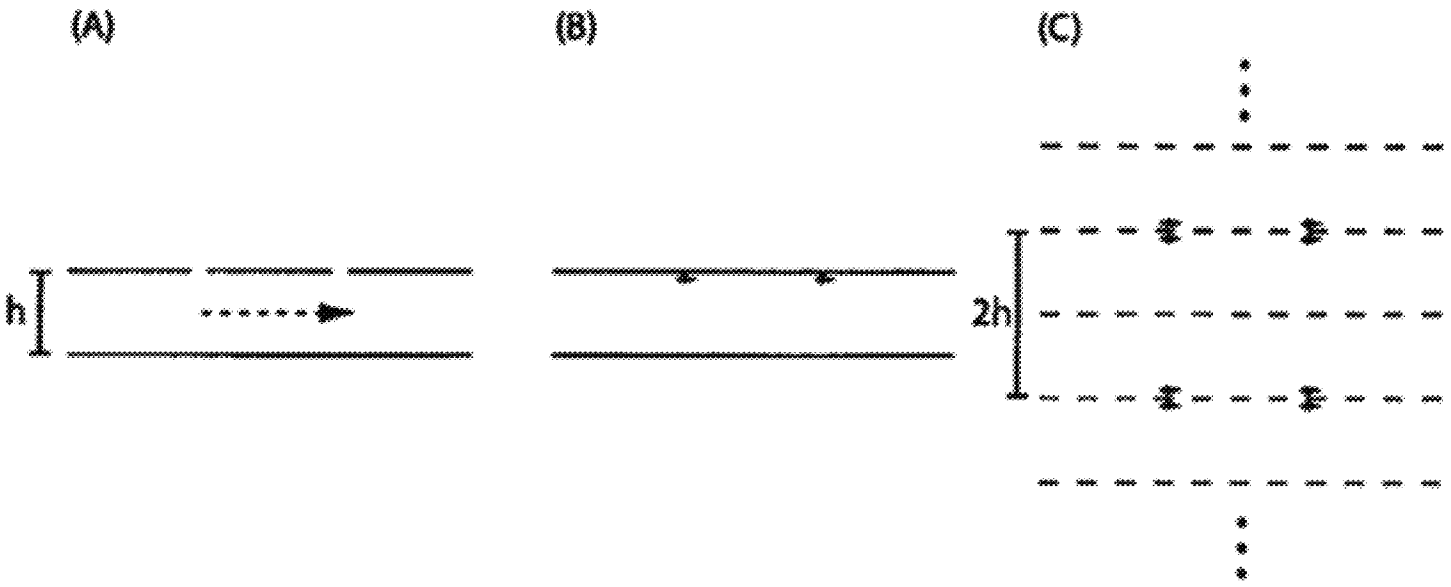
FIG. 44 depicts a diagram showing application of equivalence principle and image theory.

As an example, an illustrate model includes a parallel plate waveguide with infinite capacitive gaps etched in the top PEC wall as shown in FIG. 44, which depicts a diagram showing application of equivalence principle and image theory. Particularly, (A) of FIG. 44 shows the physical configuration including an electromagnetic wave incident on a series of small, shaped apertures. (B) of FIG. 44 shows excited aperture fields as may be represented by equivalent magnetic dipole sources. (C) of FIG. 44 shows that via image theory, the effect of the PEC side-walls is to create an infinite array of identical dipoles in the vertical direction. The per-unit-length polarizability may be given by suitable analytical or numerical models.

Figure 45:
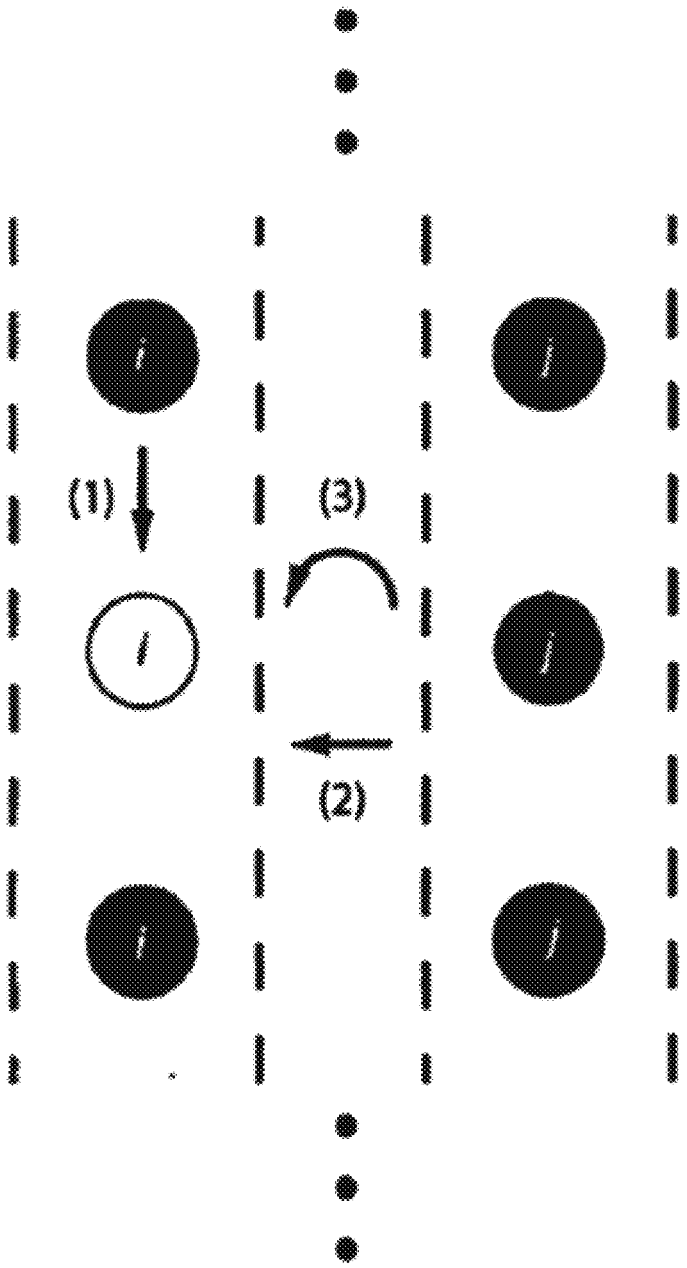
FIG. 45 depicts dipolar interaction mechanisms for a DDA.

DDA methods in accordance with embodiments of the present disclosure can allow for one to self-consistently calculate the fields acting on each wire to determine the effective dipole moment of the aperture $m_i=a_iH_{loc}$, where $H_{loc}$ is the field due to all the other dipoles in the system and the incident field. To determine the local field acting on each particle, the various interaction methods between dipoles may be identified, as depicted in FIG. 45, which depicts the dipolar interaction mechanisms for the DDA. The local field for a single dipole is a sum of the incident field, (1) the field due to other dipole in the same column, (2) the field due to other columns of dipoles, and (3) the field radiated by a single dipole from another column. A given polarizable element i may experience the field generated by all the other dipoles in the same column as well as fields generated by all the other columns of identical columns j. Additionally, each dipole may experience the field of an isolated dipole j due to radiative coupling on the other side of the waveguide.

The field acting on each element is then:

$$\alpha_i^{-1}m_i=H_0(\vec{\rho}_{ij})+m_i\Sigma_{k\neq 0}G(kl\hat{z})+\Sigma_{j\neq i}m_j[G(\vec{\rho}_{ij})+\Sigma_k G(\vec{\rho}_{ij}+kl\hat{z})]$$

where $G(\vec{r})$ is the 2D magnetic Green's function. This system of equations may be written in matrix form: $Am=H_0$, where m is an N dimensional vector of dipole moments. m is then determined by matrix inversion of A.

This DDA method generalizes to three dimensions in a straightforward manner. The same method can be used for rectangular waveguides and other transmission line layouts using image theory. Additionally, this method can account for interaction between anisotropic magnetic and electric elements when the Dyadic Green's function functions for both magnetic and electric sources are included. This method may be extended to conformal arrays when the Green's function in the radiative correction term is modified to account for the altered topology. This can be done analytically for simple surfaces such as spheres and cylinders, and with asymptotic techniques for more complicated shapes.

As opposed to full-wave solvers, the DDA is ideal for optimization problems. For instance, the 1D array that can act as a surface scattering antenna. Described herein are embodiments that allows for the determination of a distribution of polarizabilities to generate a certain field configuration in the radiating aperture.

The classical hologram seeks an aperture modulation function $\psi(x)$ which transforms a reference wave $E_{ref}(x)$ into a desired aperture wave $E_{opt}(x)$, such that $$E_{ref}(x)\psi(x)=E_{opt}(x)$$

one such solution (though not necessarily the only solution) is for $\psi$ to take the form of the interference between $E_{ref}$ and $E_{opt}$. If the following is set:

$$\psi(x)=\frac{E'_{ref}(x)E_{opt}(x)}{|E_{ref}|^2}$$

then when the modulation is re-illuminated by the reference mode, the result is:

$$E_{ref}(x)\psi(x)=E_{ref}\left[\frac{E_{ref}(x)E_{opt}(x)}{|E_{ref}|^2}\right]=E_{opt}(x);$$

the desired aperture field times a spatial constant—which can be ignored through renormalization of $\psi$. This approach breaks down if there are interactions such that the form of the modulation perturbs the reference mode. In this case, a solution $\psi$ is sought to the more complex transcendental problem $$E_{ref}(s,\ \psi(x)\psi(x)=E_{opt}.$$

This can be solved using a perturbative approach, treating the above solution as the zeroth-order guess. For simplicity, (x) is omitted but it is noted that spatial dependence remains, writing:

$$\psi^0=E'^{0}_{ref}E_{opt}$$

$$E_{ref}^1=\mathbb{F}[E_{ref}^0,\ \psi(E_{ref}^0)].$$

$$\psi^1=E'^{1}_{ref}E_{opt}$$

where $\mathbb{F}[\ ]$ is a function that describes the interaction between the hologram and the reference mode, and it can be provided by the DDA method. When the correction is small, such that $|E_{ref}^0-E_{ref}^1|<E_{ref}^0$, more accurate solutions may be iteratively arrived at for the hologram, as the series converges $\psi^0, \psi^1, \psi^2 \ldots \rightarrow\psi$. Once the modulation function is known, the physical scattering elements may be adjusted to provide the correct distribution of polarizabilities.

Figure 46:
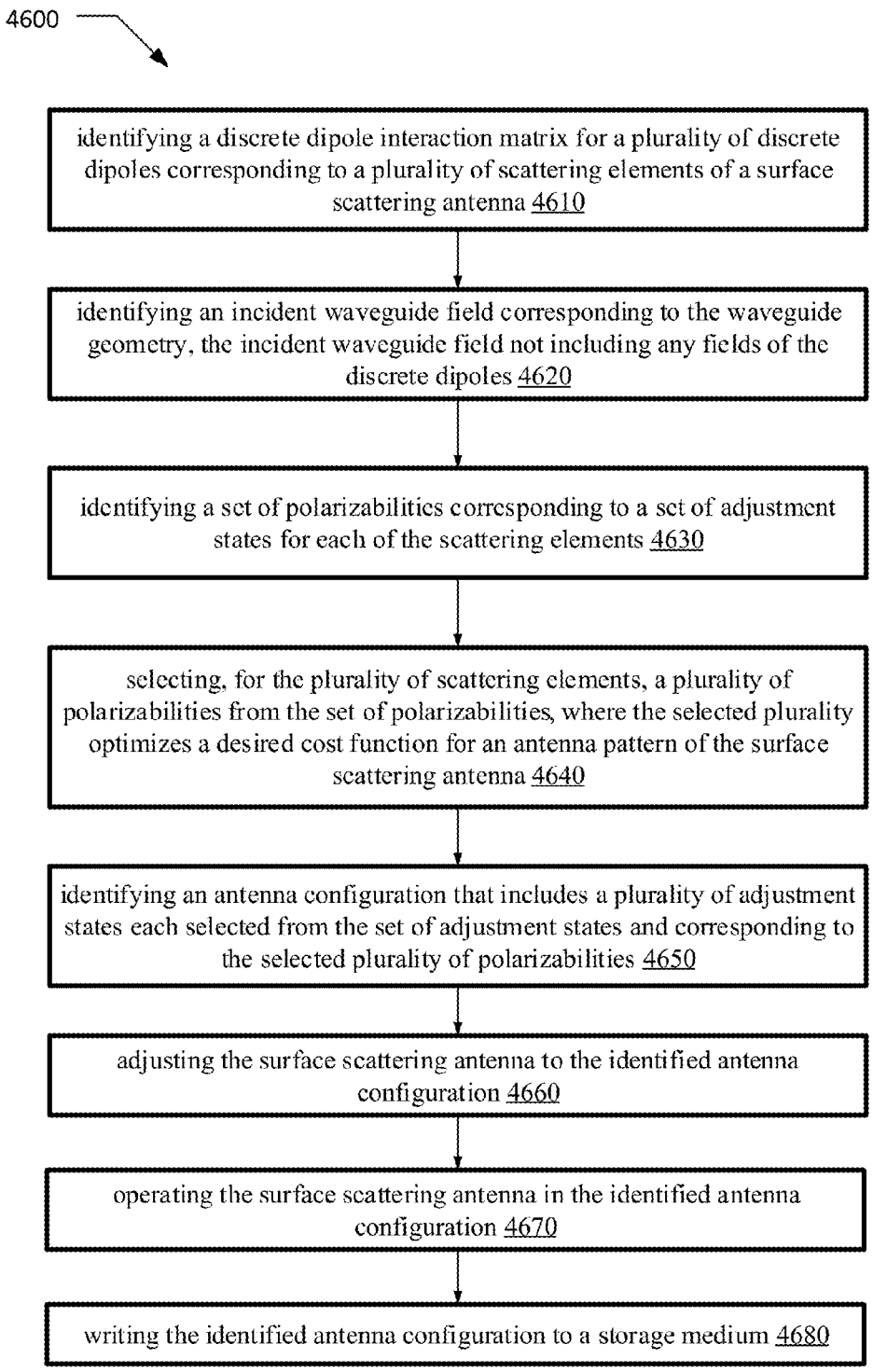
FIG. 46 shows a process flow diagram of an embodiment of the present disclosure.

With reference now to FIG. 46, an illustrative embodiment is depicted as a process flow diagram. Flow 4600 includes operation 4610—identifying a discrete dipole interaction matrix for a plurality of discrete dipoles corresponding to a plurality of scattering elements of a surface scattering antenna. For example, the discrete dipole interaction matrix may be calculated by evaluating Green's function for displacements between pairs of locations of scattering elements of the surface scattering antenna, e.g. using the equations described herein regarding the field acting on each element. By using image theory, the effect of a conducting surface of the waveguide may be handled as an equivalent problem without the conducting surface but with images of the discrete dipoles at locations that are reflections across the conducting surface; this allows the use of free-space Green's functions to define the discrete dipole interaction matrix. Alternatively, the Green's functions may be evaluated for radiation of the discrete dipoles in the presence of the conducting surfaces of the waveguide. This may be done analytically for some geometries, or, more generally, by using a full-wave electromagnetic simulator such as HFSS, Comsol, or Microwave Studio.

Flow 4600 optionally further includes operation 4620—identifying an incident waveguide field corresponding to the waveguide geometry, the incident waveguide field not including any fields of the discrete dipoles. Thus, for example, for a discrete dipole model described by the equation $Am=H_0$, where A is the discrete dipole interaction matrix and m is the N dimensional vector of dipole moments (for N scattering elements), the applied field $H_0$ corresponds to the mode that would propagate in the waveguide in the absence of the discrete dipole fields.

Flow 4600 optionally further includes operation 4630—identifying a set of polarizabilities corresponding to a set of adjustment states for each of the scattering elements. For example, if the scattering elements are adjustable by applying a set of control signals to the scattering elements, such as bias voltage levels, then each adjustment state of a scattering element will corresponding to a particular polarizability of the scattering element at an operating frequency of the antenna. The polarizability can include an electric polarizability, a magnetic polarizability, a magnetoelectric coupling, or any combination thereof. In some approaches, the correspondence between the polarizability and the adjustment state may be determined by performing a full-wave simulation of a scattering element and evaluating the scattering data.

Flow 4600 optionally further includes operation 4640—selecting, for the plurality of scattering elements, a plurality of polarizabilities from the set of polarizabilities, where the selected plurality optimizes a desired cost function for an antenna pattern of the surface scattering antenna. Various optimization algorithms may be used to find the set of polarizabilities that optimizes the cost function, such as a standard Newton, damped Newton, conjugate-gradient, or any other gradient-based nonlinear solver. Various cost functions may be suitable for desired applications, including: maximization of the gain or directivity of the surface scattering antenna in a selected direction, minimization of a half-power beamwidth of a main beam of the antenna pattern, minimization of a height of a highest side lobe relative to a main beam of the antenna pattern, or combinations of these cost functions.

Flow 4600 optionally further includes operation 4650—identifying an antenna configuration that includes a plurality of adjustment states each selected from the set of adjustment states and corresponding to the selected plurality of polarizabilities. Thus, if the optimization operation 4640 obtains a set of optimal polarizabilities, these may be mapped to a set of adjustment states for the scattering elements (such as a set of control voltages) to be applied to the scattering elements to obtain the desired polarizabilities. Flow 4600 optionally further includes operation 4660—adjusting the surface scattering antenna to the identified antenna configuration. For example, the surface scattering antenna may include driver circuitry configured to apply a set of bias voltages to the scattering elements, establishing a modulation pattern. Flow 4600 optionally further includes operation 4670—operating the surface scattering antenna in the identified antenna configuration. Thus, for example, once the surface scattering antenna has been configured with a desired modulation pattern, the antenna can be operated to transmit or receive as appropriate. Flow 4600 optionally further includes operation 4680—writing the identified antenna configuration to a storage medium. Thus, if the optimization operation 4640 obtains a set of optimal polarizabilities, these polarizabilities (or the corresponding adjustment states) may be written to a storage medium so that they can be later recalled to avoid repeating the optimization operation.

Figure 47:
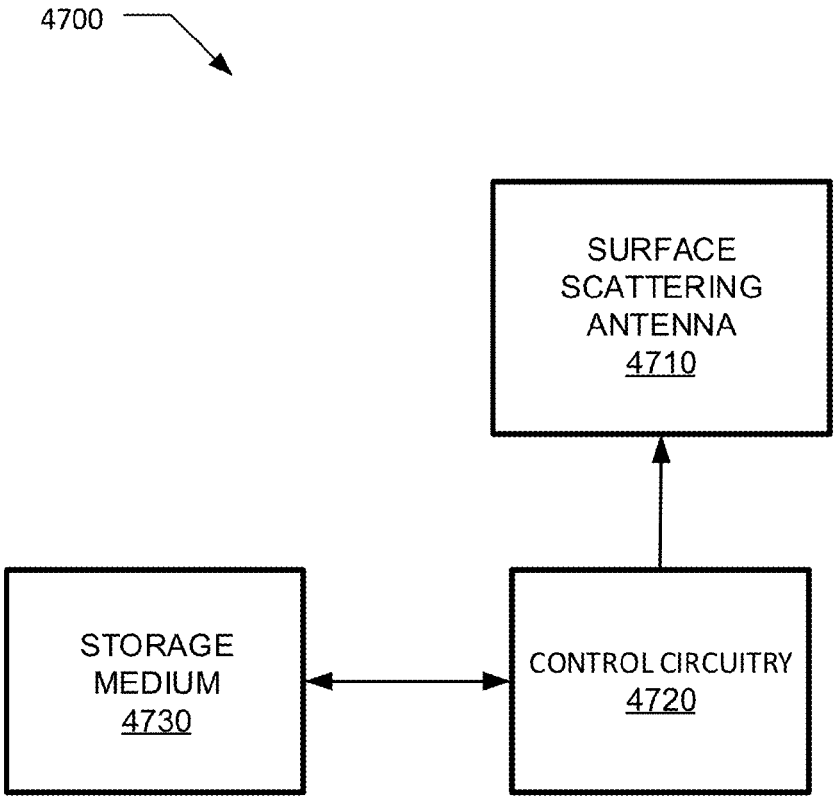
FIG. 47 shows a system block diagram in accordance with an embodiments of the present disclosure.

With reference now to FIG. 47, an illustrative embodiment is depicted as a system block diagram. The system 4700 includes a surface scattering antenna 4710 coupled to control circuitry 4720 operable to adjust the surface scattering to any particular antenna configuration. The system optionally includes a storage medium 4730 on which is written a set of pre-calculated antenna configurations. For example, the storage medium may include a look-up table of antenna configurations indexed by some relevant operational parameter of the antenna, such as beam direction, each stored antenna configuration being previously calculated according to one or more of the approaches described above, e.g. as in FIG. 46. Then, the control circuitry 4720 can operate to read an antenna configuration from the storage medium and adjust the antenna to the selected, previously-calculated antenna configuration. Alternatively, the control circuitry 4720 may include circuitry operable to calculate an antenna configuration according to one or more of the approaches described above, e.g. as in FIG. 46, and then to adjust the antenna for the presently-calculated antenna configuration.

Figure 48:
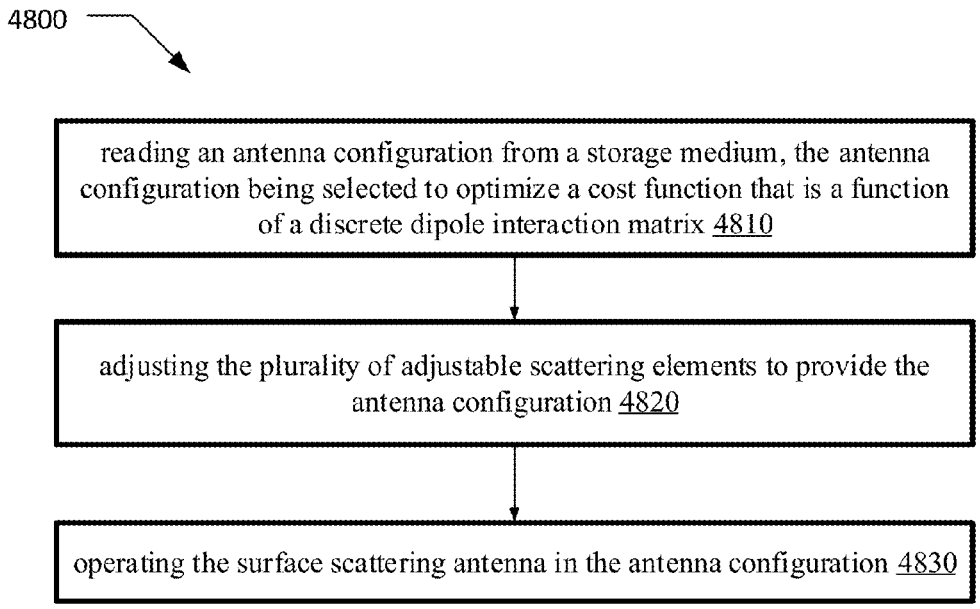
FIG. 48 shows a process flow diagram of an embodiment of the present disclosure.

With reference now to FIG. 48, an illustrative embodiment is depicted as a process flow diagram. Flow 4800 includes operation 4810—reading an antenna configuration from a storage medium, the antenna configuration being selected to optimize a cost function that is a function of a discrete dipole interaction matrix. For example, the control circuitry 4720 of FIG. 47 can be used to read an antenna configuration from storage medium 4730, the antenna configuration having been previously calculated, e.g. according to the process of FIG. 46. Flow 4800 further includes operation 4820—adjusting the plurality of adjustable scattering elements to provide the antenna configuration. For example, the control circuitry 4720 of FIG. 47 can be used to apply control signals, e.g. bias voltage settings, to the scattering elements of the surface scattering antenna 4710. Flow 4800 optionally further includes operation 4830—operating the surface scattering antenna in the antenna configuration. Thus, for example, once the surface scattering antenna has been configured with a desired modulation pattern, the antenna can be operated to transmit or receive as appropriate.

The various techniques described herein may be implemented with hardware or software or, where appropriate, with a combination of both. Thus, the methods and apparatus of the disclosed embodiments, or certain aspects or portions thereof, may take the form of program code (i.e., instructions) embodied in tangible media, such as floppy diskettes, CD-ROMs, hard drives, or any other machine-readable storage medium, wherein, when the program code is loaded into and executed by a machine, such as a computer, the machine becomes an apparatus for practicing the presently disclosed subject matter. In the case of program code execution on programmable computers, the computer will generally include a processor, a storage medium readable by the processor (including volatile and non-volatile memory and/or storage elements), at least one input device and at least one output device. One or more programs may be implemented in a high level procedural or object oriented programming language to communicate with a computer system. However, the program(s) can be implemented in assembly or machine language, if desired. In any case, the language may be a compiled or interpreted language, and combined with hardware implementations.

The described methods and apparatus may also be embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, a video recorder or the like, the machine becomes an apparatus for practicing the presently disclosed subject matter. When implemented on a general-purpose processor, the program code combines with the processor to provide a unique apparatus that operates to perform the processing of the presently disclosed subject matter.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

REFERENCES

[1] Landy, N. I., Urzhumov, Y., and Smith, D. R., Quasi-Conformal Approaches for Two and Three-Dimensional Transformation Optical Media, in *Transformation Electromagnetics and Metamaterials*, Springer US, 2014.

[2] Landy, N. and Smith, D. R., Nature materials 12 (2013) 25.

[3] Kundtz, N., *Advances in Complex Artificial Electromagnetic Media*, PhD thesis, Duke University, 2009.

[4] Schurig, D., Pendry, J., and Smith, D., Opt. Express 14 (2006) 9794.

[5] Prost, E. J., *Formal Structure of Electromagnetics*, Dover Publications, 1997.

[6] Pendry, J. B., Schurig, D., and Smith, D. R., Science (New York, N.Y.) 312 (2006) 1780.

[7] Zhang, B., Luo, Y., Liu, X., and Barbastathis, G., Physical Review Letters 106 (2011) 033901.

[8] Chen, X. et al., Nature communications 2 (2011) 176.

[9] Schurig, D. et al., Science (New York, N.Y.) 314 (2006) 977.

[10] Liu, R. et al., Science (New York, N.Y.) 323 (2009) 366.

[11] Ma, Y., Ong, C., Tyc, T., and Leonhardt, U., Nature materials (2009) 1.

[12] Valentine, J., Li, J., Zentgraf, T., Bartal, G., and Zhang, X., Nature materials 8 (2009) 568.

[13] Li, C., Liu, X., and Li, F., Physical Review B 81 (2010) 115133.

[14] Ma, H. F. and Cui, T. J., Nature communications 1 (2010) 21.

[15] Ma, H. F. and Cui, T. J., Nature communications 1 (2010) 124.

[16] Fischer, J., Ergin, T., and Wegener, M., Optics letters 36 (2011) 2059.

[17] Tichit, P.-H., Burokur, S. N., Germain, D., and de Lustrac, a., Physical Review B 83 (2011) 155108.

[18] Hunt, J., Kundtz, N., Sun, B., and Smith, D. R., 8021 (2011) 80210O.

[19] Hunt, J., Jang, G., and Smith, D. R., Journal of the Optical Society of America B 28 (2011) 2025

[20] Hunt, J. et al., Optics express 20 (2012) 1706.

[21] Driscoll, T. et al., Opt. Express 20 (2012) 28.

[22] Yang, F., Mei, Z. L., Jin, T. Y., and Cui, T. J., Physical Review Letters 109 (2012) 053902.

[23] Shelkunoff, S. A. and Friis, H. T., *Antennas: Theory and Practice*, Wiley, New York, 1952.

[24] Pendry, J., a. J. Holden, Robbins, D., and Stewart, W., IEEE Transactions on Microwave Theory and Techniques 47 (1999) 2075.

[25] Ramo, S., Whinnery, J., and Van Duzer, T., Fields and Waves in Communication Electronics, John Wiley & Sons, 3rd edition, 1994.

[26] Balanis, C., *Advanced Engineering Electromagnetics*, John Wiley & Sons, New York, 1989.

[27] Petschulat, J. et al., Physical Review A 78 (2008) 043811.

[28] Simovski, C. and Tretyakov, S., Photonics and Nanostructures—Fundamentals and Applications 8 (2010) 254.

[29] Marqu'es, R., Medina, F., and Rafii-El-Idrissi, R., Physical Review B 65 (2002) 144440.

[30] Smith, D. R., Gollub, J., Mock, J. J., Padilla, W. J., and Schurig, D., Journal of Applied Physics 100 (2006) 024507.

[31] Padilla, W. J., Optics express 15 (2007) 1639.

[32] Tretyakov, S., *Analytical Modeling in Applied Electromagnetics*, Artech House, 2003.

[33] Smith, D. R. and Pendry, J. B., Journal of the Optical Society of America B 23 (2006) 391.

[34] Simovski, C. R., Metamaterials 1 (2007) 62.

[35] Smith, D. R. et al., Applied Physics Letters 82 (2003) 1506.

[36] E., R. R. and De, L. O. L., *Multipole theory in electromagnetism: classical, quantum, and symmetry aspects, with applications*, Clarendon Press, 2005.

[37] Smith, D. R., Urzhumov, Y., Kundtz, N. B., and Landy, N. I., Optics express 18 (2010) 21238.

[38] Rahm, M., Cummer, S., Schurig, D., Pendry, J., and Smith, D., Physical Review Letters 100 (2008) 063903.

[39] Thompson, J., Soni, B., and Weatheri, N. P., editors, *Handbook of Grid Generation*, CRC Press, Boca Raton, 1999.

[40] Li, J. and Pendry, J. B., Physical Review Letters 101 (2008) 203901.

[41] Knupp, P. and Steinberg, S., *Fundamentals of Grid Generation*, CRC Press, Boca Raton, 1994.

[42] Tang, L. et al., Opt. Express 19 (2011) 15119.

[43] Chang, Z., Zhou, X., Hu, J., and Hu, G., Optics express 18 (2010) 6089.

[44] Zhang, B., Chan, T., and Wu, B.-I., Physical Review Letters 104 (2010) 233903.

[45] Tang, W., Argyropoulos, C., and Kallos, E., IEEE Transactions on Antennas and Propagation 58 (2010) 3795.

[46] Kong, F. et al., Applied Physics Letters 91 (2007) 253509.

[47] Mei, Z. L., Bai, J., and Cui, T. J., New Journal of Physics 13 (2011) 063028.

[48] Garć ia-Meca, C., Mart inez, A., and Leonhardt, U., Optics express 19 (2011) 23743.

[49] Roberts, D. a., Rahm, M., Pendry, J. B., and Smith, D. R., Applied Physics Letters 93 (2008) 251111.

[50] Rahm, M., Roberts, D. A., Pendry, J. B., and Smith, D. R., Opt. Express 16 (2008) 11555.

[51] Landy, N. I. and Padilla, W. J., Optics express 17 (2009) 14872.
[52] Ma, Y. G., Wang, N., and Ong, C. K., Journal of the Optical Society of America A 27 (2010) 968.
[53] Schurig, D., New Journal of Physics 10 (2008) 115034.
[54] Sluijter, M., de Boer, D. K. G., and Braat, J. J. M., Journal of the Optical Society of America A 25 (2008) 1260.
[55] Sluijter, M., de Boer, D. K., and Paul Urbach, H., Journal of the Optical Society of America A 26 (2009) 317.
[56] Damaskos, N., IEEE Transactions on Antennas and Propagation 30 (1982) 991.
[57] Landy, N. I., Kundtz, N., and Smith, D. R., Physical Review Letters 105 (2010) 193902.
[58] Luneburg R., *Mathematical Theory of Optics*, Univ of California Press, 1964. [59] Kundtz, N. and Smith, D. R., Nature materials 9 (2010) 129.
[60] Jacob, Z., Alekseyev, L. V., and Narimanov, E., Journal of the Optical Society of America A 24 (2007) A52.
[61] Press, W. H., Teukolsky, S. A., Vetterling, W. T., and Flannery, B. P., Numerical Recipes 3*rd Edition: The Art of Scientific Computing*, volume 1, 2007.
[62] Halimeh, J. C., Ergin, T., Mueller, J., Stenger, N., and Wegener, M., Optics express 17 (2009) 19328.
[63] Ergin, T., Halimeh, J. C., Stenger, N., and Wegener, M., Optics express 18 (2010) 20535.
[64] Leonhardt, U., Science (New York, N.Y.) 312 (2006) 1777.
[65] Urzhumov, Y., Landy, N., and Smith, D. R., Journal of Applied Physics 111 (2012) 053105.
[66] Andreasen, M., IEEE Transactions on Antennas and Propagation (1965).
[67] Cai, W., Chettiar, U. K., Kildishev, A. V., Shalaev, V. M., and Milton, G. W., Applied Physics Letters 91 (2007) 111105.
[68] Cai, W., Chettiar, U. K., Kildishev, A. V., and Shalaev, V. M., Nature Photonics 1 (2007) 224.
[69] Smolyaninov, I., Smolyaninova, V., Kildishev, A., and Shalaev, V., Physical Review Letters 102 (2009) 213901.
[70] Yan, M., Ruan, Z., and Qiu, M., Physical Review Letters 99 (2007) 233901.
[71] Luo, Y., Zhang, J., Chen, H., and Ran, L., IEEE Transactions on Antennas and Propagation 57 (2009).
[72] Xi, S., Chen, H., Wu, B.-i., and Kong, J. A., IEEE Microwave and Wireless Components Letters 19 (2009) 131.
[73] Popa, B.-I. and Cummer, S. a., Physical Review B 83 (2011) 224304.
[74] Cummer, S. A., Member, S. S., Popa, B.-i., and Hand, T. H., IEEE Transactions on Antennas and Propagation 56 (2008) 127.
[75] Kabiri, A., Yousefi, L., and Ramahi, 0. M., 58 (2010) 2345.
[76] Kildal, P., Electronics Letters 24 (1988) 3.
[77] Kildal, P., IEEE Transactions on Antennas and Propagation 38 (1990).
[78] Kildal, P.-s., Kishk, A. A., and Tengs, A., IEEE Transactions on Antennas and Propagation 44 (1996).
[79] Purcell, E. and Pennypacker, C., The Astrophysical Journal 186 (1973) 705.
[80] Yurkin, M. and Hoekstra, A., Journal of Quantitative Spectroscopy and Radiative Transfer (2007).
[81] Yurkin, M. a., Hoekstra, A. G., Brock, R. S., and Lu, J. Q., Optics express 15 (2007) 17902.
[82] Liu, C., Bi, L., Panetta, R. L., Yang, P., and Yurkin, M. A., Opt. Express 20 (2012) 16763.
[83] Bowen, P. T., Driscoll, T., Kundtz, N. B., and Smith, D. R., New Journal of Physics 14 (2012) 033038.
[84] Lakhtakia, A., The Astrophysical Journal 394 (1992) 494.
[85] Mulholland, G., Bohren, C., and Fuller, K., Langmuir 10 (1994).
[86] Osa, R. A. d. L., Albella, P., and Saiz, J., Opt. Express 18 (2010) 23865.
[87] P. P., E., Ann. Phys. 369 (1921) 253.
[88] Reinert, J. and a.F. Jacob, IEEE Transactions on Antennas and Propagation 49 (2001) 1532.
[89] Jelinek, L. and Baena, J., . . . Conference, 2006. 36th . . . 0 (2006) 983.
[90] Silveirinha, M. G., Physical Review B 83 (2011) 165104.
[91] Rockstuhl, C. et al., Physical Review B 83 (2011) 245119.
[92] Fietz, C., Urzhumov, Y., and Shvets, G., Opt. Express 19 (2011) 9681.
[93] Andryieuski, A., Ha, S., Sukhorukov, A. a., Kivshar, Y. S., and Lavrinenko, A. V., Physical Review B 86 (2012) 035127.
[94] Smith, D. R. and Schultz, S., Physical Review B 65 (2002) 195104.
[95] Smith, D. R., Vier, D. C., Koschny, T., and Soukoulis, C. M., Physical Review E 71 (2005) 036617.
[96] Nicolson, a. M. and Ross, G. F., IEEE Transactions on Instrumentation and Measurement 19 (1970) 377.
[97] Weir, W. B., Proceedings of the IEEE 62 (1974).
[98] Koschny, T., Markos, P., Smith, D., and Soukoulis, C., Physical Review E 68 (2003) 065602.
[99] Koschny, T. et al., Physical Review B 71 (2005) 245105.
[100] Liu, R., Cui, T., Huang, D., Zhao, B., and Smith, D., Physical Review E 76 (2007) 026606.
[101] Smith, D. R., Physical Review E 81 (2010) 036605.
[102] Chen, X., Grzegorczyk, T., Wu, B.-I., Pacheco, J., and Kong, J., Physical Review E 70 (2004) 016608.
[103] Qi, J. and Kettunen, H., Antennas and Wireless Propagation Letters 9 (2010) 1057.
[104] Liu, X.-X., Powell, D. a., and Alu, A., Physical Review B 84 (2011) 235106.
[105] Scher, A. D. and Kuester, E. F., Metamaterials 3 (2009) 44.
[106] Karamanos, T. and Dimitriadis, A., Advanced Electromagnetics (2012).
[107] Draine, B. T. and Goodman, J., The Astrophysical Journal 405 (1993) 685.
[108] Collin, R., *Field Theory of Guided Waves*, IEEE Press, New York, 2nd edition, 1991.
[109] Belov, P. and Simovski, C., Physical Review E 72 (2005) 026615.
[110] Vinogradov, a. P., Ignatov, a. I., Merzlikin, a. M., Tretyakov, S. a., and Simovski, C. R., Optics express 19 (2011) 6699.
[111] Simovski, C. R. and Tretyakov, S. a., Physical Review B 75 (2007) 195111.
[112] Simovski, C. R., Optics and Spectroscopy 107 (2009) 726.
[113] Lemaire, T., Journal of the Optical Society of America A 14 (1997) 470.
[114] Bethe, H., Physical Review (1944).
[115] Collin, R. E., *Foundations for Microwave Engineering*, John Wiley & Sons, New York, 2000.
[116] Pozar, D. M., *Microwave Engineering*, John Wiley & Sons, New York, 3rd edition, 2005.

[117] Monk, B., *Frequency Selective Surfaces: Theory and Design*, John Wiley & Sons, New York, 2000.

[118] Falcone, F. et al., Physical Review Letters 93 (2004) 197401.

[119] Hand, T. H., Gollub, J., Sajuyigbe, S., Smith, D. R., and Cummer, S. a., Applied Physics Letters 93 (2008) 212504.

[120] Yang, X. M. et al., IEEE Transactions on Antennas and Propagation 59 (2011) 373.

[121] Sipe, J. E. and Kranendonk, J. V., Physical Review A 9 (1974).

[122] Oliner, A. A. and Jackson, D. R., Leaky Wave Antennas, in *Modern Antenna Handbook*, pages 325-368, 2008.

[123] Landy, N., Hunt, J., and Smith, D. R., Photonics and Nanostructures—Fundamentals and Applications (2013).

[124] Yaghjian, A. D., *Near-field Antenna measurements on a cylindrical surface: a source-scattering matrix formulation,* 1977.

[125] Giovampaola, C. D., Martini, E., Toccafondi, A., Member, S., and Maci, S., IEEE Transactions on Antennas and Propagation 60 (2012) 4316.

[126] Xu, H., Jackson, D. R., and Williams, J. T., IEEE Transactions on Antennas and Propagation 53 (2005) 3229.

What is claimed is:

1. A method, comprising:

identifying a discrete dipole interaction matrix for a plurality of discrete dipoles corresponding to a plurality of scattering elements of a surface scattering antenna, where the identifying of the discrete dipole matrix includes identifying a waveguide geometry and plurality of locations of the scattering elements for the surface scattering antenna;

identifying a set of polarizabilities corresponding to a set of adjustment states for each of the scattering elements;

selecting, for the plurality of scattering elements, a plurality of polarizabilities from the set of polarizabilities, where the selected plurality optimizes a desired cost function for an antenna pattern of the surface scattering antenna; and identifying an antenna configuration that includes a plurality of adjustment states each selected from the set of adjustment states and corresponding to the selected plurality of polarizabilities;

wherein the cost function for each trial plurality of polarizabilities is evaluated by:

identifying an incident waveguide field corresponding to the waveguide geometry, the incident waveguide field not including any fields of the discrete dipoles;

using the dipole interaction matrix and the incident waveguide field to calculate a plurality of dipole moments resulting from the trial plurality of polarizabilities for the plurality of discrete dipoles;

calculating a trial antenna pattern for the plurality of dipole moments; and evaluating the cost function for the trial antenna pattern.

2. The method of claim 1, wherein the waveguide geometry is a closed waveguide geometry.

3. The method of claim 2, wherein the closed waveguide geometry is a substrate-integrated waveguide geometry.

4. The method of claim 1, wherein the scattering elements include subwavelength patch elements.

5. The method of claim 1, wherein the identifying of the discrete dipole interaction matrix further includes:

evaluating Green's functions for displacements between pairs of locations selected from the plurality of locations.

6. The method of claim 1, wherein the scattering elements are voltage-controlled scattering elements, and the set of adjustment states is a set of applied voltage states for the voltage-controlled scattering elements.

7. The method of claim 6, wherein the scattering elements include an electrically-adjustable material, and the set of applied voltage states is a set of bias voltages for the electrically-adjustable material.

8. The method of claim 6, wherein the scattering elements include lumped elements, and the set of applied voltage states is a set of bias voltages for the lumped elements.

9. The method of claim 1, wherein the cost function maximizes a gain of the surface scattering antenna in a selected direction, maximizes a directivity of the surface scattering antenna in a selected direction, minimizes a half-power beamwidth of a main beam of the antenna pattern, or minimizes a height of a highest side lobe relative to a main beam of the antenna pattern.

10. The method of claim 1, further comprising:

adjusting the surface scattering antenna to the identified antenna configuration.

11. The method of claim 1, further comprising:

operating the surface scattering antenna in the identified antenna configuration.

12. The method of claim 1, further comprising:

writing the identified antenna configuration to a storage medium.

13. A system, comprising:

a surface scattering antenna with a plurality of adjustable scattering elements, wherein the surface scattering antenna includes a waveguide coupled to the plurality of adjustable scattering elements;

a storage medium on which a set of antenna configurations is written, each antenna configuration being selected to optimize a cost function that is a function of a discrete dipole interaction matrix; and control circuitry operable to read the antenna configurations from the storage medium and adjust the plurality of adjustable scattering elements to provide the antenna configurations;

wherein, for each antenna configuration, the cost function provides a selected optimization of an antenna pattern of the surface scattering antenna.

14. The system of claim 13 , wherein the waveguide is a closed waveguide.

15. The system of claim 14, wherein the closed waveguide is a substrate-integrated waveguide.

16. The system of claim 13, wherein the scattering elements include subwavelength patch elements.

17. The system of claim 13, wherein the discrete dipole interaction matrix includes Green's functions for displacements between pairs of locations selected from a plurality of locations of the adjustable scattering elements.

18. The system of claim 13, wherein each of the adjustable scattering elements is adjustable between a set of adjustment states corresponding to a set of polarizabilities for each of the adjustable scattering elements.

19. The system of claim 18, wherein the adjustable scattering elements are voltage-controlled scattering elements, and the set of adjustment states is a set of applied voltage states for the voltage-controlled scattering elements.

20. The system of claim 19, wherein the adjustable scattering elements include an electrically-adjustable material, and the set of applied voltage states is a set of bias voltages for the electrically-adjustable material.

21. The system of claim 18, wherein the adjustable scattering elements include lumped elements, and the set of applied voltage states is a set of bias voltages for the lumped elements.

22. The system of claim 13, wherein the selected optimization of the antenna pattern maximizes a gain of the surface scattering antenna in a selected direction, maximizes a directivity of the surface scattering antenna in a selected direction, minimizes a half-power beamwidth of a main beam of the antenna pattern, or minimizes a height of a highest side lobe relative to a main beam of the antenna pattern.

23. A method of controlling a surface scattering antenna with a plurality of adjustable scattering elements, comprising:

reading an antenna configuration from a storage medium, the antenna configuration being selected to optimize a cost function that is a function of a discrete dipole interaction matrix; and adjusting the plurality of adjustable scattering elements to provide the antenna configuration;

wherein, for each antenna configuration, the cost function provides a selected optimization of an antenna pattern of the surface scattering antenna, and wherein the surface scattering antenna includes a waveguide coupled to the plurality of adjustable scattering elements.

24. The method of claim 23, further comprising:

operating the surface scattering antenna in the antenna configuration.

25. The method of claim 23, wherein the waveguide is a closed waveguide.

26. The method of claim 25, wherein the closed waveguide is a substrate-integrated waveguide.

27. The method of claim 23, wherein the scattering elements include subwavelength patch elements.

28. The method of claim 23, wherein the discrete dipole interaction matrix includes Green's functions for displacements between pairs of locations selected from a plurality of locations of the adjustable scattering elements.

29. The method of claim 23, wherein each of the adjustable scattering elements is adjustable between a set of adjustment states corresponding to a set of polarizabilities for each of the adjustable scattering elements.

30. The method of claim 29, wherein the adjustable scattering elements are voltage-controlled scattering elements, and the set of adjustment states is a set of applied voltage states for the voltage-controlled scattering elements.

31. The method of claim 30, wherein the adjustable scattering elements include an electrically-adjustable material, and the set of applied voltage states is a set of bias voltages for the electrically-adjustable material.

32. The method of claim 29, wherein the adjustable scattering elements include lumped elements, and the set of applied voltage states is a set of bias voltages for the lumped elements.

33. The method of claim 23, wherein the selected optimization of the antenna pattern maximizes a gain of the surface scattering antenna in a selected direction, maximizes a directivity of the surface scattering antenna in a selected direction, minimizes a half-power beamwidth of a main beam of the antenna pattern, or minimizes a height of a highest side lobe relative to a main beam of the antenna pattern.

* * * * *